US008608410B2

(12) United States Patent
Shreider et al.

(10) Patent No.: US 8,608,410 B2
(45) Date of Patent: Dec. 17, 2013

(54) APPARATUS AND A METHOD FOR CONSTRUCTING AN UNDERGROUND CURVED MULTISECTIONAL WALL AND STRATUM

(76) Inventors: Vladimir Anatol Shreider, Sydney (AU); Natalia Shreider, Sydney (AU)

( * ) Notice: Subject to any disclaimer, the term of this patent is extended or adjusted under 35 U.S.C. 154(b) by 288 days.

(21) Appl. No.: 12/798,780

(22) Filed: Apr. 12, 2010

(65) Prior Publication Data

US 2010/0254768 A1 Oct. 7, 2010

Related U.S. Application Data

(63) Continuation-in-part of application No. 10/841,997, filed on May 10, 2004, now abandoned.

(51) Int. Cl.
*E02F 3/08* (2006.01)

(52) U.S. Cl.
USPC ..... 405/267; 405/232; 405/233; 37/465; 37/352

(58) Field of Classification Search
USPC ..... 405/267, 270, 271, 266, 286, 287, 405/287.1, 233, 236, 240–242, 268, 272, 405/282, 283; 37/462, 465, 349, 352, 353, 37/355, 403, 449, 195, 357, 142.5
See application file for complete search history.

(56) References Cited

U.S. PATENT DOCUMENTS

| | | | | |
|---|---|---|---|---|
| 1,343,081 | A * | 6/1920 | Hammen | 37/356 |
| 3,645,101 | A * | 2/1972 | Sherard | 405/267 |
| 3,820,345 | A * | 6/1974 | Brecht | 405/283 |
| 3,893,302 | A * | 7/1975 | Peterson | 405/267 |
| 3,903,624 | A * | 9/1975 | Holl | 37/351 |
| 3,994,139 | A * | 11/1976 | Foik | 405/157 |
| 4,247,997 | A * | 2/1981 | Paurat et al. | 37/351 |
| 4,588,329 | A * | 5/1986 | Gilchrist, Jr. | 405/283 |
| 4,681,483 | A * | 7/1987 | Camilleri | 405/267 |
| 4,861,199 | A * | 8/1989 | Hackmack | 405/267 |
| 5,112,161 | A * | 5/1992 | Trevisani | 405/267 |
| 5,244,315 | A * | 9/1993 | Kitanaka et al. | 405/267 |
| RE34,576 | E * | 4/1994 | Camilleri | 405/267 |
| 5,349,765 | A * | 9/1994 | Kitanaka et al. | 37/356 |
| 5,401,119 | A * | 3/1995 | Washington et al. | 405/179 |
| 5,639,182 | A * | 6/1997 | Paris | 405/128.5 |
| 5,685,668 | A * | 11/1997 | Justice | 405/267 |
| 5,788,422 | A * | 8/1998 | Gardner et al. | 405/267 |
| 5,791,825 | A * | 8/1998 | Gardner et al. | 405/267 |
| 6,059,447 | A * | 5/2000 | Paris | 366/271 |
| 6,139,225 | A * | 10/2000 | Koike et al. | 405/267 |
| 6,574,893 | B2 * | 6/2003 | Mizutani | 37/462 |
| 6,925,736 | B2 * | 8/2005 | Taki | 37/352 |
| 7,481,604 | B2 * | 1/2009 | Perpezat et al. | 405/267 |
| 8,061,065 | B2 * | 11/2011 | Shreider et al. | 37/462 |
| 8,079,163 | B2 * | 12/2011 | Shreider et al. | 37/462 |
| 2004/0208710 | A1 * | 10/2004 | Shreider et al. | 405/267 |

* cited by examiner

*Primary Examiner* — Frederick L Lagman

(57) ABSTRACT

Unit plates are supported by unit frames connected consecutively together for turning about axes being remote from and crossing a longitudinal axis of the frames with the ability to alternately be shifted about the turning axes by rams coupled between the plates and frames and expanded while the frames are shifted continuously. The front frame supports alternately a face-and-end pumping mill, facing disk or wedge or endless chain cutter. A ski tenon supported on the front end of the front frame that is able to be engaged with a ski-trak means of adjacent from behind the same unit frames for relative turning about the axes and disengaged in the trench.

40 Claims, 18 Drawing Sheets

40
17
33
16
35
42
43
37
39
36
48
52
51
23
53
47
54
D
52
55
54
49
48
54
51
51
46
B
54
50
53
52
58
32
52
34
41
43
38

33
35
40
59
44
52
58
54
45
F
53
54
54
54
G
54
56
24A 33
35
32
44
45
32
24 B 40
53
F
35
56
59
57
58
33
52
42
32
G
37

FIG.7
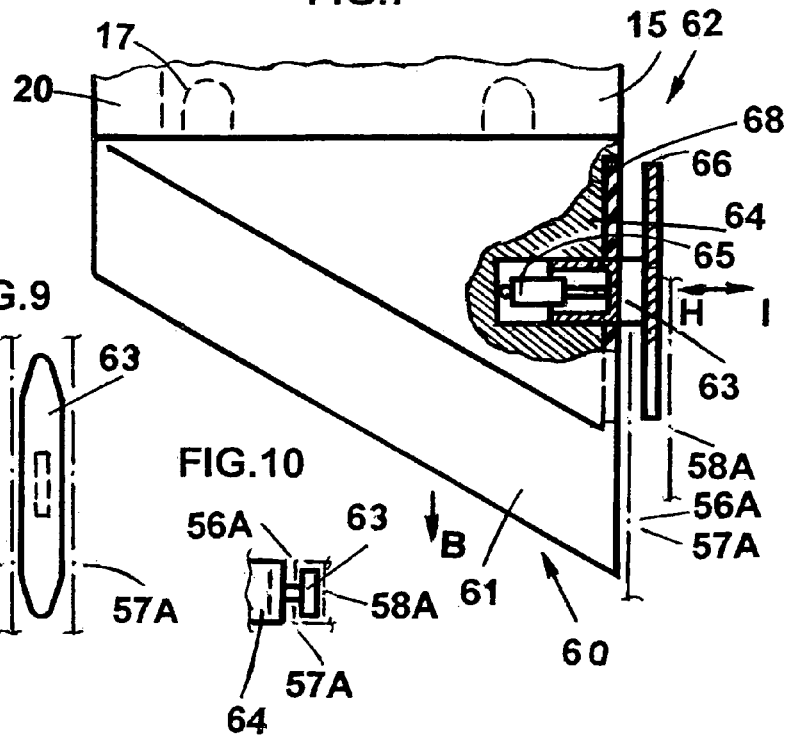
FIG.8
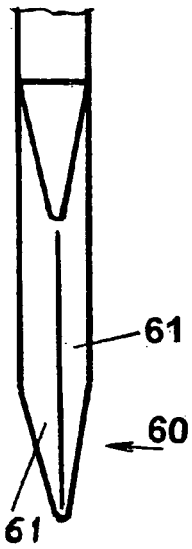
FIG.9
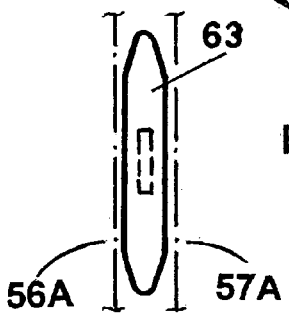
FIG.10
FIG.11
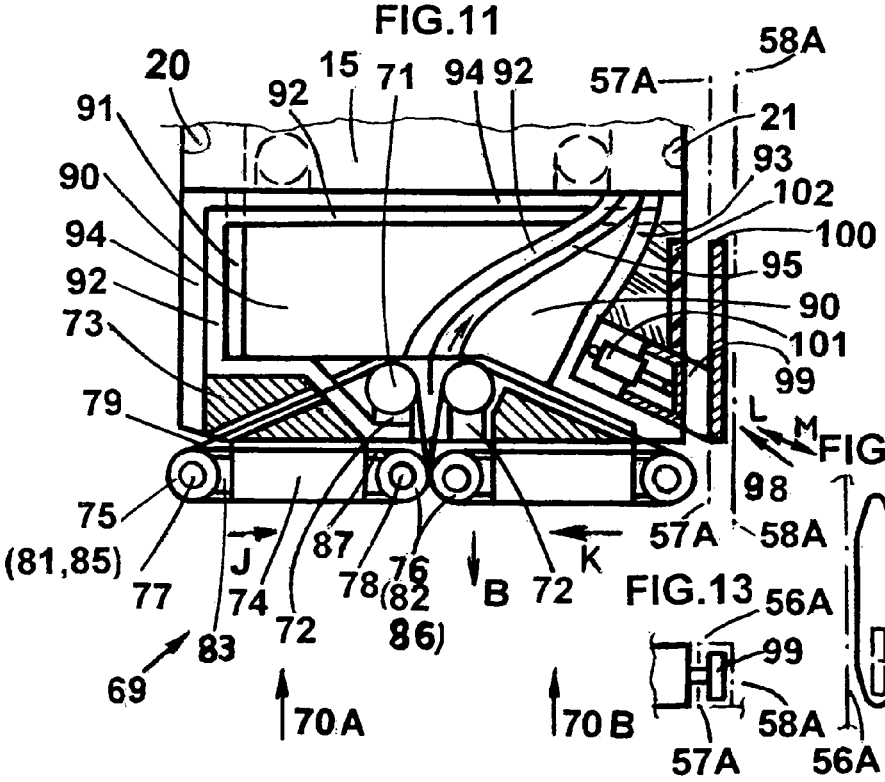
FIG.12
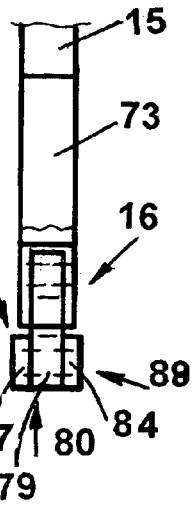
FIG.13
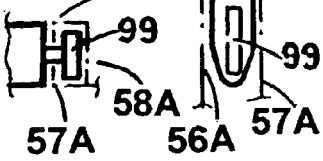
FIG.14
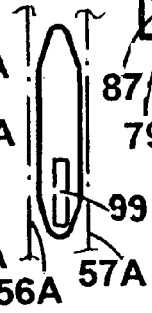

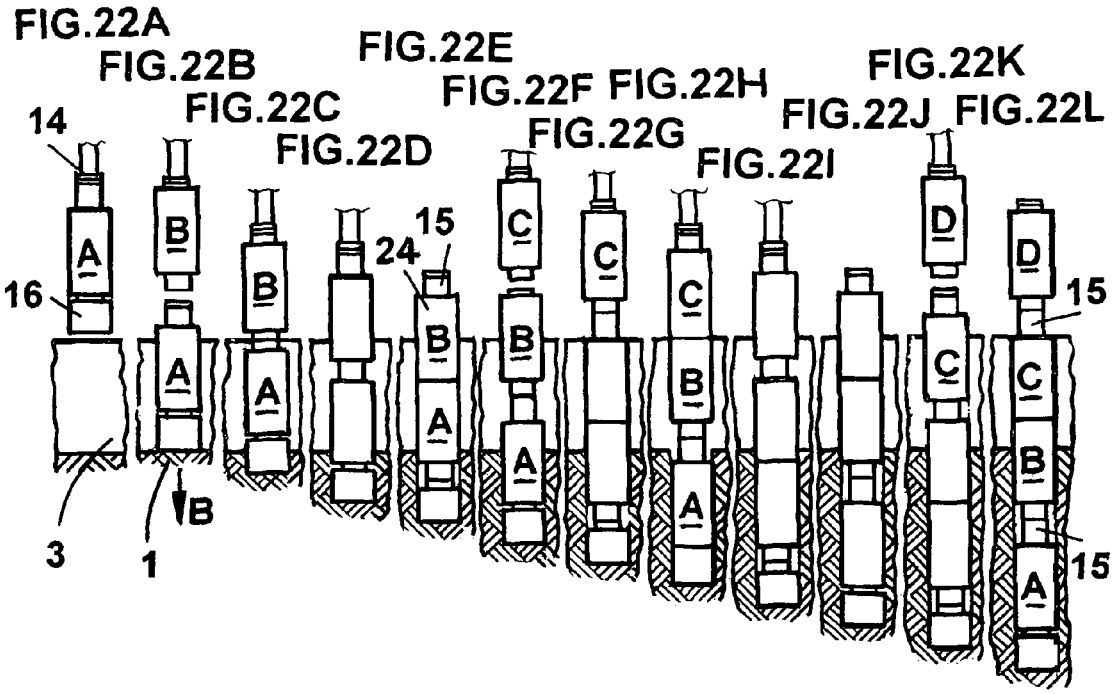
FIG.22A
FIG.22B
FIG.22C
FIG.22D
FIG.22E
FIG.22F
FIG.22G
FIG.22H
FIG.22I
FIG.22J
FIG.22K
FIG.22L
14
16
3
1
B
15
24
A
B
C
D
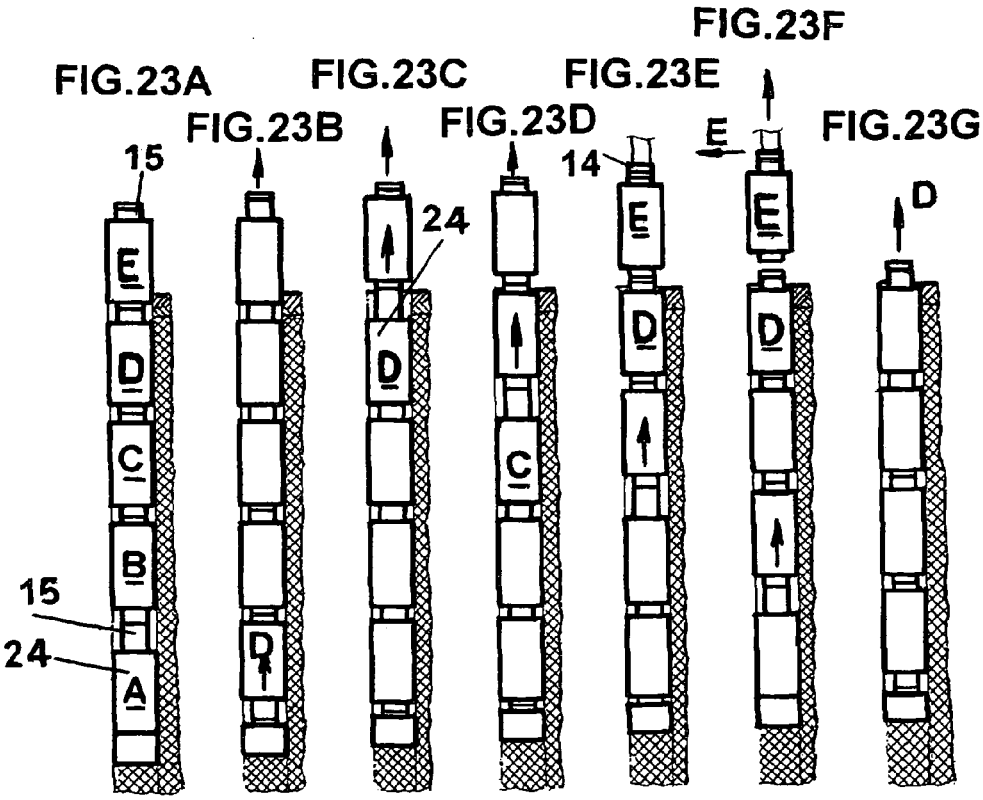
FIG.23A
FIG.23B
FIG.23C
FIG.23D
FIG.23E
FIG.23F
FIG.23G
15
24
14
E
D
C
B
A

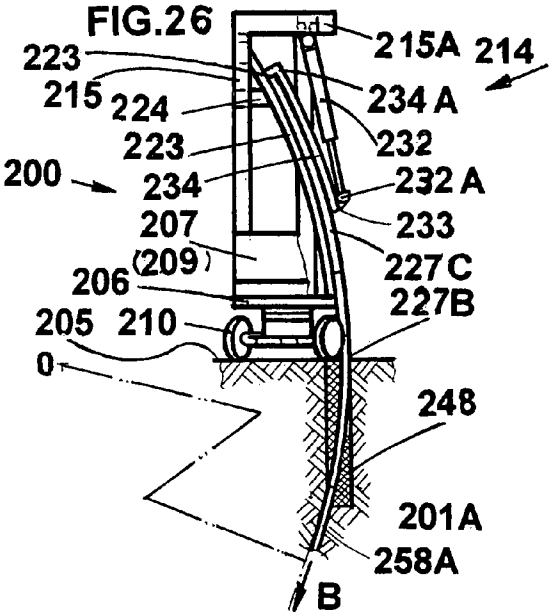
FIG.26
214
215A
234A
232
232A
233
227C
227B
248
201A
258A
B
O
223
215
224
223
234
207
(209)
206
210
205
200
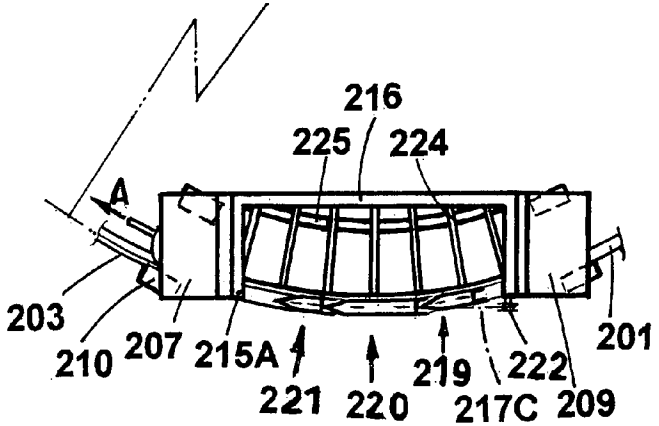
FIG.27
201
209
222
217C
219
220
221
224
216
225
215A
207
210
203
A
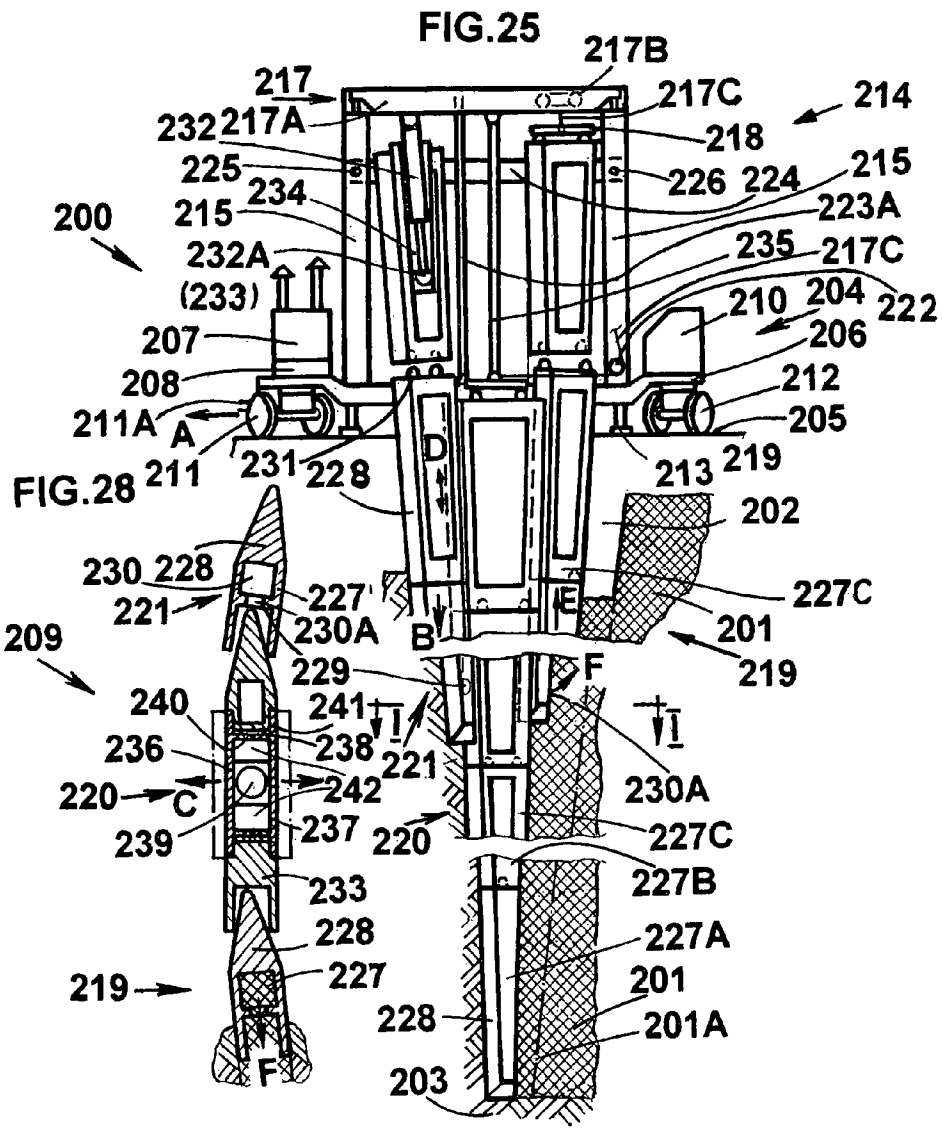
FIG.25
FIG.28
214
217B
217C
218
226
224
215
223A
235
217C
210
204
222
206
212
205
219
213
202
227C
201
219
230A
227C
227B
227A
201
201A
F
E
D
B
I
I
217
217A
232
225
234
215
232A
(233)
207
208
211A
A
211
231
228
227
230A
229
241
238
242
237
233
228
227
221
220
228
203
230
228
221
240
236
C
220
239
209
219

227'
228'
227'A
228A
229'
229'A
229A
228A
229
242
243
244
245
245A
246
247
248
248A
249
250
232
235
236
237
238
238A
217A
227B
227A
201
201A
201B
G
H
I
J
K
L
B
E 348
333
345
314'
353
352
349
351B
350
351A
354
355
356
358
350A
357
M
I
354A
352A
350'
350"
K
L
O
N
P
317'B
317'
367
365A
366
365
363
364B
364A
344A
345A
348A
314'A
319B
320
318B
362
360
361
301
301B
303
301A 411
415A
458
460
461
461A
460A
459C
459B
459A
459
462

446
447
N 447
0

458
461
459A 446
447A
450
451
448C
449
447A
448B
451
450
449

452
453
454
448
447A 455
456
457

411'A
415A
448
447B
449
447
448A
451
450
447A
446
C
B 466
463
426
466A
468
467
465
465A
465B
425
446
466B
464
414
469
470A
470
470B
470D
470C
471
471A
471B

411'E
477C
476C
475
469B
433C
476A
B
473
474
411'A
423
420
419

474
473
476
475
476C
469B
411'E
469C
476A
469A
476B

411'A
415A
477C
473
474B
476C
476A
469B
B
477B
474A
474
476
476B
475
469A
411'E

411'D
411'C
411'B
411'A
438
478
418B
411A
418A
411B
411C
411D
446
B

APPARATUS AND A METHOD FOR CONSTRUCTING AN UNDERGROUND CURVED MULTISECTIONAL WALL AND STRATUM

CROSS REFERENCE TO A RELATED APPLICATION

This application is a continuation-in-part of the parent application Ser. No. 10/841,997 filed May 10, 2004 and abandoned Dec. 10, 2007 now abandoned because an Office action non-delivered by Post and a late reply.

STATEMENT REGARDING FEDERALLY SPONSORED RESEARCH OR DEVELOPMENT

Not Applicable

REFERENCE TO A MICRIFICHE APPENDIX

Not Applicable

The invention relates to apparatuses and methods for excavating the ground to construct-in-place of a continuous multihole excavation such a trench and a gallery being formed, a structure such as a multi-column draining and retaining stratum and wall especially to control of ground gas and water flow through levees and to provide drainage, isolation, containment, and separation of subsurface environments.

In constructing a curved and narrow underground wall according to a prior art technique, first an elliptical hole of a width of 2 to 3 m is dug in the ground to a predetermined depth by a powerful bucket or two or by three series of auger drills. After the hole formed in slurry is sealed with a bentonite solution to prevent further penetration of slurry, a reinforcing bar cage is placed in the hole and a ready mixed concrete is then poured into the hole to form a structure column. Such a method is repeated to form a continuous multi-column wall. Solution layers interrupt the formation of the continuous wall so that after completion of the wall, ground water tends to leak into the inside of the wall through the joints. It is therefore very difficult to provide the continuous wall simultaneously having two function as foundation and diaphragm wall.

There is known to use an excavator disclosed in U.S. Pat. No. 5,244,315 for constructing an underground continuous wall, including a traveling trolley, supporting frame, extensible guide post vertically supported by a tiltable frame on the trolley, and endless chain cutter and agitator. The cutter excavates a trench, removes the excavated earth and jets the removed earth mixed with a hardening liquid into the trench, thereby filling the trench to form a soil cement wall. Significant defects of the excavator are: the inability to form a wall in the unstable ground and as a horizontal stratum, a huge stabilizing moment which must be applied to the trolley.

There is also disclosed in U.S. Pat. No. 5,685,668 an apparatus for delivering an unrolling liner material into and along a trench being formed of a depth up to sixty feet that prevents side walls collapse in a subsurface water saturated zone and forms a barrier wall. Significant defects of that barrier wall installation system are as shown above and following: the wall may be shaped into plane and vertical cylindrical surfaces only because of the cylindrical shape of a roll of the material, and it is difficult to use a very wide material that is sufficient to reach an usual deep impermeable ground layer.

It is known a means for steering a cable-laying apparatus disclosed in U.S. Pat. No. 5,934,833, the steering means mounted to a frame of a chassis of the apparatus to allow excavating a curvilinear slit trench by turning break the frame about a central vertical hinge disposed between to turn relatively front driving wheels and a rear driven wheel, that is difficult because the steering is carried out, while the apparatus advances and the driving wheels must provide large road-holding capacity.

To decrease the huge intended traction and stabilizing moment for the constructing apparatus disclosed in U.S. Pat. No. 3,636,338 and provided with a disposed vertically elongate blade being oscillated about a vertical axis to form a slit trench, so though there is a defect necessitated with forced applying a huge torque to the blade from above the ground level.

An advanceable, trench side walls-supporting shield disclosed in U.S. Pat. No. 3,994,139 and adapted for laying a pipeline into a rectilinear trench that being composed of a set of longitudinally displaceable elongate cutting and side wall-supporting members, a frame for supporting and guiding the members and ram means for effecting relative movement between the frame and the members to effect advancement of the trench. In operation, the ram means advance the members in relation to the frame so as to excavate the trench and then the frame in relation to and follow the members. Significant defects of the shield and a method of its advancement are: the members and the frame are advanced alternately and interruptible at a lesser mean speed because frequent standing idles, advancement of the frame is not secured because stopping the advanced members and their firm friction contact with the walls is not secured, the shield is not capable of controlling advancement of curvilinear holes.

SUMMARY OF THE INVENTION

It is an object of the invention to provide more efficient apparatuses and a simple method for constructing curved, deep and narrow underground structures, such as draining and impervious horizontal preferably stratum and vertical preferably wall of a plurality of adjacent filling columns of the structure being formed within a smooth trench and gallery excavation being formed of the plurality of adjacent holes in firm and unstable grounds that having side walls being supported by a walls-supporting means of the apparatus for lighten and reliable securing the continuous and steerable turning advancement of the holes, excepting stops and idle standing of the forming means when advancing the holes and the columns and real risk of damage of the structure being formed because the stoppages, in a broadened field of use.

In order to accomplish the object of the invention, there is a set of preferable embodiments of the apparatuses according to the invention for constructing underground multicolumn, preferably paling-shaped curved, deep and narrow filling structures being formed within extending horizontally across the ground surface and steeply downward multihole trench and gallery excavation being formed in the ground.

The apparatus comprises a chassis means adapted to be transported above the ground in an intended horizontal structure-extending direction along the length of an intended structure line and stopped in turn at a plurality of points of crossing of the line and intended steep column lines to produce in turn holes and filling columns in the holes; a connecting framework means mounted on the chassis means and comprising a tiltable frame slip means for supporting and guiding components of a hole-forming means of the apparatus when the forming means being assembled upwards of the components in working positions and disassembled, a number of displaceable carrier members being forced into engagement with the components, an activating means for effecting displacement of the components with the carrier members;

a number of the elongate, steeply disposed forming means according to the invention, where each of the forming means comprises an extensible motive means for supporting the components that being adapted to be steeply supported at its upper portion by the slip means along the length of an intended curvilinear cross-section of the structure and having sections adapted to displace about turning axes, the turning axes being horizontal and perpendicular to and remote from a central longitudinal axis of the forming means; a number of means according to the invention for making excavated hole sections to excavate the sections ahead of a lower end of the motive means; a plurality of means according to the invention for supporting side walls of the sections that are distributed in consecutive order along an elongate underground portion of the motive means with the ability to compress the walls and force continuously the motive means in the directions by a less plurality of the interacting supporting means;

an excavation-directing means according to the invention for controllable changing the direction of advancement of the hole sections about the turning axes, having the ability to force from a point below the ground level the motive means from its position in directions crossing the central longitudinal axis of the section being formed toward the intended hole-advancing direction, comprising a number of excavation-directing members capable of being forced into interaction with an intended wall of the hole section being formed to urge the forming means in a direction crossing the central longitudinal axis of the excavated section toward the advancing direction and having a hole excavation-directing portion for forcing the wall in the opposite direction that are operable to move the forming means, with the directing members, relative to the walls being forced toward the advancing direction by an activating means capable of forcing the portions against the walls.

A first preferred embodiment of the directing member according to the invention that comprises a circular frame member of the motive means about the intended turning axis with the ability to control the circular directions of advancement and emptying of the hole, the circular excavation-directing portions with the ability to force the circular side walls of the section being formed, the making means comprising two disposed in mirror order groups of adjacent in side-by-side order endless chain cutters extending substantially horizontally across the advancing direction, where each of the groups comprises an elongate frame for guiding and supporting components of the group, the frame is tangentially disposed on the lower end of the circular member; a shaft supported by an inner end of the frame and extending perpendicularly to the central cylindrical surface of the circular member; a pair of endless chain sprockets supported on end portions of the shaft; a shaft-driving, chain wheel positioned on a middle portion of the shaft; chain sprockets connected rotationally to a saddle on the outer end portion of the frame remote from and coplanar with these lateral chain wheels and middle chain wheel; a means for sliding the saddle on the end portion in a direction substantially perpendicular to the shaft; endless chains extending around the lateral chain sprockets and the lateral chain wheels; a chain-driving wheel positioned on the end portion of the motive member above and coplanar with those middle chain sprocket and the middle chain wheel; a middle endless chain extending around the middle chain sprocket and the middle chain wheel and the upper chain driving wheel and being capable of moving the lateral endless chains; a plurality of cutter bits arranged on those endless chains to form an endless chain forming means; where the endless chain forming means comprises a number of injection pipes and a number of removal pipes extending from the framework means into the frame means and having branched remote ends, where the injection ends opening at incoming ends of the endless chain cutters and the removal ends opening at unloading ends of the cutters. As a further variant of the first embodiment, the circular frame member is shaped into an acute spherical triangle and displaceable about an intended center of spherical curvature of the structure, the center being on the intended turning axis and has down-oriented vertex, and the making means of the triangular forming means comprises a wedge-shaped cutter member extending along the length of a front, in relation to the trench-advancing direction, edge of the triangular member and having a downward and forward oriented cutting portion.

Furthermore, a second preferred embodiment of the forming means according to the invention that comprises the directing cutter members capable of forcing a working end facial wall of the excavated section being formed in a direction crossing the central longitudinal axis of the section and the directing portions having forward oriented, in relation to the hole-advancing direction, cutting portions with the ability to control the force and direction of deformation of the facial wall; the motive means adapted to be moved about the turning axes; where the directing cutter members are adapted to urge the lower end of the motive means about the turning axes while the excavated section is being advanced so that the direction of the advancement of the motive means can be controlled. The directing cutter members and follower motive frame link members of the motive means that are connected in consecutive order, in relation to the hole-advancing and emptying directions, for movement about a number of connecting axes, the connecting axes being on the central longitudinal surfaces of the adjacent members and perpendicular to the directions, and have the ability to interact with the walls to urge the members about the connecting axes in the formation and emptying of the excavated section, where the directing cutting portions are capable of deforming the ground of the walls to form the curved walls and are operated by the activating means to move the cutter members about the connecting axes in order to move the members along the length of the section. Each of the directing cutter members is with the ability to be forced to move about the connecting axes and is adapted to urge the lower link member to move about the lower axis and the directing cutting portions are remotely located from the lower axis and operable to move the lower member about the lower axis by the activating means that is capable of moving the forming means forward and by a drive means that is located within the excavated section to effect the relative movement of the lower axis and capable of rotating the cutter member relative to the lower member.

A first variant according ti the invention of the second embodiment comprises a number of plunger barrel-shaped cutter members disposed horizontally in groups in end-to-end and side-by-side order and supported with a frame member on a saddle of the making means for movement about and along longitudinal axes of the barrel members, the axes being substantially perpendicular to the central longitudinal axis of the forming means; where each of the barrel members has a circular cylindrical facial shell portion provided with a plurality of piston-shaped blade portions, piston-shaped end wall portions and a plurality of cutter bits arranged on the end and facial shell portions; where the multiple activating and drive means are capable of effecting relative movement in intended axial and tangential directions between the barrel members with the saddle and the lower link member; where the plunger barrel forming means comprises a number of injection pipes and a number of removal pipes extending from the framework into the motive means and having branched lower injection ends opening between the inner wall portions and removal ends opening at the outer wall portions and provided with a check valve opening for injecting and removal flows and closing for opposite flows, so that the opposite end portions and the compressor portions of the barrels alternately suck the drilling fluid from the injection pipes into the section and compress a mixture of the excavated ground and a drilling fluid from a hole section being advanced into the removal pipes.

A second variant according to the invention of the second embodiment comprises a central facial disk cutter member and a number of outer facial ring cutter members supported for rotation about a central longitudinal axis of the lower link member; a plurality of directing facial disk cutter members supported behind closely the outer member for rotation about the plurality of peripheral rotation axes, the peripheral axes being disposed equidistantly parallel to the central axis and crossing the outer member, where segmental portions of the directing members that are protruded aside of the outer member and disposed remotely from the lower connecting axis; where the multiple drive means capable of effecting separate rotation of the disk members and the ring members in intended directions.

A third variant according to the invention of the second embodiment that comprises a pyramid-shaped cutter member having a forward oriented, pyramid-shaping, direction-controlling, thrusting facet portion and a middle, backward oriented, conjugated step-bearing, ball socket-shaped hinge portion to form a ball-and-socket hinge, and a backward oriented directing foot tail portion and connected to the lower member having a forward oriented, partly ball-shaped hinge portion to form the ball-and-socket hinge, a center of the hinge being on the central longitudinal axis of the lower member, for movement about the center; where the multiple drive means comprise a plurality of cylinder and piston and output member units disposed oppositely in relation to the hinge center and connected with the length of traction members to the foot tail portion remotely from the center and capable of effecting rotation of the pyramidal member about the center relative to the lower member.

A fourth variant according to the invention of the second embodiment that comprises a plurality of one-facet-wedged, elongate directing cutter members which are longitudinally displaceable and disposed adjacently in side-by-side, mirror symmetrical cluster order; where each of the wedged members has a forward and outward oriented, one facet-wedge-shaping, directing and cutting facet portion with the edge vertex being on the central longitudinal axis of the lower member, and a backward oriented, foot tail portion supported and guided by means of a conjugated step-bearing portion of the lower member; where the multiple drive means are capable of effecting alternate relative movement between the lower member and the wedged members to effect direction-controlling advancement in side-by-side order sections of the hole.

A fifth variant according to the invention of the second embodiment comprises a two-facet-wedged cutter member connected to the lower member for movement about a pivot axis on the central longitudinal planes of the cutter member and the lower member and transverse to the hole-advancing direction, where the drive means is capable of effecting the turning of the wedged member about the pivot axis and comprises a cylinder and piston unit with the longitudinally, in relation to the pivot axis, displaceable output rod including oppositely disposed, castellated portions leaning on corresponding castellated bearings of the lower member for longitudinal displacement and engaging screw-shaped splined portions capable of interacting with corresponding engaged screw-shaped splined portions of the wedged member.

Moreover, each of the means for supporting the side walls that comprises an unit of oppositely disposed wall-supporting members connected to the motive means for relative movement about the turning axes and capable of supporting, forcing, deforming and compressing the walls and supporting the motive means in the hole section to easy the movement; where each of the supporting members has a wall-supporting plate movable reciprocatingly in transversal direction and capable of supporting, forcing, compressing and deforming the wall into a curved shape and supporting the motive means for relative movement and operable to move the motive means about the turning axes by an activating ram means capable of effecting movements together between the motive means and the intended number of the supporting units stationary relative to the walls at the speed V1, where the speed V1 is the speed of movement of the motive means relative to the framework means, to decrease a force which is needed of being applied to the motive means relative and overturning moment about the framework means and to increase a force of advancement of the making means, and where the speed V1 of the continuous uniform movement of the motive means relative to the framework means is secured by alternate and uninterruptible movement between the motive means and each of the units alternately approaching the end of the working stroke of the ram means at the same speeds V2 and distances, where the speed V2 must be equal to not less than $(0.5n-1)\times V1$, where "n" is the number of the interacting units. Each of the units is with the ability to be expanded and outwardly forced into compressive engagement with the side walls being supported by the unit to be immobilized and to secure of holding the unit stationary relative to the walls and decrease the friction resistance of the unit to and easy movement of the motive means; where the supporting portions are movable reciprocally in transverse directions that are capable to compressive engage the walls and support movingly the motive means and operable to expand and change the unit in volume by an activating means capable of outwardly moving the portions to engage the walls and release the motive means.

The apparatus according to the invention that comprises a well-known means for measuring intended characteristics of the ground and determining what kind of the directing and making means and the materials should be used and when to operate the multiple activating means to effect advancement and filling of the holes.

The further hole-directing means according to the invention that comprises a guide ski-trak—shaping means extending from the framework means along the length of the motive means and having an upper end opening at an upper end of the motive means and a lower end opening at a lower end of the motive means; a next hole excavation-directing tenon ski-shaped member that is able to be supported on a lower end of the motive means of each of the next in turn front forming means, in relation to the trench-advancing direction, and disposed in a working position and has a rearward oriented ski-shaped directing portion for forcing the guide ski-trak means in the crossing directions, the directing portion is capable to be forced into engagement with the upper end of the ski-trak means for relative downward movement about the number of the turning axes along the length of the ski-trak means to urge the front forming means in directions crossing the central longitudinal axis of an excavated section of a next hole of the trench being formed toward the hole formed previously, and out of the engagement with the lower end of the ski-trak means, and is operable to engage the front forming means with the rear forming means and to disengage the rear forming means from the front forming means in the trench by an activating means of the apparatus that is capable of moving the directing portion relative to the motive means of the front forming means and the rear forming means out of the engagement with the guiding means to easy the movement of the rear forming means out of the trench.

In other aspect of the invention, a method for constructing an underground steeply and horizontally extending curved multicolumn filling wall and stratum structure in a multihole trench and gallery excavation in the ground, the method comprising the following steps: operating multiple activating means of an apparatus for constructing the excavation to dispose a transportable framework means with a chassis means of the apparatus at a point of crossing of a horizontal trench line and a steeply extending hole line; operating an activating means of the framework means to insert a means for making the hole excavation, the means for making being part of a means for forming the underground structure of the apparatus, at a working position into the ground to a predetermined depth in the excavation and in an intended hole-advancing direction so that the means for making forms a section of a hole along the hole line, the direction of the excavation diverges from a central longitudinal axis of the section about an intended turning axis, the turning axis being crossing remotely the central longitudinal axis of the section, and is determined; operating the activating means to move a supporting motive means of the forming means in the advancing direction to cause the motive means to excavate the section; operating an activating means of the forming means to advance members of a means for supporting side walls of the section in a working position relative to the motive means and to stop within the formed section to support the walls, where the means for supporting being part of the forming means; operating an activating means of the forming means to move wall-supporting portions of the stopped members outwardly in opposite directions against and into compressive engagement with the walls to immobilize the members relative to the walls and to decrease the friction resistance of the supporting means to and easy the relative movement of the motive means; operating the activating means of the forming means to move the motive means relative to the stopped members in the advancing direction at a speed, V1, where the speed must be equal to a speed of movement of the motive means in the same direction in relation to the framework means, to cause the forming means to decrease the traction relative to and the overturning moment about the framework means; operating the activating means of the forming means to effect alternate uninterruptible movement in the advancing direction of each of the opposite members, n, with the same distances and speeds, V2, relative to the motive means, where the speed V2 must be equal to no less than about $(0.5n-1)\times V1$; operating the multiple activating means of the apparatus to insert into the section and move a means for directing the excavation, the means for directing being part of the means for forming and the activating means of the forming means are located within the section that being formed by forces applied to walls of the section by the directing means, in a working position to force the walls at the directing means in a direction opposite to the diverged direction to cause the directing means and the motive means to be forced in the diverged direction so to advance the hole excavation in the diverged direction about the turning axes; operating the activating means to transport the framework means in the trench-advancing direction from the previous point to a next point of crossing of the trench line and a next intended hole line, the next hole line being equidistantly remote ahead of the previous hole line, and to dispose a next structure-forming means of the apparatus in a working position at the next point and insert a next means for making a hole of the trench, the next means for making being part of the next means for forming, at a working position into the ground to a predetermined depth in the next hole and in a next intended hole-advancing direction so that the next means for making forms a section of the next hole along the next hole line, the direction of the next hole excavation diverges from a central longitudinal axis of the next section about the intended turning axis and is determined; operating the activating means to move a supporting motive means of the next forming means, the next motive means is capable to move closely along the length of the motive means of the previous forming means, in the next hole-advancing direction to cause the next motive means to excavate the section of the next hole; operating an activating means of the apparatus to engage a tenon ski-shaped directing member for directing the next hole excavation, the directing member being part of the apparatus, in a working position to the lower end of the frame means of the next forming means; operating the activating means of the apparatus to engage a ski-shaped directing portion of the directing member with the upper ends of the guide ski-trak means being in the previous hole, for relative movement along the length of the ski-trak means to cause the directing portion to force the guide ski-trak means in a direction opposite to the next diverged direction and to be forced in the next diverged directions about the intended turning axes so to advance the next hole in the next diverged directions jointly to the previous hole; operating the activating means to move the directing portion in relation to the front forming means and the rear forming means out of the engagement with the guide ski-trak means so as to disengage the rear forming means from the front forming means in the trench; operating the activating means to remove the rear forming means out of the trench to empty the previous hole, while inserting a feed pipe, the pipe is part of the apparatus, below the rear forming means to feed intended materials into the previous hole being emptied, thereby filling the emptied sections of the previous hole with the materials in an intended order.

The method according to the invention comprises the further step of remotely exploring intended characteristics of the ground the first in turn directing forming means comes across by well-known suitable measuring means to determine what kind of an excavation-making means and walls-supporting means of the forming means and what kind of materials of the structure should be used and when to operate the multiple activating means to effect advancement and emptying of the section of the next hole and when to insert the materials corresponding to the explored characteristics into the previous hole.

According to the construction apparatus and method of the invention, it is possible to excavate the ground and continuously advance in turn the hole sections of the multisectional trench excavation and to empty the formed holes to construct filling column sections of the structure of a mortar in freed gaps, such as a diaphragm or retain wall and stratum having smooth side surfaces without steps and openings, an anchor or foundation or drainage stratum and wall and the like in the ground.

It is apparent that the invention may be employed in many configurations, modifications and variations other than the preferred and specific forms and embodiments are described and given herein-before by way of examples only without departing from the essential scope, spirit and substance thereof and the scope of the invention is defined and limited only by the terms of the appended claims, including also all subject matter encompassed by the doctrine of equivalents as applicable to the claims. The invention will be more fully understood by referring to the following detailed specification and claims taken in connection with the appended drawings.

BRIEF DESCRIPTION OF THE DRAWINGS

FIG. 7 is a side view of the preferred wedge-shaped embodiment 60 of the making means 16 and the directing member 63 of the directing means 18 in FIG. 1 according to the invention;

FIG. 8 is a front view of the cutter 60 in FIG. 7;

FIG. 9 is a rear view of the directing member 63 in FIG. 7;

FIG. 10 is an upper view of the directing member 63 in FIGS. 7 and 8;

FIG. 11 is a side view of the preferred embodiments of the endless chain cutters 69 and 70 of the making means 16 and the directing member 99 of the directing means 18 according to the invention;

FIG. 12 is a front view of the chain cutters 69 and 70 in FIG. 11;

FIG. 13 is an upper view of the directing member 99 in FIG. 11;

FIG. 14 is a rear view of the directing member 99 in FIGS. 11 and 13;

FIGS. 22A, 22B, 22C, 22D, 22E, 22F, 22G, 22H, 22I, 22J, 22K and 22L are views illustrating the processes of the method for advancement of the forming means 12 in FIGS. 1 and 2 into the ground according to the invention;

FIGS. 23A, 23B, 23C, 23D, 23E, 23F and 23G are views illustrating the processes of the method for movement of the forming means 10 out of a formed hole section;

FIGS. 25, 26 and 27 are side, front and upper views of the preferred embodiment 200 of an apparatus for constructing an underground funnel- and half tore-shaped structure consisting of triangular and trapezoidal sections according to the invention;

FIG. 28 is a cross-section view of the forming means 209 in FIG. 25;

DESCRIPTION OF THE PREFERRED EMBODIMENTS

Figure 2:
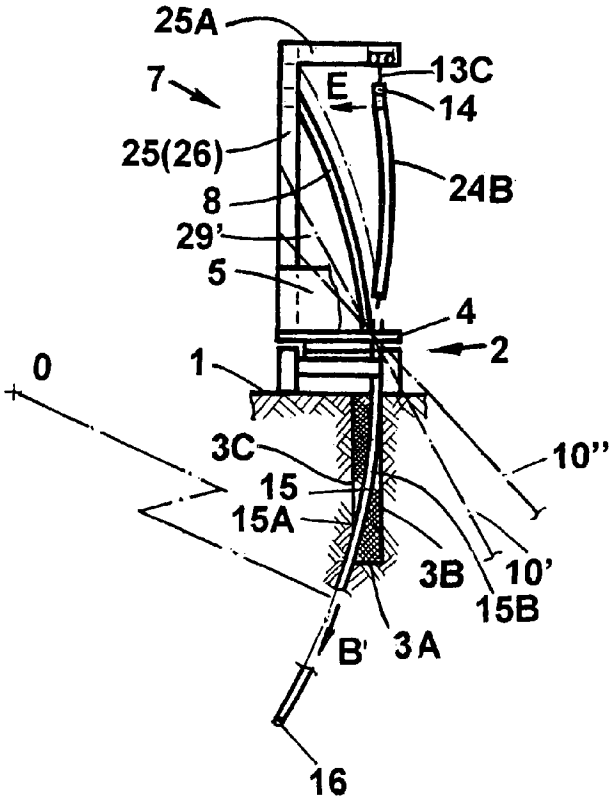
FIGS. 1 and 2 are side and front views of the apparatus for constructing an underground paling-shaped equally-curved, deep and narrow stratum and wall in a multihole excavation being formed in the ground, that apparatus comprises a set of structure sections-forming means according to the present invention and capable of interacting and moving accordingly to the method corresponding to the invention.

To the accomplishment of the foregoing and related aims the invention then comprises the features hereinafter fully described and particularly pointed out in the claims, the following description setting forth in detail certain illustrative embodiments of the invention, these being indicative, however, of but a few of the various ways in which the principles of the invention may be employed.

In describing preferred embodiments of the invention illustrated in the drawings, specific terminology will be resorted to for sake of clarity. However, the invention is not intended to be limited to the specific terms so selected, and it is to be understood that each specific term includes all technical equivalents which operate in a similar manner to accomplish a similar purpose.

Such formed hole can also be used for constructing an underground anchor or foundation column and pile, or a drain or supplying well. The formed excavation sections are used to lay into the hole a suitable structure material, such as a grout or bentonite slurry or bentonite-sand-water mixture or neat cement milk or cement-pea gravel-sand-water ready concrete or pea gravel-sand mix or any other kind of a backfill can be put in place of excavated section emptied by underground structure—forming means movable in the ground by the method according to the present invention.

Figure 1:
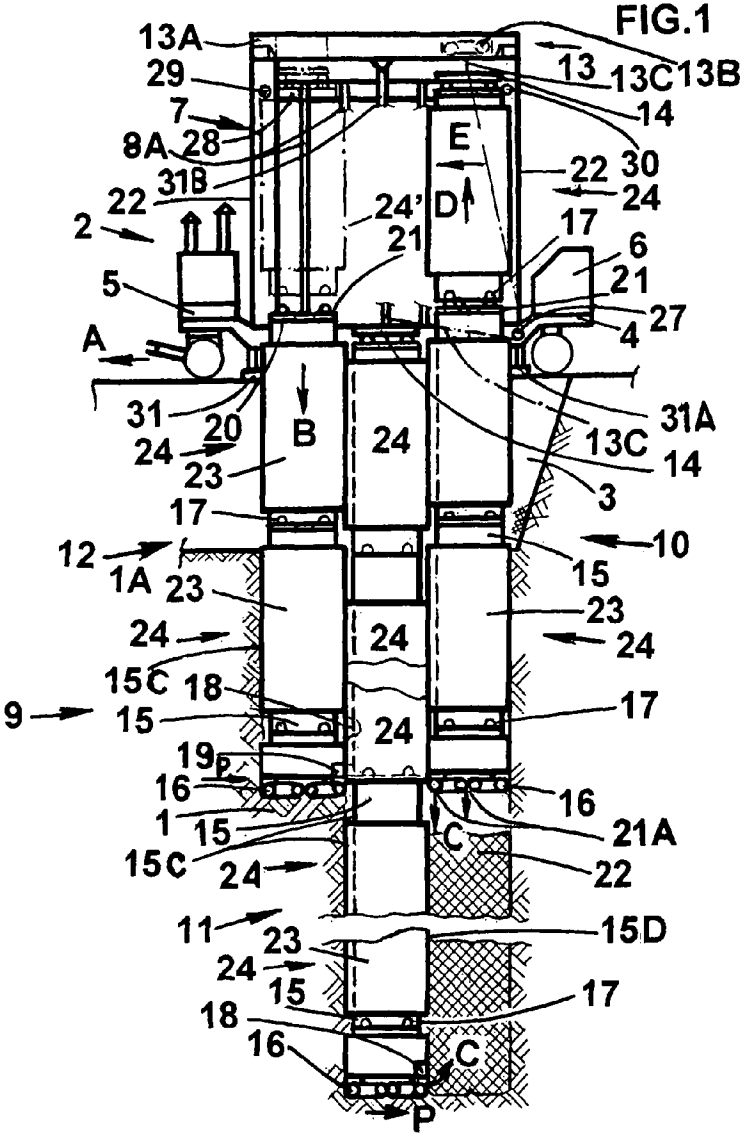

In FIGS. 1 and 2 it is illustrated an apparatus 01 for constructing an underground equally-curved, preferably circular cylindrically-shaped, and plane, deep and narrow multisectional underground structure, such as a horizontally preferably-extending stratum and vertically preferably-extending wall in a multihole excavation being extended into the ground 1 according to the invention preferably straight horizontally along the length of a structure line and composed of a number or a plurality of adjacent hole sections being extended preferably curvilinear vertically along the length of hole section lines crossing the structure line in a direction of the cross-section of the structure, the apparatus 01 comprises a travelling chassis 2 being movable along an initial or starting excavation, such as a trench 3 dug in the ground 1 to a predetermined depth along the length of the structure line in a direction shown by an arrow A in FIG. 1 and stoppable at the intended hole section lines, supporting components of the apparatus and supplying materials, power and controlling signals to the components and comprises a frame 4, a hydraulic control and pressure fluid pumping means 5 being driven by an engine, such as a combustion engine, a source means of a drilling fluid or a wash liquid and compressed air for withdrawing debris material of penetration of the working end facial wall out of an excavated section (not shown), a source of a structure material (not shown), an operator cabin 6 provided with a means for remote controlling operations of activating means of the apparatus, a connecting framework 7 mounted on the chassis 2, provided with a tiltable slip 8 for guiding and supporting components of a structure-forming means 9 including underground-movable structure section-forming means 10 to 12 and adapted to assemble and connect together and to the chassis means 2, to dispose and advance in an intended advancing direction shown by an arrow B the forming means 10 to 12, a bridge crane 13 for disposing the components and the chassis 2 and a carrier 14 for forcedly engaging the same preferably elongate and extensible motive frame means 15 for guiding and supporting components of the forming means 10 to 12, where all the frame means 15 have the same conjugated equally-curved central longitudinal surfaces, such as part of a circular cylinder or a screw helical spin, which is identical to the intended central longitudinal surfaces of hole sections and cross-section of the structure, a means 16 for making excavated hole sections to excavate hole sections ahead of the frame means 15. The making means 16, such as a wedge-shaped cutter or an endless chain cutter or an end-and-face mill cutter provided with a means for injecting the wash liquid and compressed air and withdrawing the drilled debris (later described) that is suitable for mechanical characteristics of the ground along the length of the hole line and has the ability to be replaced or substituted and supported securely by the front end of the frame means 15 provided with a lock means 17.

Each of the frame means 15 that comprises an internal aside oriented, relative to the direction of advancement of the multihole excavation, side portion 15A for interacting with the slip 8, an external aside oriented side portion 15B for interacting with the side wall of an excavated hole section, a forward oriented front portion 15C for supporting a means 18 for supporting and guiding the next in turn forming means, such as the forming means 11 and 12 for advancement of next holes, a backward oriented rear portion 15D for supporting a means 19 for interacting with the supporting and guiding means 18 and directing next holes, for guiding an adjacent from behind forming means, such as the forming means 10, forming, supporting and compressing the working front facial wall of a structure being formed.

The supporting and guiding means 18 of the forming means 11, for example, comprises directing means 19—supporting and guiding members (later described) arranged along the intended length of the front portion 15C of the frame means 15 capable of being supported by the walls of an excavated section, where each of the members is capable of being connected engagely for longitudinal movement to and interacting with the directing means 19 of the adjacent from the front forming means 12 to urge the forming means 12 in a direction crossing the central longitudinal axis of the next excavated section toward the intended advancing direction B and has a forward oriented, directing means 19—supporting and guiding portion (later described) for forcing the directing means 19 in the crossing direction, where the portions being engageable with the directing means 19 and operable to move the forming means 12 with the directing means 19 relative to the walls of the rear hole section excavated previously and being forced by the forming means 11 toward the direction B by an activating means of the apparatus 01 capable of forcing the directing means 19 against the supporting and guiding means 18, their frame means 15 and the walls.

The frame means 15 of the forming means 12, for example, that is able to be forced from its position toward the direction B by the directing means 19 which comprises a number of hole sections-directing members (later described) supported by the rear portion 15D, where each of the members is capable of being connected engagely for longitudinal movement to and forced into interaction with the supporting and guiding means 18 of the adjacent from behind forming means 11 being supported by the walls of the formed hole to urge the forming means 12 in the crossing direction toward the direction B and has a backward oriented, hole-directing portion for forcing the supporting and guiding means 18 of the forming means 11 in a direction crossing the central longitudinal axis of the front excavated section toward the direction B, where the portions are operable to move the front forming means 12, with the directing means 19, relative to the supporting and guiding means 18 and the walls being forced by the forming means 11 toward the direction B by the activating means of the apparatus 01 capable of forcing the portions against the supporting and guiding means 18 and the walls and control the direction of the advancement of the excavated section.

In operation, the frame means 15 of the first in turn forming means 10 when is forced by the bridge crane 13 and the activating means of the apparatus 01 and interacts with its portion 15A with the slip 8 to be forced from its position toward the intended advancing direction B to urge the forming means 10 in a direction crossing the tangent of the matched interacting surfaces of the slip 8 and the portion 15A about the axis O toward the direction B, where the portion 15A is forced against the slip 8 and moves the forming means 10, with the frame means 15, about the axis O relative to the slip 8 being forced toward the direction B so that the forming means 10 inserts in the working position into the trench 3 up to a predetermined depth in the trench 3 along the hole line, where bosoms between the trench walls 3B and 3C and the forming means 10 are filled up with a coarse sand or gravel preferably or the compacted withdrawn ground which supporting the forming means 10 and then the forming means 10 inserts further into the trench bottom 3A and forms and supports the side walls of the excavated hole section being formed up to a predetermined depth of the hole being formed. While the frame member 15 being supported and guided yet by the slip 8 for movement about the axis O into the ground, the making means 16 forms the excavated section being curved about the axis O and the side walls of the excavated section being formed that become to ensure the guiding and supporting of the frame member 15 for further movement about the axis O. The frame member 15 becomes to interact forcedly with the surrounded walls of the section being formed to urge the forming means 10 in a direction crossing the tangent of the central longitudinal axis of the excavated section toward the direction B, the portions 15A and 15B become to support and force the walls in the crossing directions and thereby move the forming means 10, with the frame means 15, relative to the walls being forced about the axis O toward the direction B.

The frame means 15 of the next in turn forming means 12, for example, that is forced by the bridge crane 13 into interaction firstly with the slip 8 and secondly with the forming means 11 being adjacent from behind in the formed previously hole section to urge the forming means 12 in a direction crossing the tangent of the matched interacting surfaces of its directing lower side portion 15A, the slip 8 and the central longitudinal surface of the frame means 15 of the forming means 11 toward the direction B by aid of the portion 15A forcing the slip 8 and the directing means 19 forcing the guiding and supporting means 18 of the forming means 11 in the opposite crossing direction and move, the forming means 12, with its frame means 15, relative to the slip 8 and the forming means 11 about the axis O toward the direction B.

Each of the frame means 15 comprises conduits 20 and 21 having aside and longitudinally preferably oriented quick-acting inlet conduit connections, extending from the upper end of, into and along the length of the frame means 15 for transmission compressed air, a hydraulic pressure fluid, and the drilling fluid or wash liquid to and from the making means 16 and then the structure materials 22, such as a ready mixed-concrete or a hardening liquid, such as a mix of a cement milk and sand or a mortar and soil or a surrounded walls-supporting bentonite solution, and capable to be temporarily connected by the length of pipe members (not shown) to a known means for supplying the materials 22 and receiving and processing the drilling mud and to the pumping means 5, for supplying electrical power and transmission signals that being connected by the length of electrical cables (not shown) to the remote control means 6. The conduit 21 has branched preferably lower ends 21A opening at the far and lower end of the forming means 10 to 12 for letting the structure material 22 into and laying in the formed and emptied hole section in directions shown by arrows C in FIG. 1.

The frame means 15 is provided with a number or a plurality of longitudinally displaceable means 23 (later described) for supporting the walls of the hole section, such as the roof or the side walls, that are adapted to support and guide the frame means 15 and force the forming means 10 to 12 to move about the axis O relative to the walls being supported to effect advancement and emptying of the curved hole and to immobilise relative to the walls to support the chassis 2 and the liquid materials 22 to form the structure.

The frame means 15 has the ability of being extended by joining alternately a number or a plurality of spare motive frame units 24 capable to be connected rigidly together in end-to-end relationship by the lock means 17 and the connecting means of the conduits 20 and 21. The number of the units 24 that is determined accordingly to the predetermined depth and length of a hole being formed and the length of each of the units 24.

The framework 7 consists of ⌈-shaped preferably pier columns 25 and 26 supported by the chassis frame 4 and adapted to support the bridge crane 13 provided with a bridge beam 13A supported on rolls and rails in collar pier corbels 25A and 26A of Π-shaped preferably cross-section for movement along the length of the corbels 25A and 26A by a drive means (not shown) comprising, for example, a means for providing motive power and screw shafts each of which is supported rotatably by the corbels 25A and 26A and threadedly engaged with a nut supported pivotably by the end of the bridge beam 13A (not shown), a hydraulic hoisting winch 13B supported by the bridge beam 13A for movement along the beam 13A and serving with its wire 13C for assembling the units 24 of the forming means 12, for example, being inserted into the ground, for disassembling the units 24 of the forming means 10, for example, being withdrawn out of the formed hole in a direction shown by an arrow D in FIG. 1 and for displacement of the spare units 24 forward in the direction A with the traverse carrier 14 capable to be forced into engagement by the lock means 17 with any unit 24, a guide pulley 27 supported rotatingly by the frame 4 for the wire 13C that is capable to be connected to the forming means 11, for example, being in the excavated hole section and supported by the walls of the section and serving as an abutment for advancing the chassis 2; an intended number of exchangeable sets of exchangeable supporting and guiding slip members 8A of the slip 8, where the slip members 8A of each of the sets that are shaped into a shape of the central longitudinal surface of the forming means 10 to 12, arranged preferably in transversal direction between and supported by the frame 4 and a longitudinal beam 28 located between and supported by the columns 25 and 26 and having the ability to be displaced in a vertical direction and fixed at intended operating horizontal positions by aid of pins 29 and 30 arranged along the columns 25 and 26 to form and tilt the slip 8 and connected securely to the frame 4 and the beam 28 by their ends and aid of pins (not shown) arranged along the frame 4 and the beam 28. Preferably the connections are easily detachable so that the slip members 8A can be removed and replaced to cope with the motive frame sections of different shapes of the rectilinear, for example, forming means 10 shown at working positions 10' and 10". So, the slip 8 has the ability to be disposed into any intended working positions for forming the excavation having different intended equally-curved cross-sections.

The chassis 2 comprises a means for anchoring the frame 4 that comprises a set of hydraulic outrigger supports 31A connected to the frame 4 between the ground surface and a number or a set of outrigger rods 31B being connected pivotally to the bridge beam 13A and capable to be connected with the carrier 14 and the lock means 17 to the frame means 15 of the forming means 11, for example, being motionless and supported by the walls of the formed hole. Hydraulic piston and cylinder units of the outrigger supports 31A when are supplied with pressure fluid to extend and thereby urge the outrigger support 31A against the ground surface and the rods 31B when are connected to the frame means 15 of the forming means 11 so that support motionless the chassis 2 to prevent its overturning.

The hydraulic drive means of the winch 13B being engaged with the bridge beam 13A and located with its wire 13C engaged with an upper in turn unit 24 of the forming means 10 by aid of the carrier member 14 is supplied with pressure fluid to pull the wire 13C into and thereby move upwardly the upper unit 24 which could be disassembled with the lock means 17 from the forming means 10 being withdrawn out of the formed hole in the direction D and could be advanced in the direction A in FIG. 1, assembled into the forming means 12 and being inserted again into the ground. Simultaneously the materials 22 can be let through the opening 21A as it shown by the arrows C in FIG. 1 and then the wire 13C is extended around the pulley 27 and connected to the forming means 11 with the carrier 14 and the lock means 17 and the hydraulic winch 13B when is supplied with pressure fluid to pull into the wire 13C and thereby urge the frame 4 with the pulley 27 forward in the direction A relative to the forming means 11 so that the chassis 2 advances a step and complete the construction of that structure section. The operations of inserting the forming means 12 and withdrawing the forming means 10, for example, in this way are carried out repeatedly as part of an overall sequence involving the advancement of the apparatus 01 and excavation.

FIGS. 3 to 6 show one of the same rectangular preferably motive units 24 of the forming means 10, for example, in a plane embodiment 24A shown in FIG. 1 and a circular cylindrical embodiment 24B shown in FIGS. 1 and 2. Each of the units 24A and 24B comprises a frame 32 for supporting and guiding components of the unit 24A and 24B, that comprises a number of connecting conform fork members 33, lug members 34 and pin members 35 of the locks means 17 in FIG. 1, sections 36 of the conduit 21 shown in FIG. 1 that extending along the length of the frame 32 and having known inlet and outlet end quick-acting connecting conform sockets and check valves 37 and 38, sections 39 of the conduit 20 shown in FIG. 1 that extending along the length of the frame 32 and having known end socket and check valves 40 and 41; inlet and outlet quick-acting end plug-and-socket connecting means 42 and 43 for transmission electrical power and the controlling signals, and the side walls-supporting and the frame 32-supporting and guiding, urging and immobilising means 23 shown in FIG. 1 that comprises a number or a set of side wall-supporting members 44 and 45 generally arranged in pairs and tandem order along the frame means 15. The frame 32 is provided with guide walls 46 and 47, and each pair of the members 44 and 45 is provided with a box frame 48 being supported and guided the members 44 and 45 for longitudinal displacement in the curvilinear directions shown by the arrows B and D in FIG. 3 between and along the length of the walls 46 and 47, a number of double-acting hydraulic piston and cylinder units 49 for effecting relative movement about the axis O shown in FIG. 2 between the frame 32 and the members 44 and 45 with the box frame 48 to effect turning advancement and emptying of the holes, where the unit 49 has its cylinder pivotally connected to a bracket or the like formed within the box frame 48 and its piston rod pivotally connected via linkage to the frame 32. The frame 32 is provided with known end switch means 50 and 51 that are capable to signal about end stroke positions of the box frame 48 and connected to the remote controlling means 6.

During the advancement or emptying of an equicurvilinear hole, a number of the groups of the members 44 and 45 are moved in the intended direction B or D about the axis O and stopped to support the side walls or the bottom and roof of the hole section being advanced or emptied by supplying pressure fluid to the unit 49 associated therewith so that the unit 49 correspondingly extends or shortens. The other groups of the members 44 and 45 remain preferably stationary and the units 49 associated therewith are blocked in known manner or act in the reverse direction D or B. The stopped members 44 and 45 are in static frictional contact with the walls and thus serve to anchor, support and guide the frame 32 and thereby act as an abutment for the unit 49 which is operated. This procedure would be repeated for the other members 44 and 45 and when each of the units 49 has been extended or shortened it can be operated in a reverse sense to retract and draw up the frame 32 ready for the next operative cycle. During the latter phase when the frame means 15 is drawn up, the intended number of the members 44 and 45 collectively act as an abutment for the units 49.

Figure 5:
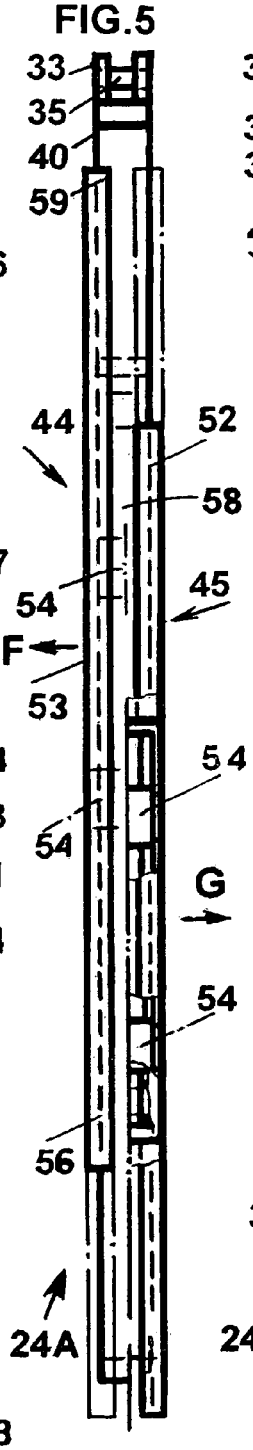
FIG. 5 is a front view of the plane unit 24 in FIG. 3.

A number of the members 44 and 45 are with the ability to be expanded and outwardly forced into compressive engagement with the side walls being supported by the members 44 and 45 to immobilise the members 44 and 45 relative to the walls and adapted to compress the cylindrically-shaped walls and urge the frame 32 about the axis O and have side wall-supporting portions 52 and 53 reciprocatingly movable in transversal directions shown by arrows F and G in FIG. 5 that are capable to compressively engage the walls of the excavated section and operable to expand the supporting members 44 and 45 for immobilising the member 44 and 45 relative to the walls by an activating means, such as a number or a set of power hydraulic cylinder and piston units 54 capable to outwardly move the portions 52 and 53 in the directions F and G to engage the walls and move the portions 52 and 53 relative to the adjacent supporting member 44 or 45. The units 54 are connected hydraulically to the unit 49 and a suitable remote controlling electromagnetic distribution valves of a controlling hydraulic means 55 by the lengths of pipes. The portions 52 and 53 have preferably a [-shaped cross-section, for instance, and are provided with L-shaped edge stiffeners 56 and 57 that have the ability to form the supporting and guiding means 18 shown in FIG. 1, such as an aisle extending between, along and close by a forward oriented, relative to the advancing direction A, side wall 58 of the frame 32 and the stiffeners 56 and 58 and adapted to support and guide a T-shaped portion 59 (later described) of the directing means 19 of the forming means 12, for example, for longitudinal movement.

Figure 3:
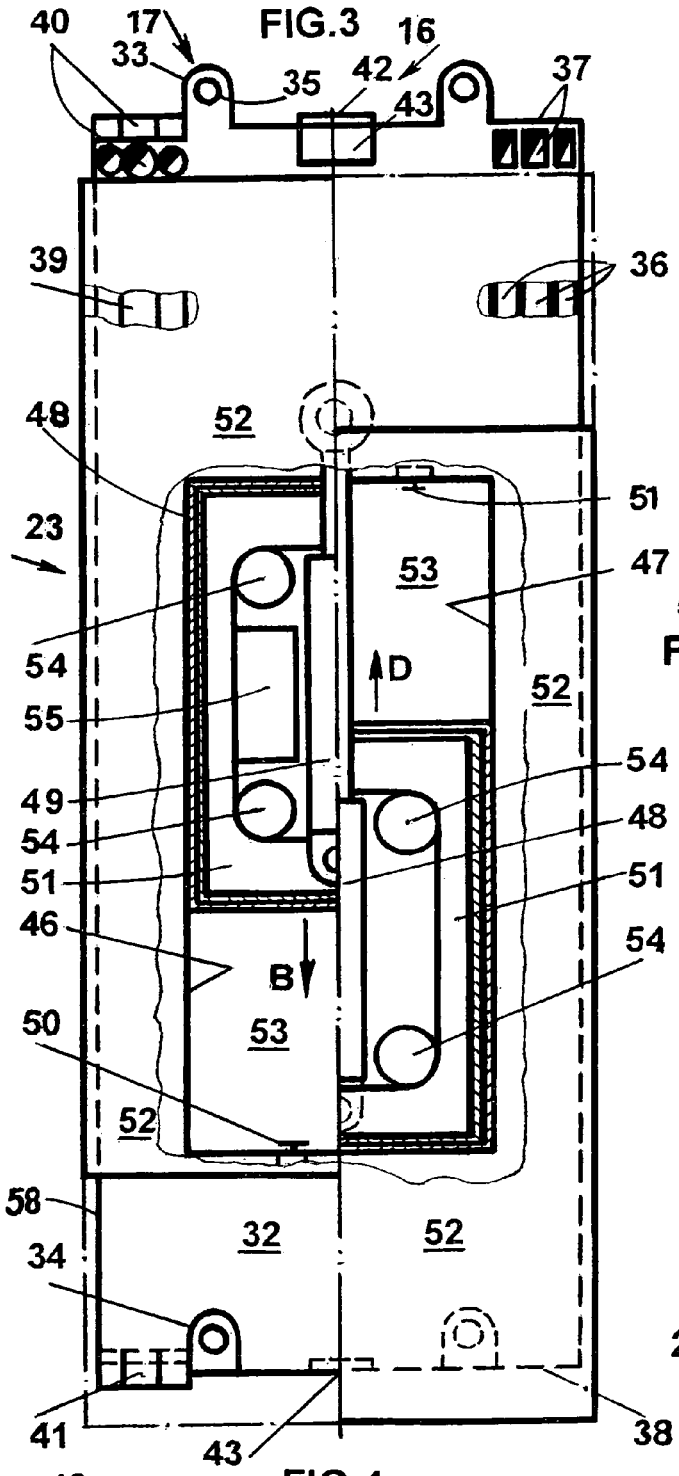
FIG. 3 is a side view of the preferred embodiment of the unit 24 of the forming means 10 in FIGS. 1 and 2 that according to the invention.
Figure 6:
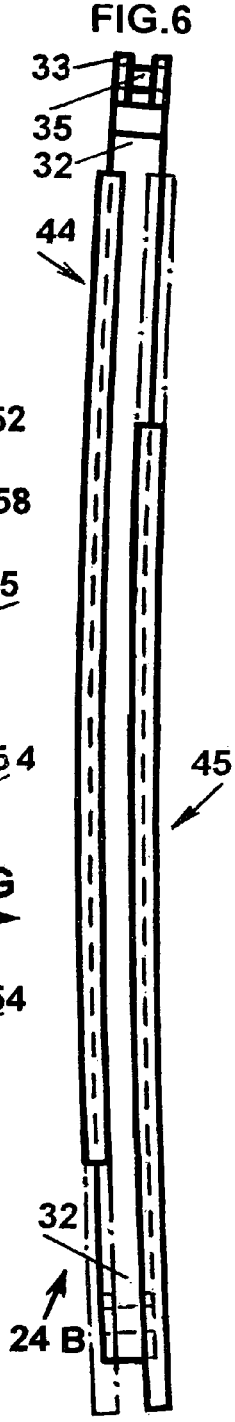
FIG. 6 is a front view of a circular cylindrical-shaped unit 24 in FIGS. 3 and 4.
Figure 4:
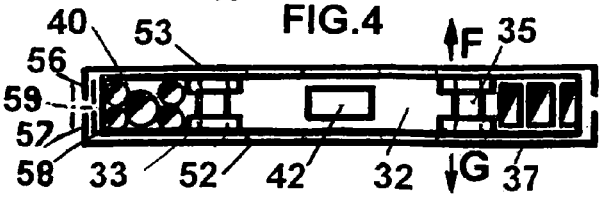
FIG. 4 is a view from above of the unit 24 in FIG. 3.

FIG. 6 shows a front view of a circular cylindrically-shaped unit 24B that has the design which is similar to the design of the plane unit 24A in FIGS. 3 to 5. Such units 24B are useful for constructing an underground structure shaped into a circular cylindrical trough shown in FIG. 24A, where as the units 24A are useful for constricting underground structures shown in FIGS. 24B to 24D.

While the members 44 and 45 (see FIG. 3 to FIG. 6) are in their operating positions, stationary and expanded within an excavated section, the portions 52 and 53 are faced and pressing on the walls in order to be compressingly engaged with the walls and are subjected to backpressures by the walls. A magnitude of such backpressure of the grounds allowing the cutting through by wedge-shaped cutters that is equal to about 1 to 6 kg/cm$^2$, the boring-allowing rocky grounds—from 10 to 20 up to 20 to 40 kg/cm$^2$, for example. The backpressures can create friction forces which are enough to impede securely relative displacement of the portions 52 and 53 to the excavated section, therefore the stopped members 44 and 45 can be operable as an abutment to securely urge the frame 32 along and relative to the excavated hole section, the walls of which being supported and compressed by the members 44 and 45. If the resistance of the ground to compression is equal to no less than 5 kg/cm$^2$, for instance, the static friction coefficient is equal to no less than about 0.5, and dimensions of the portions 52 and 53 are: the width—200 centimeters and the length—400 centimeters, for example, then the static friction forces of the portions 52 and 53 being moved apart against the walls that can correspondingly reach more than about 400 tons and up to 2500 tons. While the members 44 and 45 are in their inoperative positions and move longitudinally forward, the members 44 and 45 can be decreased in its volume by the active pressure of the unstable walls, which can be equal up to about 1.0 kg/cm$^2$, for instance, and create lesser significantly sliding friction forces which impede the displacement of the members 44 and 45 and the frame 32 within the excavated section and are correspondingly equal to no more than 80 tons. Therefore, the unit 49 must correspondingly exert a force equal to more than 100 tons for effecting relative advancement of the members 44 and 45 to the frame 32 and can exert a force equal more than about 400 tons for movement of the frame 32 relative to the members 44 and 45 to advance the forming means 12 with the frame means 15.

So, the members 44 and 45 are stationary until the unit 49 ends its piston pulling stroke with advancement of the frame means 15 with the frame 32 relative to the members 44 and 45 and the frame 32 approaches up to the box frame 48 so that the box frame 48 actuates the switch 51 which signals to the control assembly 55 to cease supplying pressure fluid into the rod end of the unit 49 and to connect it to a hydraulic drive tank and to simultaneously begin supplying pressure fluid into the head end of the unit 49 to start its piston pushing stroke with relative advancement of the members 44 and 45 to the frame 32 and signals to the assembly 55 to connect the hydraulic units 54 to the unit's 49 rod end and to the tank for ceasing the outwardly forcing the portions 52 and 53 by the units 54 to allow the portions 52 and 53 to inwardly move from the excavated section walls being supported and to decrease the members 44 and 45 in volume and the pressure of the ground on the portions 52 and 53, and then the members 44 and 45 move along and between the guides 46 and 47 forward up to the switch 50 and the end of the piston pushing stroke of the unit 49. Then the members 44 and 45 are stopped with the box frame 48 relative to the frame 32 and actuate the switch 50 to signal to the assembly 55 to cease supplying pressure fluid into the head end of the unit 49 and to connect the head end to the tank and to start supplying pressure fluid into the rod end of the unit 49 and to connect the rod end to the units 54 to supply the units 54 with pressure fluid and to outwardly push their pistons and the portions 52 and 53 toward the walls so that the portions 52 and 53 exert pressures on the walls to be fixed by friction forces stationary relative to the walls and the unit 49 forces the frame 32 forward relative to the securely fixed motionless portions 52 and 53 between and along the guides 46 and 47 of the stopped frame 32. After the unit 49 ends its piston pulling stroke and completes the forcing the frame 32 forward, where the frame 32 approaches the box frame 48 and actuates again the switch 51, and with that the cycle of actions of the unit 24 is ended. The units 24 analogously operate for urging the frame means 15 of the forming means 10 backward and out of the formed hole section.

When the forming means 10 in FIG. 1, for example, returns out of a formed hole to empty the formed hole and the materials of the structure to be let into the emptied hole section, its supporting and guiding means 18 which is similar to the supporting and guiding means 18 of the forming means 11 shown in FIG. 1 and able to serve for directing the emptying and force the forming means 10 from its position toward an intended emptying direction shown by the arrow D in FIG. 1 and control the direction D relative to the directing portion 15D and the directing means 19 of the adjacent from the front forming means 11 being supported by the walls of the excavated and formed hole section that are similar to the shown in FIG. 1 directing means 19 and directing portion 15D of the forming means 12 and able to serve for supporting and guiding the forming means 10 to empty the formed hole.

In FIGS. 7 to 21 there are shown exchangeable and substitutable embodiments of the making means 16 that are adapted to excavate the grounds having different mechanical characteristics and the directing means 19 in FIG. 1.

In FIGS. 7 to FIG. 10 there is shown a wedge-shaped cutter 60 that is adapted for using in the hover or loose or sandy or soft clayey ground that includes rocks of diameter equal up to about 50 centimeters, for instance, and has forward oriented, relative to the advancing direction B, wedge-shaping cutting portions 61 disposed at the angle of sharpness that is equal to about 45°-60° and the angle of cutting equal to about 45° to 75°, 60° being preferred, where the cutting angle vertex is located at the portion 16D in FIG. 1. The cutter 60 is connected to the far and lower end and within the central longitudinal surface of the frame means 15 by the lock means 17 with the ability to control the cutting angle by aid of a known means (not shown).

An embodiment 62 of the directing means 19 shown in FIG. 1 that comprises a directing member 63 supported and guided by a front end section 64 of the frame means 15 for axial movement in transversal directions shown by arrows H and I in FIG. 7, a hydraulic double-acting piston and cylinder unit 65 for effecting relative movement between the section 64 and the member 63 to effect engaging connection and disconnection the member 63 and the supporting and guiding means 18 of the adjacent from behind forming means 11, for example. The member 63 is capable of being forced into interaction with the supporting and guiding means 18 to urge the forming means 12 in a direction crossing the central axis of the excavated section toward the direction B and into the section line and has an excavation-directing portion 66 for forcing the stiffeners 56 and 57 and a forward oriented, supporting and guiding wall 58 of the frame 32 (shown in FIGS. 3 and 4) that form an embodiment of the supporting and guiding means 18 of the forming means 10 and 11, for example, in a crossing direction, where the portion 66, the stiffeners 56 and 57 and the wall 58 are operable to move the forming means 12, with the directing member 63, relative to the stiffeners 56 and 57 and the wall 58 being forced toward the direction B and into the excavated section line by the units 49 of the forming means 12 capable of forcing the portion 66 against the stiffeners 56 and 57 and the wall 58. The rear wall 67 of the frame section 64 has a pocket or recess 68 for accommodation the portion 66 when in an inoperative position, where the recess 68 is filled up with an elastic material, such as a soft rubber being capable to be compressed by the portion 66.

The unit 65 when is supplied with pressure fluid to extend and thereby urge the member 63 toward the previously inserted into the ground forming means 11 located adjacently to the member 63 so that its portion 66 and the stiffeners 56 and 57 and the wall 58 mate to join the frame means 15 of the forming means 11 and the frame means 15 of the forming means 12 together for relative longitudinal movement. The unit 65 when is supplied with pressure fluid to shorten and thereby urge the member 63 from the forming means 11 so that its portion 66 moves through a gap between the stiffeners 56 and 57 to separate the frame means 15 of the forming means 11 and the frame means 15 of the forming means 12 and allow the rear forming means 10, for example, to move backward out of the formed hole and relative to the front forming means 11.

In FIGS. 11 to 14 there it is shown endless chain cutter embodiment 69 of the making means 16 in FIGS. 1 and 2 for using in the firm or frozen or solid ground, that consists of endless chain cutters 70A and 70B, each of the endless chain cutters 70A and 70B comprises a driving chain wheel 71 on a saddle 72 on a front end frame section 73 of the frame means 15, a means for sliding longitudinally, relative to the direction B, the saddle 72 on the frame section 73 (not shown), a guide frame 74 supported by the front end of the frame section 73 and positioned ahead of, within the central longitudinal surface, and across the longitudinal axis of the frame means 15, chain sprockets 75 and 76 both supported by the middle portion of parallel shafts 77 and 78 rotatably connected to the ends of the guide frame 74, an endless chain 79 extending around the chain driving wheel 71 and the sprockets 75 and 76, a number of cutter bits (not shown) arranged on the endless chain 79 to form a central or middle driving endless chain cutting section 80 of each endless chain cutter 70A and 70B; chain sprockets 81 and 82 supported by the left, relative to a direction of movement of the endless chain shown by an arrow J in FIG. 11, side portions of the shafts 77 and 78 by a saddle 83 on the frame 74 provided with a means for sliding the saddle 83 along and on the frame 74 (not shown), endless chains 84 extending around the sprockets 81 and 82, chain sprockets 85 and 86 (not shown) supported by the right side portions of the shafts 77 and 78, an endless chain 87 extending around the sprockets 85 and 86, a number of the cutter bits (not shown) arranged on the endless chain 84 to form a left driven cutting section 88 of each endless chain cutter 70A and 70B and on the endless chain 87 to form a right driven cutting section 89 of each endless chain cutter 70A and 70B, so that the cutting chain 79 is capable of driving the cutting chains 84 and 87.

The frame section 73 of each of the chain cutters 70A and 70B that contains a multiple drive means 90 (components are not shown) that is capable of rotating the driving chain wheels 71 in the direction J and in an opposite direction shown by an arrow K in FIG. 11, a branched conduit 91 for transmission power, preferably pressure fluid, and signals to a drive means, branched conduits 92 to 95 extending up to the front end of the frame section 73 and having lower opening ends for transmission and injecting pressured air and the wash liquid to the chain cutters 70A and 70B and withdrawing a mixture of air-liquid-debris after penetration the facial wall from the chain cutters 70A and 70B, the ability of transmission the liquid or the mixture or the structure materials and a known means (not shown) for remotely switching the transmission over to the another aid.

FIGS. 11 to 14 illustrate an embodiment 98 of the hole-directing means 19 (see FIG. 1) that comprises a directing member 99 supported and guided by the frame section 73 for movement in axial transversal directions shown by arrows L and M in FIG. 11 and having an excavation-directing portion 100 for forcing in a crossing direction the guiding and supporting stiffeners 56 and 57 and the wall 58 of the frame member 32 in FIGS. 3 and 4 that are forming the guiding and supporting means 18 of the adjacent from behind forming means 11, for instance, in FIG. 1 and a drive means, such as a hydraulic double-acting piston and cylinder unit 101 for effecting relative movement between the directing member 99 and the frame section 64 from an operative position for interacting with the guiding and supporting stiffeners 56 and 57 and the wall 58 into an inoperative position (not shown) within a pocket or recess 102 provided in the frame section 64 for accommodating the directing member 99 in the inoperative position and filled up with an elastic material, such as a soft rubber capable of to be compressed by the member 99 that in its inoperative position can thus lie adjacent the inner face of the frame section 64 within the recess 102 to effect disconnection the forming means 11 and the forming means 10, for instance. FIGS. 13 and 14 illustrate the 0- and T-shaped directing portion 100.

In constructing a hole section by the use of the endless chain cutter means 69 constructed described above, the power drive means 90 when connected to the chain drive wheels 71 are supplied with pressure fluid to rotate the drive wheels 71 in the recess 102 provided in the frame section 64 for accommodating the directing member 99 in the inoperative position and filled up with an elastic material, such as a soft rubber capable to be compressed by the member 99 that in its inoperative position can thus lie adjacent the inner face of the frame section 64 within the recess 102 to effect disconnection the forming means 11 and the forming means 10, for instance. FIGS. 13 and 14 illustrate the 0- and T-shaped directing portion 100.

In constructing a hole section by the use of the endless chain cutter means 69 constructed described above, the power drive means 90 when connected to the chain drive wheels 71 are supplied with pressure fluid to rotate the drive wheels 71 in the intended directions J and K or in the same directions J and thereby urge the driving endless cutting chains 79 to move and rotate the shafts 77 and 78 with the driving chain sprockets 75 and 76 so that the shafts 77 and 78 when connected to the driven chain sprockets 81 and 85, 82 and 86 rotate the driven chain sprockets 81 and 85, 82 and 86 in the directions J and K or J and thereby urge the driven endless chains 84 and 87 in the directions J and K or J to forms the section of the hole.

The cutters 70A and 70B of the forming means 12, for example, when their cutting chains being moved in the direction K and inserted into the ground thereby urge the front portion of the frame means 15 with the frame section 90 in a direction shown by the arrow K in FIG. 7 toward the wall 58 of the forming means 11 and serve to facilitate the connection and joining of the forming means 12 and the forming means 11. When a formed hole section is filled up with the materials, the cutters 70A and 70B of the forming means 11, for example, when being inserted further into the ground up to the intended depth and distance in the hole section being formed and thereby urges the frame means 15 with the frame section 90 about the suitable, preferably upper portion of the frame means 15 in the direction J toward and against the formed facial wall of the structure being supported by the forming means 11 and serving to compress the facial wall by the portion 15D of the frame means 15 to form the structure.

FIGS. 15 to 19 show an end-and-face mill cutter embodiment 103 of the making means 16 in FIG. 1 for using in the firm or frozen or solid ground where it is needed to facilitate the withdrawing or taking the penetration debris out of the excavated section being formed, that comprises four barrels 104 to 107 supported by an end motive frame 108 for power rotation about a common preferably axis of co-axially grouped shafts 109 of the barrels 104 and 105 and the same co-axially grouped shafts (not shown) of the barrels 106 and 107. Each of the barrels 104 to 107 is provided with a number of blades 110 for displacement of debris material, where the blades 110 have a)-shaped cross-section (shown in FIG. 17) and arranged along crew spirals with the angle of spiral equal to about 75° to 85° at the cutting angle 30° to 36°, for example, and fixed to the shell, and a plurality of known cutter bits arranged along the length of the edges of the blades 110 and on the outer ends of the barrels at the cutting angle 30° to 36°, for example, to form the end-and-face cutter barrels 104 to 107. The frame 108 is slidingly mounted on a saddle 111 supported by a front end frame section 112 of the frame means 15 for reciprocate movement along the axes of the shafts 109 in transversal directions shown by the arrows L and M substantially crossing, preferably perpendicular to the direction B of advancement of the holes. A known hydraulic preferably drive means 113 is provided and connected to the shafts 109 for effecting the relative movement about the axes between the cutters 104 to 107 and the frame 108 and a second known drive means, such as a hydraulic piston and cylinder unit 114 is provided and pivotally connected to a bracket or the like formed on the inside of the frame section 112 and on the outside of the 111 and frame section 112 for effecting reciprocate and relative movement between the saddle 111 and the frame 112 to effect advancement of the hole.

An embodiment of the directing means 19 in FIG. 1 has a directing member 115 arranged and fixed to a rear, relative to the advancing direction A in FIG. 1, wall 112A of the frame section 112 capable of being forced into interaction with the embodiment of the supporting and guiding means 18 shown in FIG. 1, that is formed with the stiffeners 56 and 57 and the wall 58 shown in FIGS. 3 and 4, and has a directing portion 116 for forcing the stiffeners 56 and 57 and the wall 58 in a direction crossing the central longitudinal axis of the excavated hole section toward the advancing direction shown by the arrow B in FIG. 1. The portion 116 is operable to move the forming means 12, for example, with the member 115, relative to the stiffeners 56 and 57 and the wall 58 being forced toward the direction B by the activating means of the apparatus 01 capable of forcing the portion 116 against the stiffeners 56 and 57 and the wall 58.

The frame section 112 has branched transmission or injection pipes 117 provided with far or lower end outlet openings 117A and withdrawing pipes 118 and 119 having far or lower end inlet openings 118A and 119A and known check valves 120 and 121 for preventing the reversal of the mixture of wash fluid and debris material.

In operation, the cutters 104 to 107 are driven by means of the drive means 113 to rotate and by the unit 114 to reciprocate in the directions N and O, while the frame means 15 is advanced in the direction shown by the arrow B by the activating means of the apparatus 01 to form a continuous hole in the ground 1. The unit 114 when is supplied with pressure fluid to extend and thereby urges the cutters 104 to 107 from the opening 118A toward the opening 119A so that the check valve 120 closes the opening 118A, the end face wall 104A of the cutter 104 decreases pressure of the mixture being behind the face wall 104A and the end face wall 107A of the cutter 107 increases pressure of the mixture being ahead of the face wall 107A and facilitate flow of the mixture in the direction N along the facial wall of the excavated hole section the opening 118A and toward and into the opening 119A pass by and through the check valve 121 in the pipe 119. The unit 114 when is supplied with pressure fluid to shorten that acts the same manner and urges the cutters 104 to 107 toward the opening 118A so that the face wall 104A increases pressure of the mixture being between the face 104A and the opening 118A and facilitates flow the mixture toward and into the opening 118A and pass by the check valve 120 in the pipe 118 and the face wall 107A decreases pressure of the mixture being behind the end face 107A and facilitates flow the mixture in the direction O from the opening (not shown) of the pipe 117 along the facial wall of the hole section toward the opening 119A, while the check valve 121 closes. So, the making end-and-face mill means 103 is able to work like a deep-well displacement or piston and cylinder pump and facilitate the withdrawing of the mixture.

The cutting blades 110 when are rotated in opposite directions, reciprocated in the directions N and O, and advanced in the direction B by the multiple activating means of the apparatus 01 that force the facial wall of the hole section being formed and thereby urge the forming means 12, for example, in the directions N and O. The blades 110 when rotated in intended directions by the drive means 113 that force the facial wall and displace the debris material in the direction N and thereby urge the front end of the forming means 12 in the opposite direction O about the upper end of the frame means 15 of the forming means 12 toward the supporting and guiding means 18 of the forming means 11, for example, so that mate to join the directing member 115 and the supporting and guiding wall 58 of the forming means 11 or urge the front end of the forming means 11 in the direction O about the upper end of its frame means 15 toward the working facial wall of the structure being formed that is supported by the rear wall 15D of the frame means 15 shown in FIG. 1, so that compress the facial wall to form the structure.

Figure 15:
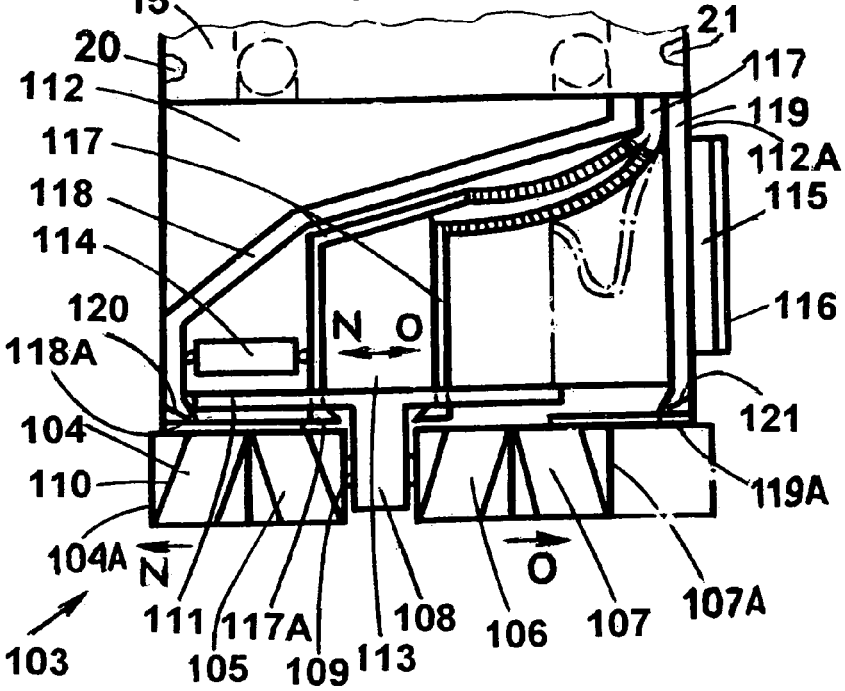
FIG. 15 is a side view of the preferred one-rowed end-and-face mill cutter embodiment 103 of the making means 16 and the embodiment 115 of the directing means 18 in FIG. 1 according to the invention.
Figure 16:
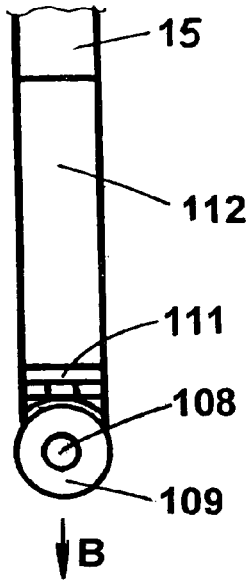
FIG. 16 is a front view of the mill cutter 103 in FIG. 15.
Figure 17:
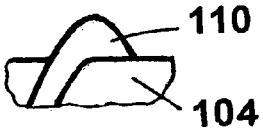
FIG. 17 is a side view of the cutting blade 110 in FIG. 15.
Figure 18:
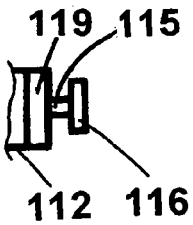
FIG. 18 is an upper view of the directing member 115 in FIG. 15.
Figure 19:
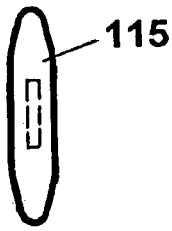
FIG. 19 is a rear view of the directing member 115 in FIGS. 15 and 18.
Figure 20:
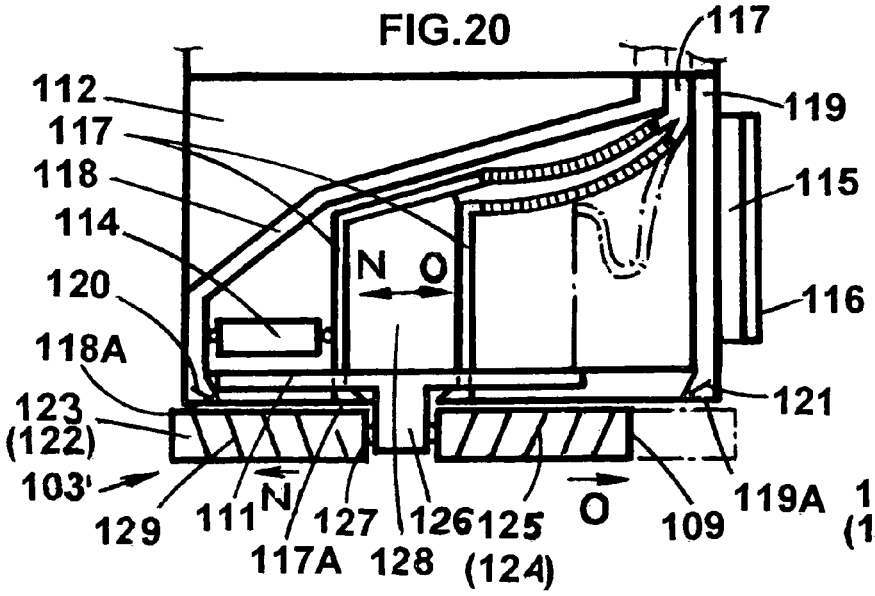
FIG. 20 is a side view of the preferred two-rowed end-and-face mill embodiment 16D of the making means 16 in FIG. 1 according to the invention.
Figure 21:
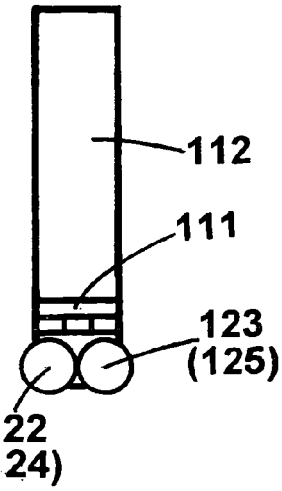
FIG. 21 is a front view of the cutters 122 and 123 in FIG. 20.

In FIGS. 20 and 21 there is shown a further end-and-face embodiment 103' of the making means 16 that is similar partly to the embodiment 103 shown in FIGS. 15 and 16 and adapted for forming hole sections in the more firm ground and consists of an intended number, four preferably end-and-face mill cutters 122 to 125 arranged in twos into two rows on sides a frame 126 and fixed to shafts 127 supported rotatably by the frame 126 and driven by a known drive means 128 (components are not shown) and provided with known cutting bits (not shown) and spiral blades 129 partly similar to the blades 110 in FIG. 17. There is shown also the similar directing member 115.

In constructing an equal-curvilinear, preferably circular cylindrical and multihole, deep and narrow excavation used in the construction of a paling-shaped underground structure, such as a horizontal preferably stratum and vertical preferably wall by the use of the apparatus 01 constructed described above, first the slot trench 3 having a predetermined depth is dug in the ground 1 along the structure line, where the structure, such as a hemicircular cylindrical trough is to be formed by means of a trench excavator or the like. The apparatus 01 (shown in FIGS. 1 and 2) then placed with the chassis 2 in a working position at the excavation section line. Thereafter, the motive means of the bridge crane 13 when located with its wire 13C provided with the carrier 14 engaged forcedly with the making means 16 and then with the first and front spare unit 24B shown in FIG. 22A by a sign A supplied with the motive power, preferably pressure fluid, to pull the wire 13C and thereby urge alternately the making means 16 and the front unit 24B toward the slip 8 to assemble the front unit 24B with the making means 16 in working positions together by the lock means 17 and the suitable connections of the conduits 20, 21 and other on the slip 8 into the forming means 10 for construction a first excavation section and slide them directionally into and up to the trench bottom 3A, then assemble a second spare unit 24B shown by a sign B in FIG. 22B in a working position on the slide 8 in end-by-end relationship together with the first unit 24B by the lock means 17 and the connections of the conduits 20 and 21 and other so that the slip 8 supports and guides the assembled units 24B to insert the forming means 10 into the trench bottom (shown in FIGS. 22C and 22D) in the intended advancing direction shown by the arrow B and being controlled by the slip 8. Then a ground-moving device like a single-bucket excavator fills up the bosoms between the trench walls 3B and 3C and the unit 24B with the coarse sand or gravel preferably or the withdrawn and compacted ground so that further advancement of the forming means 10 and the hole section being formed can be effected by movement of its hole section walls-supporting means 23 (shown in FIGS. 1 and 3 to 6) as it is discovered above. For that purpose the hydraulic units 54 of the first unit 24B are supplied with pressure fluid to extend and thereby urge the wall-supporting portions 52 and 53 of the stopped wall-supporting members 44 and 45 (shown in FIGS. 3 to 6) outwardly in opposite directions against and into compressive engagement with the walls 3B and 3C of the trench 3 to immobilize the members 44 and 45 relative to the walls and then the ram 49 of the first unit 24B when is supplied with pressure fluid to shorten and thereby urge the frame means 15 with the frame section 32 relative to the members 44 and 45 about the axis O in the advancing direction at a speed, $V_1$, and insert the making means 16 into the trench bottom 3A and the second unit 24B into the trench 3 with the frame means 15 (see FIG. 22E). Then the hydraulic units 54 of the second unit 24B when are supplied with pressure fluid to extend and thereby urge the portions 52 and 53 outwardly and immobilize the second unit 24B with the members 44 and 45 relative to the walls and then the ram 55 of the second unit 24B when is supplied with pressure fluid to shorten and thereby urge the frame member 15 with the section 32 of the second unit 24B forward and insert the making means 16 into the ground with the frame means 15, and the ram 55 of the first unit 24B when is supplied with pressure fluid to extend and thereby urge the members 44 and 45 forward relative to the section 32, and then the winch 13B when located with its wire 13C engaged forcedly with the third unit 24B shown by a sign C in FIG. 22F is supplied with pressure fluid to pull into and thereby urge the third unit 24B toward and assemble with the second unit 24B on the slip 8. Further advancement of the forming means 10 is effected by repeating these operations (shown in FIGS. 22G to 22M). The conduits 20, 21 and the other of the next in turn units 24B are connected alternately by their connecting means, cables and pipes to the control cabin 6 and the sources of pressure fluid, wash liquid and air so that the making means 16 forms the section of the hole along the section line, the direction of the excavated section diverges from the tangent of the central longitudinal axis of the excavation section about the axis O of curvature of the excavation section and is determined at first by the slip 8. The frame means 15 moves relative to and force the slip 8 at the frame means 15 in a direction opposite of the diverged direction to cause the frame means 15 to be forced in the diverged direction so to excavate the ground and advance the excavation section in the diverged direction. Then the equally-curved advancing direction being controlled by the walls of the excavated section being formed. The advancement of the forming means 10 up to the intended depth and distance is effected by operating the rams 49 to effect alternate longitudinal movement in the advancing direction between the sections 32 of the frame means 15 and each group of the members 44 and 45. When groups of the members 44 and 45 of the units 24B are inserted into the trench 3 to support the walls 3B and 3C with the filling (see FIGS. 2 and 22E), then further movement of the forming means 10 is carried out by coordinated movements of the groups of the members 44 and 45 (shown in FIGS. 22F to 22M). So, while the members 44 and 45 of the first unit 24B is stopped and supports the walls and urges the making means 16 with the frame means 15 deeply into the ground 1, the members 44 and 45 of the second unit 24B are moved forward relative to the frame member 15 and stopped (see FIG. 22F) to support the walls of further excavated hole section and to urge the making means 16 with the frame means 15 deeply into the ground 1, and then the members 44 and 45 of the first unit 24B are moved forward relative to the frame means 15 and stopped (see FIG. 22G) to support the walls of the further section and to urge the making means 16 with the frame means 15 deeply into the ground 1, and the winch 13B assembles the unit 24B shown by the sign C when it is disassembled, for instance, from the forming means 10 moving out of the formed hole, etc. A magnitude of the speed $V_1$ is determined accordingly to the intended inserting speed of the making means 16 and the disassembling rate and the lifting or withdrawing speed of the forming means 10 (later described). A number of the grouped members 44 and 45 those urge the forming means 10 and 12 within the excavation section that is determined accordingly to a force required for the movement of the forming means 10 and 12. For instance, if the hole walls are stable, the movement of the forming means 10 and 12 can be effected by two alternately and longitudinally displaced groups of the members 44 and 45.

When the hole is formed then the winch 13B with its wire 13C is engaged forcedly with the making means 16 and the first unit 24B of the next in turn guided forming means 12, for example, shown in FIG. 1 and is supplied with motive power to pull the wire 13C into and thereby urge alternately the next making means 16 and the next first unit 24B toward and on the slip 8 so that to be supported by the slip 8 in a next working position on the next excavation section line for longitudinal relative movement into the trench 3 and assembled together by the lock means 13 and the connections of the conduits 20, 21 and the other and then the directing means 19 of the forming means 12 is engaged forcedly with the guiding and supporting means 18 of the adjacent from behind previous forming means 11, for instance, located in the formed hole for longitudinal relative movement and inserted at the next working position into the trench 3, then the bosoms are filled up with the sand or gravel or the compacted withdrawn ground and then the forming means 12 inserts into the bottom 3A of the trench 3 to a next predetermined depth and distance in the next excavation section and in a next intended advancing direction to excavate the ground 1 and form the next section along the next section line, where the direction of advancement of the next section diverges from the tangent of the central longitudinal axis of the next excavated section about the axis O of curvature of the next section and is determined by the guiding and supporting means 18 of the forming means 11. After that the portions 15A and 15B of the frame means 15 of the next forming means 12 are operated by the activating means of the walls-supporting means 23 to force the walls of the adjacent from behind hole formed previously and supporting the frame means 15 of the forming means 11 with the previous frame means 15 in a direction opposite of the next diverged direction to cause the making means 16 with the frame means 15 of the forming means 12 to be forced toward and in the next diverged advancing direction so to advance the next hole section in the next diverged direction close to the hole formed previously. For this purpose the hydraulic unit 65 of the directing member 63 (see FIG. 7) or the hydraulic unit 101 of the directing member 98 (see FIG. 11) when is supplied with pressure fluid to extend and thereby urge the corresponding directing member 63 or 98, or the crane 13 when is supplied with motive power to extend the wire 13C and thereby allow the directing member 115 (see FIGS. 15 and 20) into movable engaging connection with the guiding and supporting means 18 of the adjacent previous frame means 15 being supported by the walls of the previous formed hole, the rams 49 when are supplied with pressure fluid to move and thereby push together the adjacent wall-supporting members 44 and 45 where the directing means 19 is located to cause the guiding and supporting means 18 to be continuous beside the directing means 19 and then the forming means 12 (see above) inserts into the trench 3 and the ground 1 by the method above described up to the predetermined depth and distance and stops, and then the corresponding unit 65 shown in FIG. 7 or the unit 101 shown in FIG. 11 when is supplied with the pressure fluid to shorten and thereby urge the corresponding directing member 63 or 98 backward into the inoperative position or the unit 114 when supplied with pressure fluid to shorten and thereby urge the milling barrels 103 to 106 (shown in FIGS. 15 and 20) to allow the previous directing forming means 10 be moved without an obstacle, such as the moved out member 63 or 98 out of the formed hole, and operating the activating means of the apparatus to move the forming means 10 out of the formed hole to empty the hole section and materials 22 of the structure to be let into the emptied section (later described) and repeat the operations to form alternately and closely further holes and structure sections up to the end of the excavation line.

The winch 13B, units 49 and 54, when are supplied with motive power to insert the wedge-shaped cutter 60 shown in FIGS. 7 and 8 or the endless chain cutters 70A and 70B shown in FIGS. 11 and 12 or the end-and-face mill cutters 103 and 103' shown in FIGS. 15 to 21 of the forming means 12, for example, into the ground 1 in the advancing direction shown by the arrow B and the drive means 90, 113 and 128 when supplied with motive to move the corresponding endless cutting chains 79, 84 and 87 of the cutters 70A and 70B, the blades 110 of the cutters 103 and the blades 129 of the cutters 103' in the direction shown by the arrow A in FIG. 1, the arrow H in FIG. 7, the arrow K in FIG. 11, the arrows N in FIGS. 15 and 20 and thereby urge the front end of the frame means 15 with its corresponding frame section 64 or 73 or 112 of the forming means 12 in a direction shown by an arrow P in FIG. 1 toward the supporting and guiding portion 15C and wall 58 of the frame means 15 of the forming means 11 to facilitate the connection the forming means 12 and the forming means 11 and controlling the advancement of the excavated hole section being formed and the forming means 11 firstly in the direction shown by the arrow P toward and against the facial wall of the structure being formed that is supported by the forming means 11 so that the rear portion 15D compress the facial wall to form the structure and secondly in the direction shown by the arrow A from the formed structure wall into intended positions in the formed hole.

The winch 13B, units 49 and 54, when are supplied with motive power to operate and thereby urge the forming means 10, for instance, with the frame means 15 out of the formed hole to above the ground level and in an intended emptying direction shown by the arrow D in FIG. 1 so that the forming means 10 forms a section of the emptied hole along the structure section line to let the materials of the structure into the emptied section, where the direction of the emptying diverges from the tangent of the emptied section and is determined. Then the winch 13B, units 49 and 54, when are supplied with motive power to operate and thereby move a means for directing the emptying, which is substantially similar in construction to the frame means 15 in the working position to force the walls of the hole section at the frame means 15 in a direction opposite of the diverged direction to cause the directing and motive frame means 15 to be forced in the diverged direction so to advance the emptied section in the diverged direction.

The backward movement of the forming means 10 and the hole section being formed can be effected by movement of its hole section walls-supporting means 23 (shown in FIGS. 1 and 3 to 6) as it is discovered above and by the wire 13C of the bridge crane 13. For that purpose the activating means of the bridge crane 13 that is supplied with motive power to move the carrier 14 engaged forcedly with an end unit 24 shown by a mark E in FIG. 23A in an emptying direction shown by the arrow D in FIGS. 1, 23B and 23G about the axis O in FIG. 2, while the units 54 of a suitable number of the units A to D are supplied with the pressure fluid to extend and thereby urge the wall-supporting portions 52 and 53 of the stopped wall-supporting members 44 and 45 (shown in FIGS. 3 to 6) outwardly in opposite directions against and into compressive engagement with the side walls of the hole to immobilize the members 44 and 45 relative to the walls and the rams 49 are supplied with pressure fluid to move and thereby urge the frame means 15 with the sections 32 in the same direction D relative to the stopped and expanded members 44 and 45. When the ram 49 of any one of the units A to D, the unit A, for instance, ends its working stroke then the units 54 of the unit A release the pressure fluid to shorten and thereby release the members 44 and 45 relative to the walls and then the ram 49 of the unit A when is supplied with pressure fluid to move and thereby urge the members 44 and 45 relative to the section 32 in the direction D into an advanced position shown in FIG. 23B. Then the ram 55 of the next in turn unit D, for example, ends its working stroke and the units 54 when release the pressure fluid to shorten and thereby release the members 44 and 45 and the ram 55 when is supplied with the pressure fluid to move and thereby urge the members 44 and 45 in the direction D into a further advanced position shown in FIG. 23D and stops the members 44 and 45 to extend. When the unit E is above the ground level, the activating means of the bridge crane 13 and the rams 55 stop the frame means 15 to disassemble the unit E and connect the supplying cables and pipes to the unit D, and then the activating means of the bridge crane 13 that are supplied with motive power to move the carrier 14 and thereby urge the spare unit E away in a direction shown by the arrow E in FIGS. 1 and 23F and then to move the carrier 14 into engagement with the unit D and in the direction D. These operations are repeated with the units C, B and A and the bridge crane 13 to effect movement of the forming means 10, for example, out of the hole (shown in FIGS. 23E to 23G) and to allow the materials 22 of the structure to be let into the emptied hole.

The operating of the rams 55 to move the forming means 10 with the frame means 15 relative to the supporting members 44 and 45 in the emptying direction D is effecting at a speed, $V_2$, where the speed must be equal to a speed of movement of the forming means 10 in the same direction with the carrier 14 by the bridge crane 13 to cause the forming means 10 to decrease the traction by and the overturning moment about the chassis 2. A magnitude of the emptying speed $V_2$ is determined accordingly to the speed of letting and laying the materials 22 in the hole being emptied and the disassembling rate of the forming means 10. A number of the grouped members 44 and 45 those urge the forming means 10 to 12 within the hole section that is determined accordingly to a force required for the movement of the forming means 10 and 12. For instance, if the hole walls are stable, the continuous uniform or step-by-step backward movement of the forming means 10 to 12 can be effected by two and more alternately and longitudinally displaced groups of the members 44 and 45.

When the excavation section is formed then the winch 13B with its wire 13C arranged about the pulley 27 and engaged forcedly with the forming means 11 shown in FIG. 1 that is motionless in the formed hole section is supplied with motive power to pull into and thereby urge the chassis 2 forward along the excavation line with the pulley 27 and stop at the next hole section line.

The apparatus 01 is adapted to construct an equally curved multisectional, preferably narrow and paling-shaped underground structure, such as a circular cylindrical or wedge trough- or helical spin spiral-shaped or plane, horizontally extending drain or foundation or impervious stratum in an adit or gallery and horizontally and vertically extending wall in a trench being composed of a plurality of the same preferably adjacent and conjugated circular cylindrical or screw spin or plane holes being formed alternately of a predetermined depth of 15 to 100 meters and more, preferably 25 to 50 meters, and a thickness of 0.15 to 0.30 meter or more, preferably 0.20 to 0.25 meter in diverse grounds. The spare units 24 of the extensible motive frame means 15 can be of the length equal to about 2 to 25 meters, 3 to 5 meters being preferred; and using the suitable structure materials which can be let and laid in place of a hole section emptied by the forming means 10 to 12 being capable of moving in the ground by the method according to the present invention.

Figure 24A:
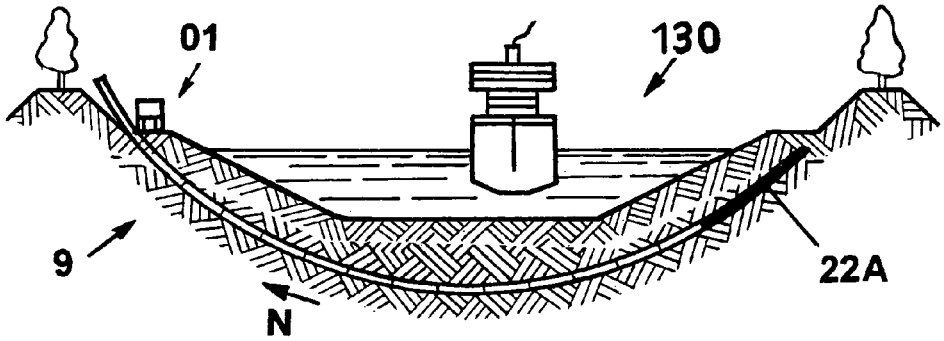
FIGS. 24A, 24B, 24C, 24D and 24E are views schematically illustrating some paling-shaped underground structures which the apparatus in FIGS. 1 and 2 is adapted to construct.
Figure 24B:
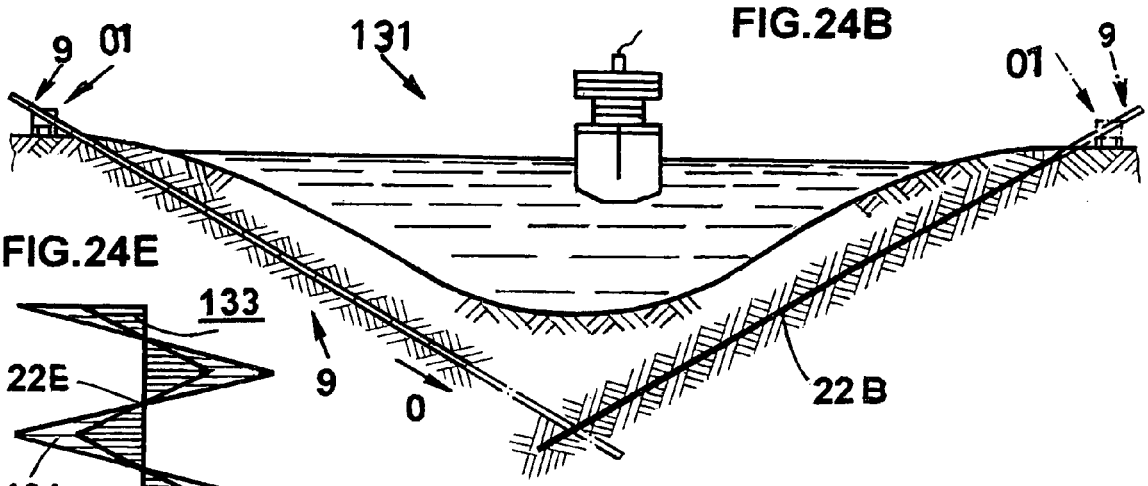
Figure 24E:
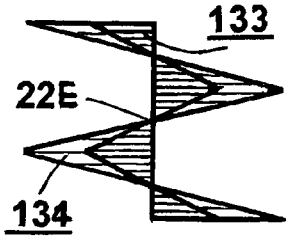
Figure 24C:
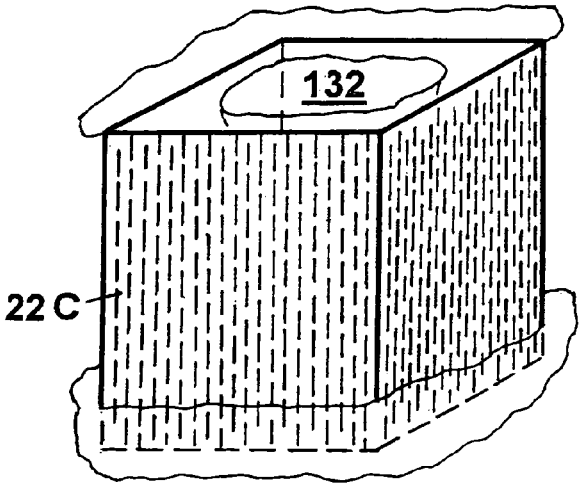
Figure 24D:
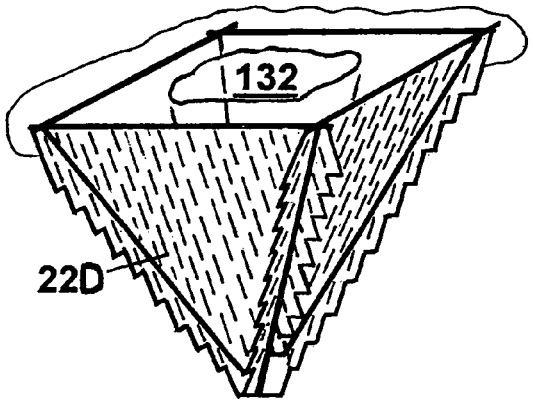

FIGS. 24A to 24E illustrate schematically some underground equally-curved, narrow and paling-shaped stratums and walls capable to be constructed accordingly to the invention: a circular cylindrical trough-shaped drain or impervious stratum 22A extending horizontally across, along and under a navigation channel 130 shown in FIG. 24A, a wedge trough-shaped drain or impervious stratum 22B extending across, along and under a natural navigation waterway 131 shown in FIG. 24B, box- and funnel-shaped impervious retaining barrier or diaphragm or walls 22C and 22D shown in FIGS. 24C and 24D both extending horizontally and vertically for surrounding a plume 132 of contamination at a contaminated material site; a helical-shaped stratum 22E consisting of a helical central section 133 and one or a plurality of co-axial helical spin sections 134.

In FIGS. 25 to 29 it is shown an embodiment 200 of an apparatus for constructing an underground multisectional, preferably paling-shaped, synclinal and about conical or hemispherical, and narrow structure 201 in a multihole excavation 202 being formed in the ground 203 that includes mainly ball-shaped rocks of a size equal up to about 0.5 meter and more, for instance.

The apparatus 200 comprises a travelling chassis 204 which being located and movable on a ground road 205 formed along the length of a circular structure line about the axis O of the structure 201 that is to be formed in a predetermined circular advancing direction shown by an arrow A in FIGS. 25 and 27. The chassis 204 has a frame 206, an engine 207 connected and supplying motive power to a means 208 for supplying a pressure fluid to a structure-forming means 209 (later described), an operator's cabin or cockpit 210 which is provided with a means for controlling the construction of the structure, front road wheels 211 which are provided with a coupling rod 211A for connecting the chassis 204 to a cargo tractor (not shown) for transportation of the apparatus 200 and back road wheels 212, where the wheels 211 and 212 rolling along and on the road 205 and being supported by wheels axles capable to be turned about a vertical preferably axis relative to the frame 206 into and fixed in an intended turned working position by known suitable stops (not shown), a known means for supplying materials to the forming means 209 (not shown), outrigger supports 213 for immobilising the stopped frame 206 relative to the road 205, a connecting framework 214 which is mounted on the chassis 204, adapted to connect the chassis 204 to the forming means 209 and comprises ⌈-shaped pier columns 215 which are supported by the frame 206 and provided with corbels 215A of Π-shaped cross-section connected between by a beam 216 and servicing for supporting a known bridge crane 217 which is provided with a bridge beam 217A being supported with rolls and rails by the corbels 215A for movement along the length of the corbels 215A by a drive means (not shown) comprising a means for supplying motive power that has screw shafts each of which is supported rotationally by the corbels 215A and threadedly engaged with a nut supported pivotally by the ends of the bridge beam 217A and a hoisting winch 217B being supported and guided by the bridge beam 217A for longitudinal displacement and working together with its wire 217C and a number of carrier members 218 being capable to be forced into engagement with angular dagger-shaped and structure sections-forming means 219 to 221 (later described), a guide pulley 222 fixed rotatably on the frame 206 for supporting and guiding the wire 217C that is capable to be engaged forcedly with the forming means 220, for instance, located in a formed hole section, by aid of the carrier member 218 and servicing for advancement of the chassis 204; a slip 223 for assembling, disassembling, guiding and supporting the forming means 219 to 221 that comprises an intended number of exchangeable sets or pluralities of slip members 223A, where the slip members 223A of each of the sets of the slip 223 that are shaped into a shape of the central longitudinal surface of the forming means 219 to 221, arranged preferably in an intended meridian and circular advancing direction shown by an arrow B in FIGS. 25 and 26 about the center O between and fixed with their ends to the frame 206 and a beam 224 located between and supported by the columns 215 and having the ability to be displaced in vertical direction and fixed in intended horizontal preferably working positions by its ends and the aid of pins 225 and 226 arranged along the columns 215 by the aid of lugs and pins (not shown) arranged along the frame 206 and the beam 224 to form the slip 223. Preferably the connections are easily detachable so that the members 223A can be removed and replaced to cope with the forming means 219 to 221 of the different intended circular cylindrical shapes.

Each of the forming means 219 to 221 (there it is possible to use the forming means 219 and 221 only) comprises an elongate and extensible motive frame means 227 for guiding and supporting components of the respective forming means 219 to 221 that has a forward oriented, relative to an advancing direction shown by an arrow B in FIGS. 25 and 26 acute angle and triangular shape and the uniformly curved, circular cylindrical and about plane central longitudinal surface, a front and oriented downward and forward, relative to the advancing directions A and B, angle-shaping end portion for supporting and guiding a longitudinally extending hole sections-making and wedge-shaped cutter 228 having downward- and forward-oriented, angle- and wedge-shaping cutting portions disposed at the angle of sharpness that is equal to about 45°-60°, a rear angle-shaping and backward- and downward-oriented portion 229 for supporting the cutter 228 for movement in the direction A. The portion 229 has a groove shape, is adapted for directing the excavation of holes and able to force the frame 227 from its position toward the direction B and control the direction of the advancement of the holes.

The frame means 227 has a conduit or a pipe 230 for transmission and injection or pouring liquid structure materials, such as a mortar, that extends from the upper end into and along the length of the frame 227 and has a branched lower end 230A opening rearward at the lower end of the frame 227.

The frame 227 consists of a front triangular frame section 227A and a number or a plurality of conjugated trapezoidal spare frame sections, such as an urged frame section 227B and an urging frame section 227C (later described) that are capable to be joined securely together in consecutive order and end-to-end relationship and disjoined by a quick-acting lock means 231, such as lugs and pins located between the sections 227A to 227C. The section 227C and the following urged and urging motive frame sections which are similar to the sections 227B and 227C and comprise conduit sections for transmission motive power, the materials and electrical signals that are connected by a known suitable fitting and electrical connecting means (not shown) which are located between the section 227C and the rest sections together and to the respective associated pumping means 208, controlling means 210 and means for supplying the forming means 219 and 220 with the structure materials by the length of pipes and cables (not shown).

For effecting the insertion of the front sections 227A, 227B and 227C into the ground 203 the framework 214 is provided with a double-acting hydraulic cylinder and piston unit or ram 232 (shown in FIGS. 25 and 26) which has its cylinder pivotally secured as at the rear to a bracket or the like formed under the bridge beam 217A, that pivot connection permits the ram 232 to be swiveled to follow the sections 227A to 227C when that being inserted into the ground 203. The ram 232 has a hemispheric head 232A provided at the end of its piston rod and capable to engage forcedly with conjugated spherical thrust pads provided in the number of foot-steps 233 of a replaceable elongate rigid saddle 234 arranged and spaced accordingly to the length of the working stroke of the ram 232 along the saddle 234 having the lower central longitudinal surface shaped into the shape of the central longitudinal surface of the frame section 227C, for example, placed on the slip 223 and provided with an upper claw portion 234A for geometric forcedly engaging with the upper edge of the section 227C by aid of connecting lugs and pins of the lock means 231. Preferably the connection 231 is easily detachable so that the saddle 234 can be removed and replaced to cope with any section 227 at different positions on the slip 223.

To avert the overturning of the chassis 204, there are provided a set of telescopic preferably brace rods 235 connected pivotally the bridge beam 217A through the carrier member 218 and the frame means 227 of the forming means 220, for example, located in the excavation and supported by the side walls 302A and 302B.

Each of the forming means 219 to 221 comprises a plurality or a set of side wall-supporting members 236 and 237 which are reciprocatingly movable in transversal directions shown by an arrow C in FIG. 28 and along the frame means 227 in directions shown by arrows D in FIG. 25, where each pair of the interacting members 236 and 237 is supported and guided by a box frame 238 supported and guided by the frame means 227 for longitudinal displacement, and to force or shift the members 236 and 237 with the box frame 238 relative to the frame means 227 there are provided a plurality or a set of double-acting hydraulic rams 239. The frame means 227 serves to space, support and guide the box frames 238 during their displacement.

Each of the supporting members 236 and 237 that comprises a main frame portion 240 being supported and guided by the box frame 239 for displacement in transversal direction shown by an arrow C in FIG. 28 and a side wall-supporting portion 241. To force or shift the members 236 and 237 in the opposite directions C there are provided cylinder and piston units 242 which are located between and pivotably connected with known foot-steps (not shown) to the portions 241.

During the excavating or emptying operations, a pair of the members 236 and 237 or a group of the members 236 and 237 is advanced to support the walls 203A and 203B by supplying pressure fluid to the ram 239 associated therewith so that the latter moves. The other rams 239 are preferably blocked in known matter or moved so that the reminder of the members 236 and 237 remain stationary and are expanded and outwardly forced into compressive engagement with the walls 203A and 203B being supported by the respective members 236 and 237 and immobilising the members 236 and 237 relative to the walls 203A and 203B by supplying pressure fluid to the units 242 associated therewith so that the portions 241 move in the transversal directions C into compressive friction contact with and compressively engage the walls 203A and 203B and thus serve to anchor the box frame 238 which thereby effectively acts as an abutment for the ram 239 which is operated. This procedure would be repeated for the other members 236 and 237 and the rams 239 of the advanced and stopped members 236 and 237 can be operated in a reverse sense to draw up the frame means 227. During the latter phase when the frame means 227 is drawn up, a number of the members 236 and 237 collectively act as an effective abutment for the rams 239.

The section 227' of the frame means 227, the members 236 and 237, the box frame 238, the ram 239 and the hydraulic units 242 are composed into an assembly unit 243 and a number or a plurality of the similar units 243 can be assembled alternately in consecutive end-to-end tandem order into the forming means 221 being inserted into the ground in the direction B and disassembled alternately from the forming means 219 being moved backward out of the formed hole in an emptying direction shown by an arrow E in FIG. 25 and simultaneously the structure materials can be let through the opening 230A in a direction shown by an arrow F in FIGS. 25 and 28. Then the winch 217B when located with its wire 217C engaged with forming means 220 located in the excavation 202 and supported by the walls of the excavation 202 is supplied with motive power to pull into the wire 217C and thereby urge the chassis frame 206 with the pulley 222 forward toward and relative to the forming means 220 so that the chassis 204 advances a step and complete the construction of that structure section. The operations of inserting the forming means 221 and withdrawing the forming means 219, for example, in this way is carried out as part of an overall sequence involving the advancement of the apparatus 200 and the structure 201.

In FIGS. 29A to 29D it is shown schematically one of the units 243 of the forming means 219 to 221 that has the frame section 227' provided with the wedge-shaped supporting and guiding cutter portion 228', the directing groove portion 229', a central window of a trapezoidal shape formed by a front wall 244 relative to the direction B of advancement of the unit 243, a rear wall 245, a backward-oriented relative to the advancing direction A in FIG. 25 side wall 246 that is disposed parallel preferably to the groove portion 229' and a forward-oriented side wall 247 that is disposed parallel preferably to the cutter portion 228', the box frame 238 (the wall-supporting members 236 and 237 are shown in FIGS. 25 and 26 and not shown in FIGS. 29A to 29D) placed for longitudinal movement between the walls 244 to 247 effecting by the ram 239 which is pivotally secured via linkage to the box frame 238 and to the frame section 227'. The axis of the ram 239 is oriented in a direction shown by an arrow G crossing the cutter portion 228' and the groove portion 229' and passing behind, relative to the direction A, the vertex of the angle-shaped frame means 227.

In advancing the hole by the forming means 221 along the forming means 220 located motionless in the formed hole (shown in FIGS. 25 and 28) with its wall-supporting members 236 and 237 supported by the hole side walls or expanded and engaged compressively with in the formed hole walls, when the units 242 of the unit 243 (shown in FIG. 29A) are supplied with pressure fluid to extend and thereby urge the members 236 and 237 outwardly in opposite directions into compressive engagement with the side walls of the excavated hole section being formed so that the box frame 238 is immobilised relative to the walls, then the ram 239 is supplied with pressure fluid to shorten and thereby urge the frame section 227' forward toward the immobilised box frame 238 in the direction shown by the arrow G and crossing the wall 246, the directing groove section 229' and the adjacent from behind supporting and guiding cutter 228 shown by a chain-dotted line at the position 228A of the forming means 220 (shown in FIGS. 25 and 28) so that the directing groove portion 229' moves also in a direction shown by an arrow I and mate together with the supporting and guiding cutter 228 to join the forming means 221 and 220 together and the cutter 228 of the forming means 221 moves in the direction G and also in a direction shown by an arrow J to slit and split the ground 203 with an unwedging force which is more in many times than the forces created by the rams 239 and enough to move aside a buried rock of a diameter up to 50 centimeters that come across in the ground, for instance, and to advance the hole section being formed in the directions J or A and B up to the box frame 238 stops the frame section 227' with the rear wall 245 at the position 245A. So, the wedge-shaped cutter 228 of the forming means 220 located in the formed hole section which side walls are supporting the forming means 220 that is able to guide and support the adjacent from the front groove portion 229 of the frame means 227 of the forming means 221 being inserted into the ground, where the groove portion 229 is able to force the frame means 227 relative to the walls of the formed hole section from its position toward the intended direction of advancement of an excavated hole section being formed and control the direction of the advancement of the next excavated hole section in the intended direction of advancement of the multihole excavation.

Figures 29A, 29B, 29C, 29D, 30A, 30B, 30C, 30D, 30E, 30F, 31A, 31B, 31C:
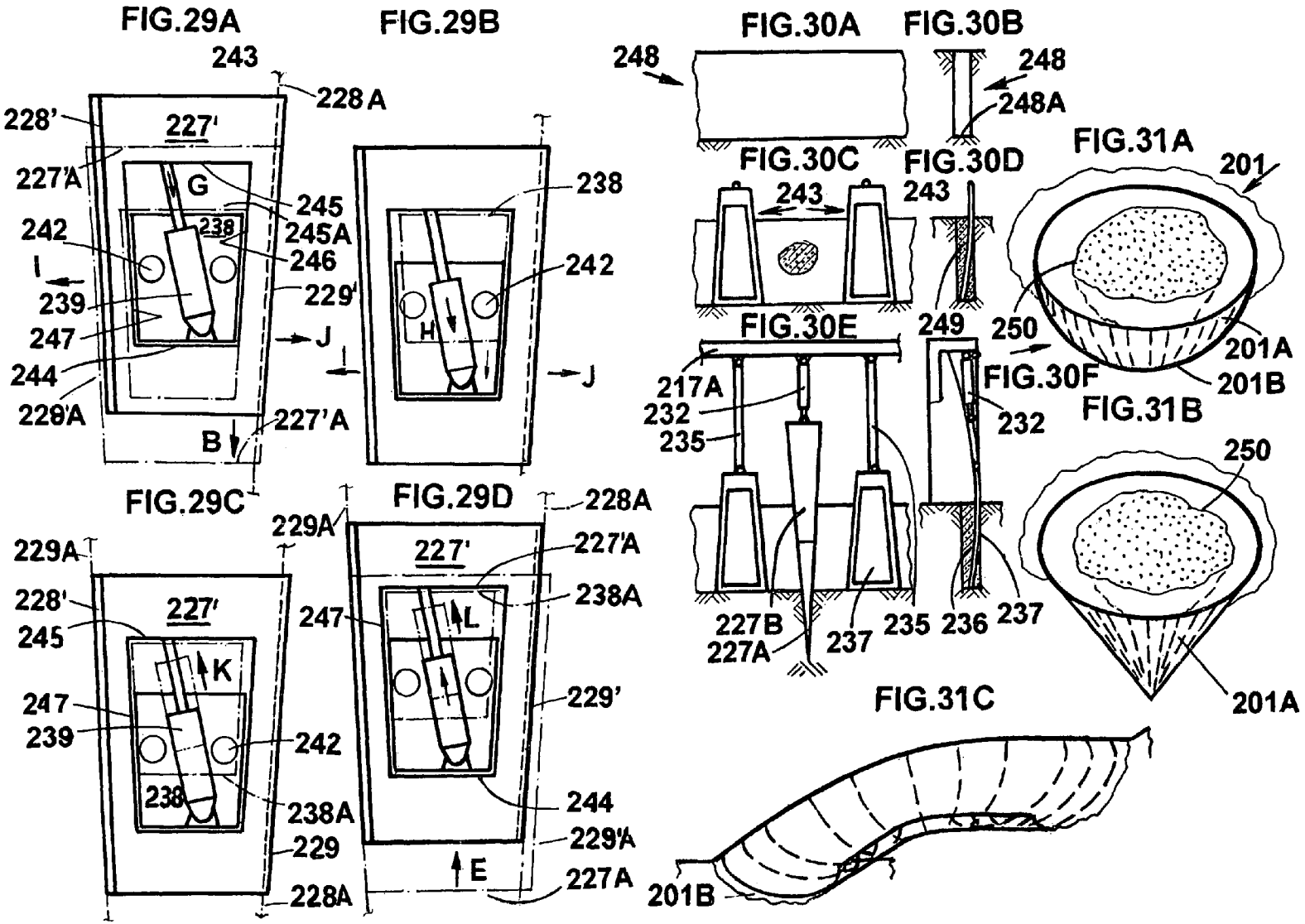
FIGS. 29A, 29B, 29C and 29D are views illustrating schematically the processes of relative movement of the box member 238 and the motive frame section 227 in FIGS. 25 and 28.
FIGS. 30A, 30B, 30C, 30D, 30E and 30F are views illustrating schematically the processes of inserting the urged front motive frame sections 227A and 227B into the ground by aid of the urging motive frame sections 227C in FIG. 25 according to the invention.
FIGS. 31A, 31B and 31C are views illustrating schematically some underground funnel- and half tore-shaped structures consisting of the triangular and trapezoidal sections which the apparatus 200 in FIGS. 25 to 29 is adapted to construct.

In constructing the structure 201 by the use of a baffle means for supporting the structure working facial wall 201A being formed, the baffle means is substantially similar in construction to the forming means 220, when the forming means 221 is located motionless in the formed hole (shown in FIGS. 25 and 28) with its wall-supporting members 236 and 237 supported by the hole side walls or expanded and engaged compressively with in the formed hole walls and the box frame 238 of the unit 243 of the forming means 220 that is shown schematically in FIG. 29B and located in the advanced position, for instance, and the units 242 are supplied with pressure fluid to extend and thereby urge the members 236 and 237 outwardly in opposite directions into compressive engagement with the side walls of the formed hole section so that the box frame 238 is immobilised relative to the walls and then the ram 239 is supplied with pressure fluid to shorten and thereby urge the frame section 227' forward toward the immobilised box frame 238 in the direction G and crossing the wall 246 so that the baffle and directing groove section 229' moves also in the direction I against the facial wall 201A being supported by the section 229' and compacts the facial wall 201A to form the structure 201.

During the operation of emptying the formed hole section with the forming means 219 (shown in FIGS. 25 and 28), when the forming means 220 is located in the front formed hole section and the units 242 of the unit 243 of the forming means 219 that is shown schematically in FIG. 29C in a rear working position release pressure fluid to shorten and thereby release the members 236 and 237 (shown in FIG. 28) out of compressive engagement with the side walls of the formed hole section being emptied to release the box frame 238 for movement and the ram 239 is supplied with pressure fluid to shorten and thereby urge the members 236 and 237 with the box frame 238 relative to and toward the wall 245 of the frame section 227' being supported motionless or urged by the other units 243 in the emptying direction shown by the arrow E in FIG. 25 and an arrow K in FIG. 29C crossing the wall 247 up to an advanced position 238A where the wall 245 stops the members 236 and 237 with the box frame 238. Further (see FIG. 29D), when the units 242 are supplied with pressure fluid to extend and thereby urge the stopped members 236 and 237 outwardly into compressive engagement with the side walls and then the ram 239 is supplied with pressure fluid to extend and thereby urge the directing cutter section b with the frame section 227' in the direction K from the position 227'A toward, against and along the guiding and supporting groove 229 at the position 229A of the forming means 221 so that to facilitate the movable connection and engagement of the directing cutter section 228' with the guiding and supporting groove 229 up to the box frame 238 stops the section 227' with the wall 244 while the directing, supporting and compacting groove section 229' retreats from the facial structure wall 201A and forms a gap or interior 202 between the wall 201A, the side walls of the formed hole and the groove section 229' to let and lay the structure materials to form the structure 201. So, the groove portion 229 of the forming means 220 located in the front formed hole which side walls are supporting the forming means 220 that is able to guide and support the adjacent from behind edge-shaped cutter 228 of the forming means 219 being moved out of the rear formed hole section and force the frame means 227 of the forming means 219 relative to the walls of the front formed hole section from its position toward the intended direction E of the emptying of the rear formed hole section and control the same direction E of the advancement of the emptied gap in the intended directions A and E of advancement of the section of the multisectional structure 201.

In constructing an equally-curved and narrow multihole excavation 202 used in the construction of an underground multisectional and preferably synclinal, about conical or hemispherical or tore-, and paling-shaped structure 201 by the use of the apparatus 200 (shown in FIGS. 25 to 28) constructed described above, first a slot trench 248 having a predetermined depth and width is dug in the ground 203 along the structure line where the structure 201 is to be formed (shown in FIGS. 30A and 30B) by means of a trench excavator or the like and then the apparatus 200 is placed with the cargo tractor in a working position at a first excavation section line. Thereafter, the bridge crane 217 when located with its wire 217C engaged forcedly and alternately with two broadest preferably the units 243 is supplied with motive power to move itself and pull the wire 217C and thereby urge alternately the units 243 at working positions, where the supporting members 236 and 237 are in the inoperative narrowed positions, into the trench 248 to stop within the trench 248 to support the side walls 248A, bosoms between the units 243 and the walls 248A are filled up with a coarse sand or gravel preferably or the compacted or packed withdrawn ground 249 by a known means for moving and packing those materials, the units 242 of the stopped units 243 are supplied with pressure fluid to extend and thereby urge the members 236 and 237 to expand and be outwardly forced into compressive engagement with the walls 248A being supported by the members 236 and 237 so that the members 236 and 237 immobilize the units 243 relative to the walls 248A to form abutments. Then the bridge crane 217 when located with its wire 217C engaged forcedly with the front sections 227A to 227C, for example, of the forming means 219, where the section 227C is preferably similar in construction to the unit 243, that is supplied with motive power to displace the sections 227A to 227C into a working position on the slip 223 and the intended hole section line, displace a number of the rods 235 connected with their upper ends to the beam 217A into working positions to connect forcedly their lower ends to the units 243 servicing as the abutments. Then the unit 232 when located with its rod head 232A engaged with the respective foot-step 233 of the saddle 234 is supplied with pressure fluid to extend and thereby move the cutter 228 in the working position into the filled trench 248 and in an intended advancing direction so that the cutter 228 forms the section of the hole along the section line, the direction B of the excavation diverges from the central longitudinal axis of the section about the axis O of curvature of the excavated hole and is determined, and move the frame sections 227A to 227C in the intended advancing direction B to cause the sections 227A to 227C to force the slip 223 at the sections 227A to 227C in a direction opposite of the diverged direction B to cause the sections 227A to 227C to be forced toward and in the diverged direction B so to guide and support the cutter 228 to advance and excavate the hole section within the filled trench 248 and its bottom 248B in the diverged direction B and to compact the walls of the hole section to keep the sections 227A to 227C on the intended section line. Then the bridge crane 217 is supplied with motive power to urge the next in turn frame section 227D, preferably similar in construction to the unit 243 toward the slip 223 into the first working position on the slip 223 and toward the section 227C located in and above the trench 248 to assemble forcedly the section 227D to the section 227C in end-by-end relationship by aid of the lock means 231 on the section line, then urge the saddle 234 toward and into engagement with the section 227D by aid of the lock means 231, and supply the ram 232 with pressure fluid to engage its rod head 232A with the suitable foot-step 233 of the saddle 234 and to extend and thereby urge the sections 227A to 227C with the section 227D supported by the slip 223 to force the ground at the sections 227A to 227C in a direction opposite of the diverged direction B to cause the sections 227A to 227D to be forced toward and in the diverged direction B so to further advance the hole section in the diverged direction B and to insert the unit 227D into the ground 249 and 203. Further advancement of the forming means 219 is effected by its interacting units 243 of the sections 227C and 227D and the next sections of the frame means 227 analogously to that is shown in FIGS. 22 and 23, while the controlling means 210 withdrawn the pressure fluid out of the units 242 to release the supporting members 236 and 237 of the abutment units 243 out of the compressive engagement with the side walls 248A and the bridge crane means 217 when located with its wire 217C engaged with the rods 235 and after that with the abutment units 243 is supplied with pressure fluid to pull the wire 217C into and thereby urge the rods 235 out of connection with the units 243 and after that urge the abutment units 243 out of the trench 248.

Dimensions of the wall-supporting portions 241 (see FIG. 28) are: the width—from about 50 centimeters for the frame section 227C up to about 200 centimeters for the last upper frame section and the length—about 200 to 500, preferably 400 centimeters, then the static friction forces of the portions 241 being moved apart against the walls can correspondingly reach more than about 20 tons and up to 500 tons and the sliding friction forces which impede the displacement of the members 236 and 237 and the section 227' within the hole that can be equal correspondingly from 10 tons up to 40 tons. Therefore, the rams 239 must exert correspondingly a force equal to more than 10 to 40 tons for effecting relative advancement of the members 236 and 237 to the section 227' and can exert a force equal more than about 20 to 500 tons to effect movement of the section 227' relative to the members 236 and 237 and effect advancement of the hole section.

When the forming means 219 has formed the first hole section and is supported by the hole side walls, then the bridge crane 217 with its wire 217C engaged with the forming means 219 is supplied with motive power to move the wire 217C into and thereby urge the chassis 204 forward relative to the forming means 219 along the excavation line and stop at a next hole line, then the bridge crane 217 urges and assembles by the method above described the frame sections 227A to 227C, for example, of the next in turn forming means 220 on the slip 223 so that to be supported by the slip 223 in the first working position while the directing groove section 229' of the frame section 227A is engaged forcedly with and supported by the guiding and supporting wedge-shaped cutter 228 of the adjacent from behind forming means 219 for longitudinal movement and inserted at the working position on the next hole line into the filled ground 249 and the bottom 248A of the trench 248 by the method above described up to a next predetermined depth and distance in the next hole section and in a next intended advancing direction B to excavate the ground and form a section of the next hole along the next hole line, where the direction B of the excavation diverges from the tangent of the central longitudinal axis of the next excavated section about the axis O and is determined by the guiding and supporting cutter 228 being supported with the frame means 227 of the forming means 219 by the walls of the hole formed previously. After that the directing groove portion 230A of the next frame means 227 operates to force the guiding and supporting cutter 228 and the frame means 227 of the last forming means 219, for example, relative to the walls of the last formed hole section supporting the last frame means 227 in a direction opposite of the next diverged direction B to cause the frame means 227 of the next forming means 220 to be forced toward and in the next diverged advancing direction B so to advance the next excavation section in the next diverged direction B close to the formed previously hole section up to the predetermined depth and distance and stops to allow the last previous forming means 219 be moved out of the formed hole section; then operating the activating means of the apparatus 200 to move the forming means 219 out of the formed hole section to empty the section and materials of the structure to be let into the emptied section to advance the structure 201 being formed and form, support and compress the facial structure wall 201A by the rear groove portion 229 of the motive frame means 227 of the forming means 220 (shown in FIGS. 25 and 28) by the method described above; and repeat the operations to construct alternately further sections of the paling-shaped structure 201 in closely formed hole-shaped sections of a multihole narrow excavation and up to the end of the excavation line.

The apparatus 200 and the method according to the invention that are adapted to construct the underground paling-shaped structure 201 including a wall section 201A and a stratum section 201B shown in FIG. 31A, such as a drain or impervious retain, anchoring or foundation structure disposed into a synclinal, about a hemispherical bowl (see FIG. 31A) or a conical funnel-shaped impervious wall 201B shown in FIG. 31B, where both structures are extending horizontally and vertically for surrounding a plume 250 of contamination at a contaminated material site; a turning portion of a trough-shaped structure shown in FIG. 31C, for examples, that can be formed of a predetermined depth of 15 to 100 meters and more, 25 to 100 meters being preferable, and a thickness of 0.15 to 0.50 meter, 0.20 to 0.30 meter being preferable, in the grounds that may be cut through by the wedge-shaped cutter and include mainly rounded rocks of size up to 50 centimeters, for example. The triangular-shaped hole sections of the slit excavation being formed that can have the width equal up to about 1.5 to 5.0 meters, with 2.0 to 3.0 meters being preferred. The suitable structure material or any other kind of a backfill can be let or put in place of excavated slit trench section being emptied by the forming means 219 to 221 movable in the ground 203 by the method according to the present invention.

Figure 36:
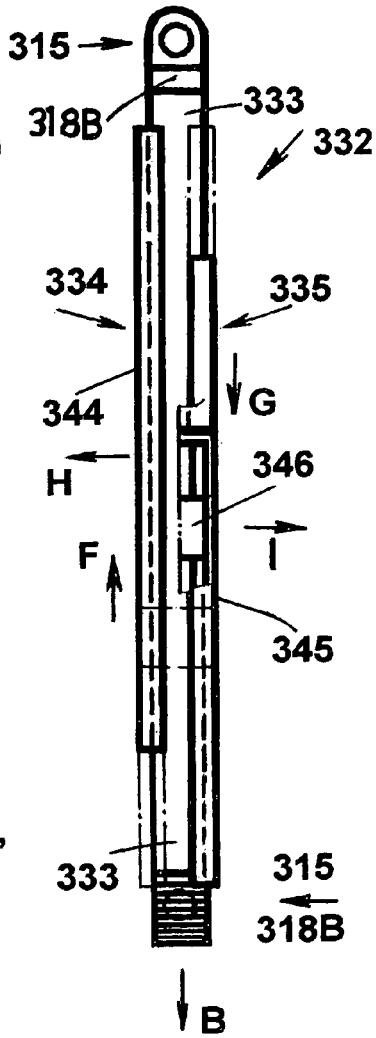
Figures 37, 38, 39, 40, 41, 42, 43, 44, 56:
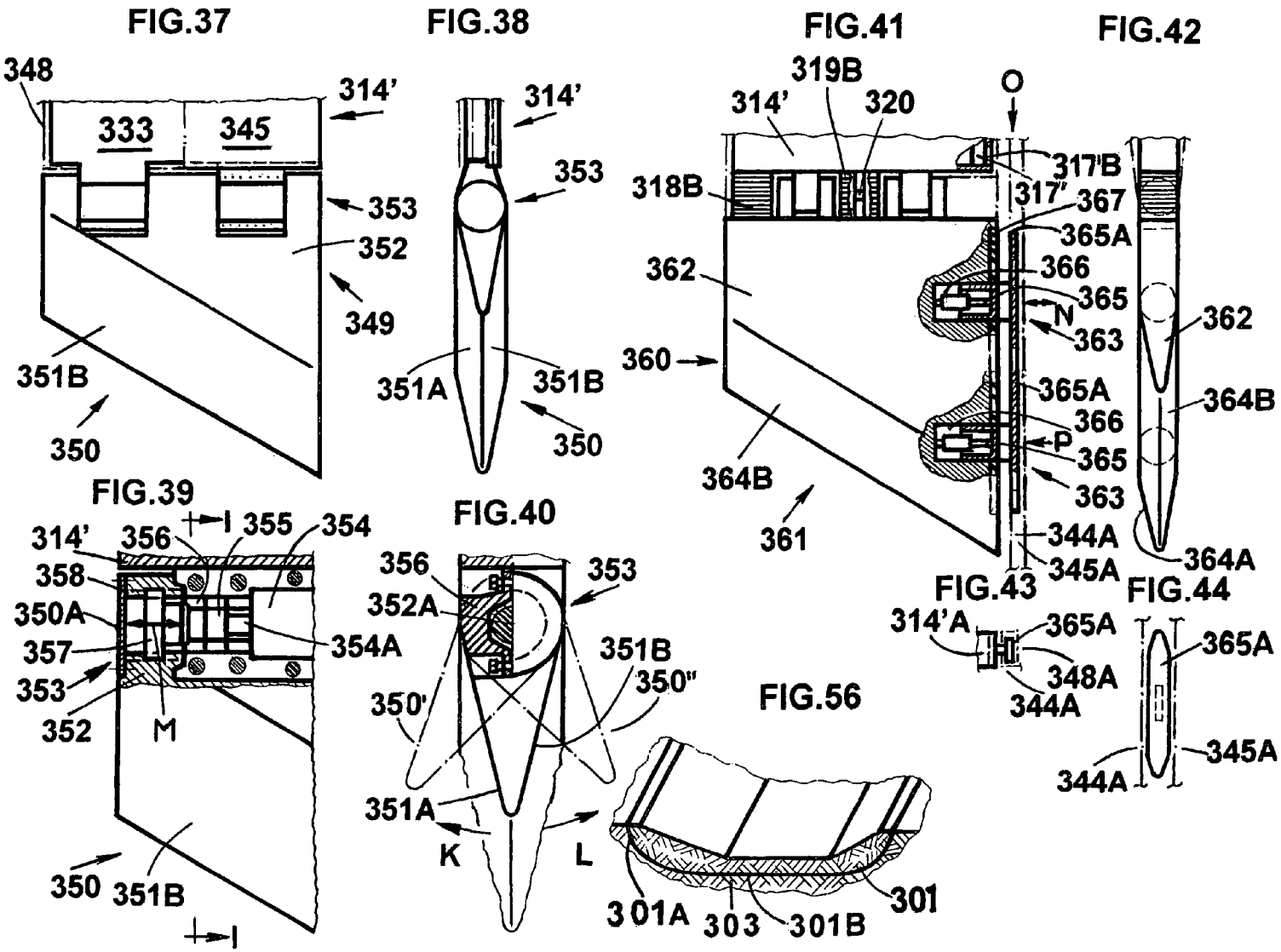
FIGS. 37 and 38 are side views of the wedge-shaped cutter embodiment 349 of the directing making means 316A in FIG. 32.
FIGS. 39 and 40 are longitudinal partial axial and cross-sectional views of the drive means 353 of the wedge-shaped cutter 349 in FIGS. 37 and 38.
FIGS. 41 and 42 are side and longitudinal partly axial cross-sectional views of the wedge-shaped cutter embodiment 360 of the guided making means 316B in FIGS. 32 and 33.
FIGS. 43 and 44 are views of the motionlessly attached embodiment 365A of the directing means 321 in FIG. 32 in directions shown by arrows O and P in FIG. 41.
FIG. 56 is a cross-sectional view illustrating schematically an underground cylindrically-shaped retain stratum and walls which the apparatus 300 in FIGS. 32 and 33 is adapted to construct below a main water channel.

In FIGS. 32 to 55 there is shown an embodiment 300 of an apparatus nor constructing an underground cylindrical trough-shaped structure 301 shown in FIG. 56 that consists an extending horizontally in a direction shown by an arrow A and vertically in a direction shown by an arrow B wall portion 301A and an extending horizontally in the directions A and B stratum portion 301B in a multihole excavation 302 (shown as a hole section 302') being formed in the ground 303. The apparatus 300 comprises a travelling chassis 304 for supporting a means for forming the structure 301 and supplying materials and power to the structure forming means (later described), the chassis 304 being movable on a ground road 305 with road wheels 306 along the length of a structure line and stoppable at intended hole lines crossing the structure line, a hydraulic control and pressure fluid pumping means 307 being driven by an engine, a known means for supplying a drilling fluid or wash liquid and air pressure to the structure forming means, withdrawing a debris material after penetration of the working end facial wall of an excavated hole section 302' being formed and supplying a structure material 301' into formed hole sections 302' (not shown), an operator cabin 308 provided with a means for remote controlling operations of the apparatus 300, a guiding and supporting framework 309 (later described) mounted on the chassis 304 and comprising a carrier member 310 for forcedly engaging underground-movable and cylindrically-shaped structure sections-forming means 311, 312 and 313 shown in FIGS. 32 and 33, where the forming means 311 is shown when it moves out of the formed hole section 302' in a hole section-emptying direction shown by an arrow C in FIG. 32 and adapted to construct directionally a first or initial hole section 302' of the excavation 302, the forming means 312 is shown when it being motionless in a next formed hole 302' and the forming means 313 is shown when it inserts into the ground 303 and they are adapted to construct alternately adjacent closely sections (shown as 301') of the structure 301.

Each of the forming means 311 to 313 comprises an elongate, articulated preferably like a flat link chain and displaceable longitudinally in the directions B and C motive means 314 for supporting components and transmission the materials and power to the components of the forming means 311 to 313. The motive means 314 is extensible by connecting shortened motive flat frame links 314' each of which takes the form of a rectangular prismatic box-like structure (later described) in consecutive order, relative to the advancing direction B and in end-to-end relationship with a known quick-assembled hinge means 315 for movement about axes of the hinge means 315 preferably within the central longitudinal surfaces of the adjacent links 314' and perpendicular to the direction B with the ability to interact with opposite walls 302'A and 302'B, such as the bottom and the roof of the excavated hole section 302' being formed, occupied and then emptied to urge the frame links 314' in a lateral direction crossing the central longitudinal surface of the excavated section 302' toward the intended advancing direction B in the formation of the section 302' by the forming means 313 and toward the intended returning direction C in the emptying of the hole section 302' formed previously by the forming means 311 and to immobilise the stopped links 314' of the forming means 312, for example, relative to the walls 302'A and 302'B supporting the links 314' to form a supporting and guiding abutment means for supporting and guiding the forming means 313 when which inserts into the ground 303 and forms a next hole section 302', for supporting and guiding the forming means 311 which empties the hole section 302' formed previously, for forming and supporting the working facial wall 301A of the structure 301 to form the structure 301 and for supporting and guiding the chassis 304 for advancement.

Each of the links 314' has side portions 314'A and 314'B (later described) for forcing the walls 302'A and 302'B in the crossing direction, where the portions 314'A and 314'B are operated by an activating means (later described) of the respective associated forming means 311 to 313 to move the links 314' in about the axes of the hinges 315 in order to move the links 314' along the length of the hole section 302' and to immobilise the links 314' relative to the walls 302'A and 302'B in order to immobilise the motive means 314, a forward oriented portion 314'C (later described) for supporting and guiding a next in turn front forming means, such as the forming means 313, that is operated by the activating means of the forming means 312 and 313, a rearward oriented portion 314'D (later described) for supporting and guiding a rear forming means, such as the forming means 311, that is operated by the activating means of the forming means 311 and 312, and for forming and supporting the structure facial wall 301A, that is operated by the activating means of the forming means 312.

A means 316A for making direction-controlly excavated hole sections 302' to excavate the ground 303 and form the first or initial hole sections 302' in the intended curvilinear advancing directions B along the first or initial hole section lines ahead of the motive means 314 of the forming means 311, the directing and making means 316A performs both a ground-cutting function and a hole-directing function and takes the form of later described wedge-shaped cutters which are shown in FIGS. 32, 33, 37 to 40 and 53 to 55 and end-and-face mill cutters which are shown in FIGS. 45, 46, 49A to 49C and 50 to 52C. The directing and making means 316A is able to force the front motive link 314' from its position toward the intended advancing direction B and control the direction B of the advancement of the first or initial hole section 302' and comprises excavation-directing and making members, such as the wedge-shaped cutter 316A shown in FIGS. 32 and 33, where each of the members is capable of being forced into interaction with the working end facial wall of the excavated section 302' being formed to urge the forming means 311 in a direction crossing the central longitudinal axis of the excavated section 302' toward the intended advancing direction B and has a hole-directing and making portion for forcing the facial wall in the crossing direction that has the ability to control the force and direction of deformation of the facial wall and is operable to move the forming means 311, with the directing and making member, relative to the facial wall being forced toward the direction B by an activating means (later described) capable of forcing the portions against the wall.

The above-mentioned cutters have the ability to be replaced and substituted with the aid of the framework 309 accordingly to the mechanical characteristics of the ground 303 located along the length of the hole line.

Each of the links 314' comprises a number of transmission conduits 317', 318' and 319' (later described and not shown in FIGS. 32 and 33) extending from the upper end into and through each of the links 314' for transmission the materials, power and signals and having a respective associated, aside and longitudinally oriented, inlet and outlet, quick-acting, connecting and coupling means 317'A, 318'A and 319'A which are armoured and flexible about the respective associated hinge 315. The connecting and coupling means 317'A is provided with known socket and check valves, where the inlet means 317'A is able to be temporarily connected by the length of pipes (not shown) to the means for supplying the drilling fluid and compressed air, to a known means for cleaning the drilling mud from the debris material and for supplying the structure material 301'. The connecting and coupling means 318'A is able to be temporarily connected by the length of pipes (not shown) to the pumping means 307. The connecting and coupling means 319'A is able to be connected by the length of electrical cables (not shown) to the remote controlling means at the cabin 308. The conduits 317' of the front link 314' of each of the forming means 311 to 313 that have branched preferably lower ends 317'B opening at the front link 314' and at the mill making means 316A and 316B (later described).

The directing forming means 311 has a means 320 for measuring angles of relative diverging between the central longitudinal planes of the directing means 316A and the adjacent link 314' (later described).

Figure 33:
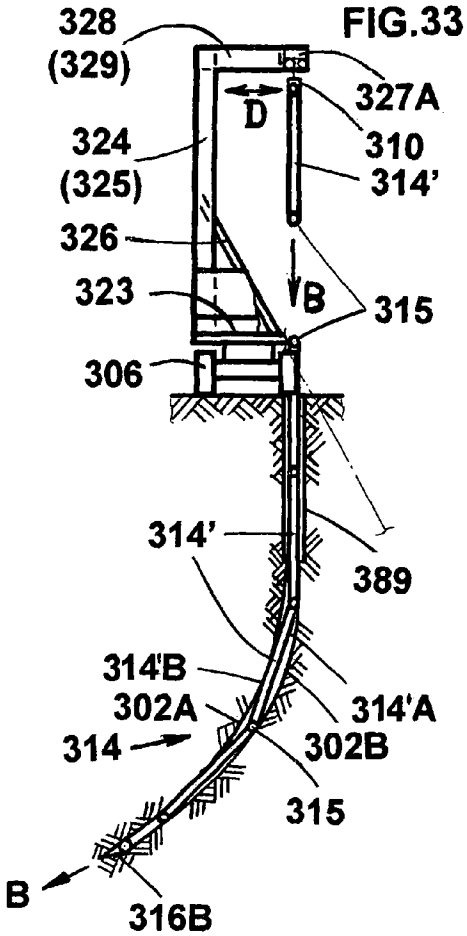
FIGS. 32 and 33 are side and front views of the preferred embodiment 300 of an apparatus for constructing an underground cylindrically- and paling-shaped and narrow horizontally and vertically extending structure in a multihole excavation being formed in the ground according to the invention.

Each of the portions 314'C forms a means 321 (later described) for supporting and guiding the next in turn guided forming means 312, for instance, and is able to force the motive means 314 of the forming means 312 from its position toward the intended diverged advancing direction B' in FIG. 33 and control the direction B of the advancement of the next hole section 302'.

The portions 314'D of several of the links 314', preferably the front link 314' of each of the guided forming means 312 and 313 that comprise a longitudinally in the direction B displaceable means 322 for directing next excavated hole sections 302' being formed (later described) that is able to force the links 314' of the forming means 313, for example, being inserted into the ground 303 from its position toward the intended diverged advancing direction B' and control the direction B of the advancement of the next hole section 302' along the length of the next hole section line close and relative to the adjacent formed hole section 302'.

Each of the forming means 312 and 313 comprises a means 316B for making guidedly excavated hole sections 302' to excavate the ground 303 and form further adjacent and copied hole sections 302' ahead of the motive means 314 of the forming means 312 and 313, the directed or guided making means 316B performs both the cutting and a being guided function and takes the form of later described wedge-shaped cutter which is shown in FIGS. 32, 33, 41 to 44 and end-and-face mill cutters which are shown in FIGS. 45 to 48, 50 and 51.

The motive means 314 of the forming means 312, for instance, that is able to be supported by the walls 302'A and 302'B of the formed hole 302' and perform when it is the supporting and guiding abutment means three functions of forcing the motive means 314 of the forming means 313 from its position toward the intended advancing direction B and control the direction B of the advancement of the front hole section 302', forcing the forming means 311 from its position toward the intended returning direction C and control the direction C of the emptying of the rear hole 302' formed previously, forming and supporting the facial wall 301A of the structure 301.

Each of the links 314' of the forming means 312 that is capable of being forced into interaction with the walls 302'A and 302'B of the formed hole 302' that are supporting the link 314' with its portions 314'A and 314'B to urge, firstly, with its portion 314'C the motive means 314 of the forming means 313 which inserts into the ground 303 and forms the front hole section 302' in a direction crossing the central longitudinal axis of the excavated section of the front hole 302' being formed toward the direction B', where the portion 314'C and the portions 314'D of the forming means 313 that are operable to move the forming means 311, with its links 314', relative to the links 314' of the forming means 312 toward the direction B' by the activating means capable of forcing the portions 314'D against the portions 314'C and via the portions 314'A and 314'B against the formed walls 302'A and 302'B; secondly, with its portion 314'D the motive means 314 of the forming means 311 being moved in the direction C out of the hole 302' formed previously in a direction crossing the central longitudinal axis of the emptied section 302' toward the direction C for forcing the motive means 314 of the forming means 311 in the crossing direction, where the portions 314'D of the forming means 312 and the portions 314'A of the forming means 311 that are operable to move the forming means 311, with its links 314', relative to the links 314' of the forming means 312 toward the direction C by the activating means capable of forcing the portions 314'A against the portions 314'D and via the portions 314'A and 314'B against the formed walls 302'A and 302'B; thirdly, to form and support the structure facial wall 301A.

Figure 32:
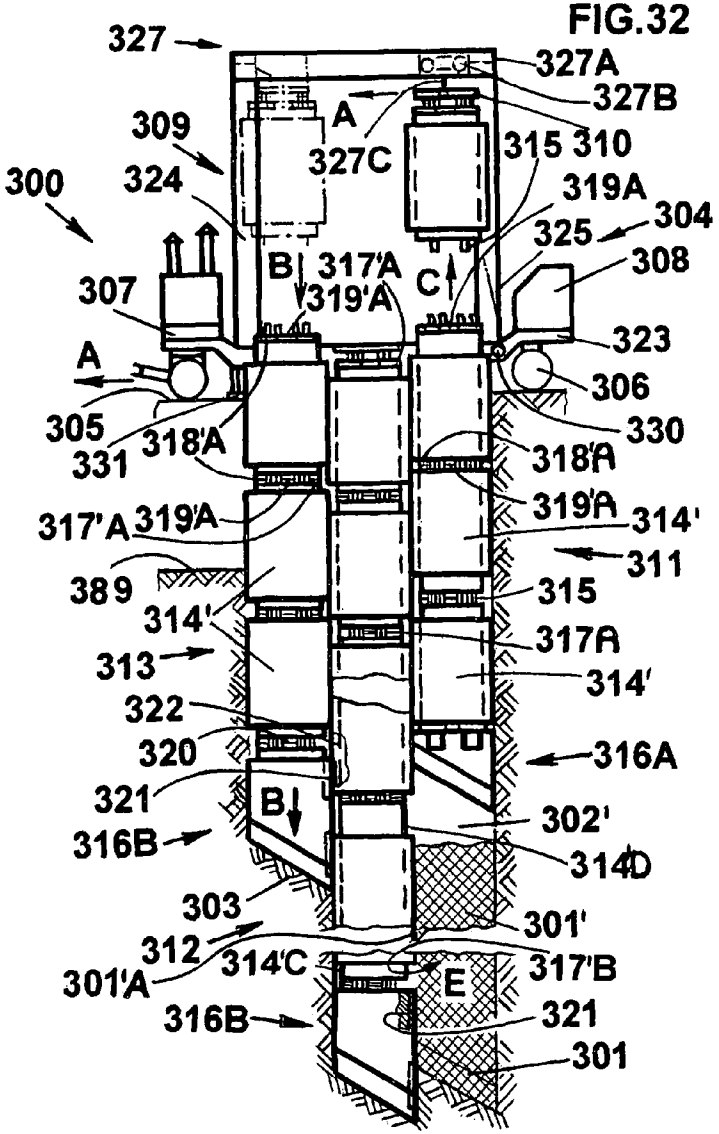

The framework 309 consists of ⌈-shaped preferably pier columns 324 and 325 supported by a frame 323 of the chassis 304, a supporting and guiding slip 326 for assembling and disassembling, supporting and guiding the forming means 311 to 313, a bridge crane 327 provided with a bridge beam 327A supported on rolls and rails by corbels 328 and 329 of Π-shaped preferably cross-section of the columns 324 and 325 for movement in transversal direction shown by arrows D in FIG. 32 along the length of the corbels 328 and 329 that effecting by a drive means (not shown) comprising, for example, a means for providing motive power and having screw shafts each of which is supported rotationally by the corbels 328 and 329 and threadedly engaged with a nut supported rotationally by the end of the bridge beam 327A, a hoisting winch 327B supported by the bridge beam 327A for movement along the length of the beam 327A and serving with its wire 327C for assembling the links 314' of the forming means 313, for example, being inserted into the ground 303, for disassembling the links 314' of the forming means 311, for example, being withdrawn out of the formed excavation section, for displacement of the spare links 314' forward in the direction A and for advancement of the chassis 304 from its position in the direction A into a next working position by the aid of the carrier member 310 which is forced into engagement by the lock means 315 with each of the links 314', a guide pulley 330 supported rotationally by the frame 323 for the wire 327C when it is connected to a located above the level of the ground road 305 end portion of the upper link 314' of the forming means 312, for example, being motionless in the formed hole section 302' and supported by the walls 302'A and 302'B of the section 302' and serving as the abutment for advancing the chassis 304, a number of outrigger supports 331 connected to the frame 323 between the ground road 305.

The winch 327B when engaged with its wire 327C with a next in turn upper link 314' of the forming means 311 being withdrawn out of the formed section in the direction C in FIG. 32 is supplied with motive power to pull the wire 327C into and thereby urge upwardly the upper link 314' which could be disassembled with the hinge means 315 and the connecting means 317A to 319A from the adjacent from below link 314' and then be advanced in the direction A in FIG. 32 and assembled with the hinge means 315 and the connecting means 317A to 319A into the forming means 313 being inserted into the ground 303 in the direction B in FIGS. 32 and 33. Simultaneously the structure material 301' can be let through the opening 317CA as it shown by an arrow E in FIG. 32 and then the wire 327C is connected to the upper unit 314' of the forming means 312 by the carrier member 310 and the winch 327B when located with its wire 327C engaged with forming means 312 is supplied with motive power to pull into the wire 327C and thereby urge the frame 323 with the guide pulley 330 forward in the direction A relative to the forming means 312 so that the chassis 304 advances a step and complete the construction of that structure section. The operations of inserting the forming means 313 and withdrawing the forming means 311, for example, in this way are carried out as part of an overall sequence involving the advancement of the apparatus 300.

The directing means 322 has excavation-directing members (later described and not shown in FIGS. 32 and 33) each of which is capable of being forced into interaction with walls 302'A and 302'B of a hole 302' formed previously with the aid of the guiding and supporting means 321 of the links 314' of the directing forming means 311 or a directing forming means which is substantially similar to the forming means 312, for example, being in the formed hole 302' and supported by its walls 302'A and 302'B to urge the guided forming means 313 being advanced in the crossing direction and has hole-directing portions (later described) for forcing guiding and supporting portions (later described) of the guiding and supporting means 321 of the directing and forming means 311 or 312 in the crossing direction. The guiding and supporting portions are operable to move the guided forming means 311 or 312, with the directing means 322, to the walls 302'A and 302'B being forced toward the advancing direction B by the activating means (later described) capable of forcing the directing portions against the supporting and guiding portions and the walls 302'A and 302'B of the formed hole 302'.

Figure 34:
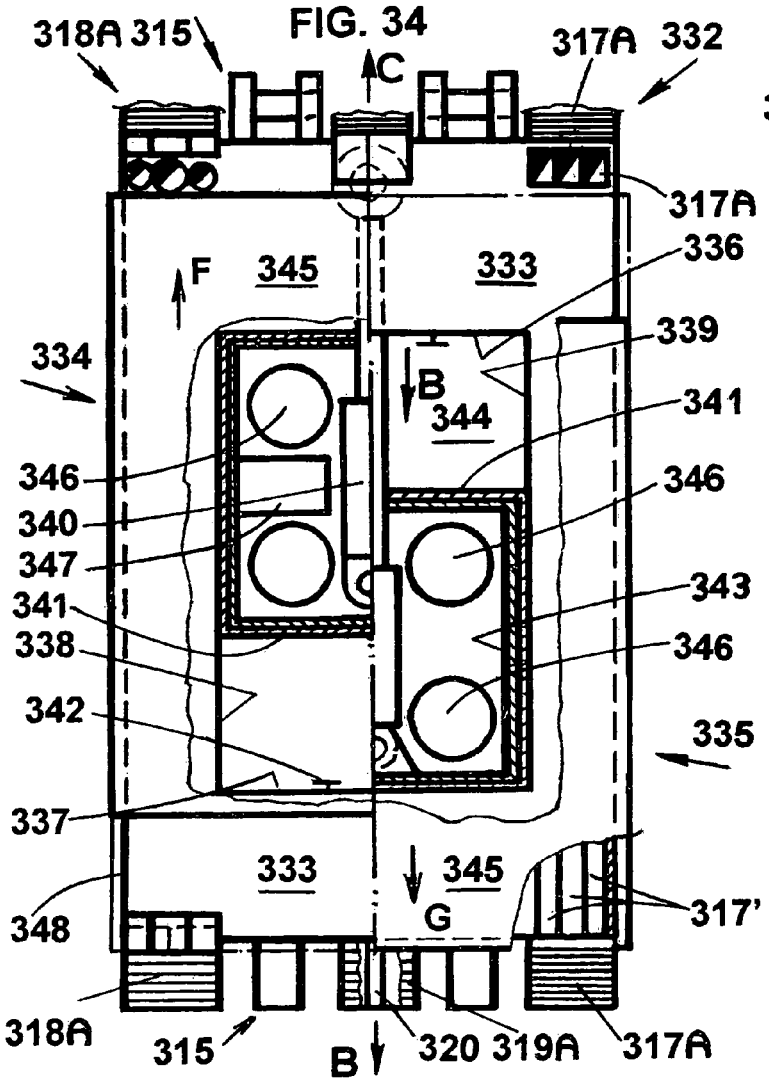
FIGS. 34, 35 and 36 are side, upper and front views of the urging motive link 314' in FIG. 32.
Figure 35:
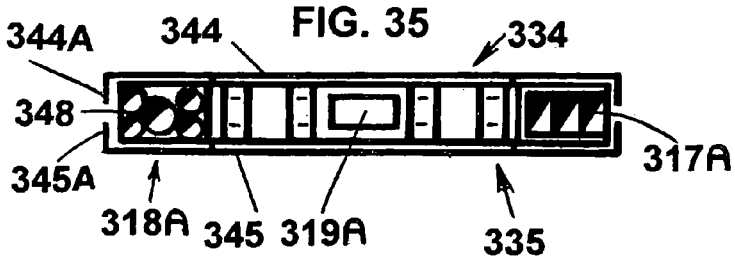

In FIGS. 34 to 36 there is shown an embodiment 332 of one of the same preferably urging motive frame links 314' of the forming means 311, for example. The link 314' has a motive frame 333 for supporting and guiding components of the link 314' that is provided with a number of known connecting members, such as conform forks, lugs and pins, of the hinge means 315, the transmission conduits 317', 318' and 319' (not shown) extending in and along the length of the frame 333 and having the end flexible connecting means 317'A, 318'A and 319'A, the measuring means 320 which has a steel flexible beam 320A with its ends being fixed to the adjacent frames 333 and a set of known strain meters (not shown) which are connected together by wires into a known electrical bridge circuit and to the controlling means 308 by the length of a cable (not shown), an embodiment of the wall-supporting portions 314'B and 314'C in FIG. 33 that is adapted for guiding and supporting the frame 333 for longitudinal displacement in the advancing direction B and the emptying direction C in FIGS. 32 and 33 and immobilising relative to the walls 302'A and 302'B and comprises wall-supporting members 334 and 335 supported for displacement in their longitudinal directions shown by arrows F and G in FIG. 34 between transversal walls 336 and 337 and along the length of longitudinal walls 338 and 339 of the frame 333 and about the axes of the hinge means 315 and axes (not shown) of curvature of an excavated hole section 302' and to force or shift the members 334 and 335 there is provided a double-acting hydraulic ram 340 which is pivotably connected with its ends and via a linkage or bracket to the frame 333 and a box frame 341 for supporting and guiding the members 334 and 335 for movement in the directions F and G and transversal directions shown by arrows H and I in FIG. 36. The walls 336 and 337 are provided with known electrical end switch means 342 which can signal about end positions of the box frame 341 and are connected to the remote controlling means 308 by the length of a cable (not shown).

Each of the members 334 and 335 has a main frame portion 343 which is supported and guided by the box frame 341 for relative movement and a respective associated side wall-supporting portion 344 and 345 reciprocatingly movable in the directions H and I. To outwardly force or move the members 334 and 335 in the directions H and I there are provided a plurality of interacting power hydraulic cylinder and piston units 346 which are located between the portions 344 and 345 and connected pivotally via known step-bearings to the respective associated portion 344 and 345 and hydraulically to the ram 340 by the lengths of pipes and a known suitable remote controlling means 347 provided with electromagnetic distribution valves. During the known excavating and emptying operations, the members 334 and 335 are stopped, then expanded and outwardly forced into compressive frictional engagement with the walls 302'A and 302'B being supported by the members 334 and 345 and thereby immobilised relative to the walls 302'A and 302'B and thus serve to anchor the frame box 341 which thereby effectively acts as an abutment for the ram 340 which is operated. After that the members 334 and 335 are narrowed, forced inwardly out of the compressive engagement with and released from the walls 302'A and 302'B, then advanced, deform the around 303 and form the cylindrically-shaped walls 302'A and 302'B, and urge the links 314' about the axes of the hinges 315. An intended number of the urging links 314' can provide longitudinal movement of the forming means 311 to 313. The urged motive frame links 314' being without the rams 340 and units 346. The portions 344 and 345 have ⌈-shaped cross-section and are provided with L-shaped edge stiffeners 344A and 345A. The guiding and supporting means 321 shown in FIG. 31 that is substantially similar in construction to an aisle formed and extending along the length and between by the stiffeners 344A and 345A and a front end, relative to the direction A, wall 348 of the frame 333.

In FIGS. 37, 38 and 40 there is shown a two-sided wedge-shaped cutter embodiment 349 of the directing and making means 316A for using in the hover or loose or sandy or clayey ground that includes rocks of diameter equal up to about 50 centimeter, for instance, that comprises a wedge-shaped cutter 350 which has forward oriented, relative to the advancing direction B, wedge-shaping cutting portions 351A and 351B disposed at the angle of sharpness that is equal to about 45°-60° and the angle of cutting equal to about 45° to 75°, 60° being preferred and which vertex is located at a rear end wall of the cutter 350 relative to the direction A and a motive tail frame link 352 supported by the link 314' for movement about an axis 352A on the central longitudinal surfaces of the cutter 350 and the front link 314' and preferably perpendicular to the advancing direction B in directions shown by arrows K and L in FIG. 39 through an arc of about 60°, for instance, a set of co-axial drive means 353 (see FIGS. 38 and 39) which are located between the cutter 350 and the link 314' within the section being excavated and comprise a means for providing motive power, such as a hydraulic power cylinder and two piston rods unit 354 which has two longitudinally displaceable in directions shown by arrows M in FIG. 38 opposite output piston rods 354A (the second rod 354A is not shown) that are disposed co-axially with the axis 352A and two interacting drive and turning screw-and-nut mechanisms each of which includes a cross-head 355 with longitudinally splined bearing portions leaning on correspondingly splined bearing portions of the support member 356 for axial longitudinal displacement and engaging screw-shaped portions 357 which interact with corresponding engaged screw nut-shaped portions 358 of the cutter 350. The unit 354 when located with its rods 354A engaged with the drive means 353 is supplied with pressure fluid to move and thereby urge axially the screw portions 357 relatively to the screw nut portions 358 to move the nut portions 358 together with the cutter 350 about the axis 352A relatively to the link 314'.

The moved aside in the direction K or L cutter 350 is capable of being forced into interaction with the working end facial wall of the hole section being formed to urge the front link 314' located remotely from the adjacent following hinge 315 about the following hinge 315 in a direction crossing the central longitudinal axis of the excavated section 302' from the diverged advancing direction B' correspondingly aside and has the ability to control the direction B of the section 302'.

The portions 351A and 351B for forcing the facial wall in the crossing direction that are operable to move the forming means 311, with the cutter 350, relative to the wall being forced toward the direction by the rams 340 capable of forcing the portions 351A and 351B against the wall and have the ability to control the force and direction of deformation of the wall of the excavated section 302' being formed by the aid of the remotely controlling means 307. The force of deformation is controlled by the aid of the rams 340 and units 346 of the urging links 314'. The directions K and L and a rate of an angle of deflection of the cutter 350 that are depended on a length of a working stroke of the piston rods 354A and sizes of the screw and nut portions 357 and 358 and equal up to about 30° leftward and rightward, controlled by the controlling means 307 by the aid of measuring of a volume of pressure fluid with that the unit 354 which is like a selsyn is supplied for movement and are determined accordingly to the intended curvilinear direction B of advancement of the first or initial hole of the excavation 302. The unit 354 can be blocked in known manner and immobilise the cutter member 350 relative to the front link 314' with the drive means 353.

In FIGS. 41 to 44 there are shown a wedge-shaped cutter embodiment 360 of the guided making means 316B that comprises a wedge-shaped cutter 361 supported securely by a motive tail frame link 362 which is connected to the following front link 314' by the hinge 315, connecting means 318A and 319A and diverging angle-measuring means 320, and two the same preferably embodiments 363 of the directing means 321 (shown in FIG. 32). The cutter 361 has forward oriented, relative to the advancing direction B, wedge-shaping cutting portions 364A and 364B which are disposed at the angle of sharpness that is equal to about 45° to 60° and angle of cutting which is equal to about 45° to 75°, 60° being preferred and which vertex is located at a rear, relative to the direction A in FIG. 32, end wall of the cutter 361. Each of the directing means 363 has a directing member 365 which is supported and guided by the frame link 362 for movement in axial directions shown by arrows N in FIG. 41 and has an excavation-directing portion 365A for forcing the walls 302'A and 302'B of the adjacent from behind formed hole section 302' in the crossing directions and an activating and drive means, such as a hydraulic double-acting piston and cylinder unit 366 for effecting relative movement between the directing member 365 and the frame link 362 from an operative position for interacting with the guiding and supporting stiffeners 344A and 345A and the wall 348 into an inoperative position (not shown) in a pocket or recess 367 provided in the link 362 for accommodating the directing portion 365A in the inoperative position and filled up with an elastic material, such as a soft rubber which is compressed by the portion 365A that in its inoperative position can thus lie adjacent the inner face of the link 314' within the recess 367. In FIGS. 43 and 44 there are shown the 0- and T-shaped directing portion 365A as it is viewed in directions shown by arrows O and P in FIG. 41 where it is shown also the conduit section 317' and the opening 317'B.

Each of the members 365 is capable of being forced into interaction with the side walls 302'A and 302'B of the adjacent from behind formed hole section 302' to urge the respective associated forming means 312 or 313 in a direction crossing the central longitudinal axis of the excavated section toward the intended diverged advancing direction B' and control the direction B of the excavated section 302'.

Each of the portions 365A is being engageable with the guiding and supporting stiffeners 344A and 345A and end wall 348 (represented by chain-dotted lines) of links 314' of the adjacent from behind and respective associated directing forming means 311 or 312 and operable to move the forming means 312 or 313, with the member 365, relative to the walls 302'A and 302'B supporting the links 314' and being forced by the links 314' of the forming means 311 or 312 toward the advancing direction by the rams 340 capable of forcing the portions 365A against the walls 302'A and 302'B via the stiffeners 344A and 345A, end wall 348 and side portions 314'B and 314'C that are substantially similar in construction to the side wall-supporting portions 344 and 345 of the side wall-supporting members 334 and 335 in FIGS. 34 to 36. The portions 365A have the ability to control the force and direction of deformation of the side walls 302'A and 302'B of the adjacent formed hole 302' by the aid of the rams 340 and units 346 of the urging links 314' and the remote controlling means 307.

In FIGS. 45 to 49C there is shown an end-and-face mill cutter embodiment 368 of the directing making means 316A and the guided making means 316B that is partly and substantially similar in construction and using to the embodiment 103 of the making means 16 (above described and shown in FIGS. 15 and 16) but differs from the embodiment 103 with the hinge 315, a motive frame link 369 for supporting components of the mill cutter 368, a guiding, supporting and reciprocating T-shaped frame 370 for supporting the same preferably barrels for reversible power rotation, where each of the barrels is provided with a number of known double- or reversible-acting and outwardly oriented cutter bits (not shown) arranged on the face shells and the outer ends of the barrel to form reversible end-and-face mill barrels 371A, 371B, 371C, 371D and each group of two mill barrels 371A and 371B, and 371C and 371D is supported on the same preferably respective associated co-axial reversible shafts 372 and 373, a known activating, hydraulic preferably motor having an output shaft and being assembled and connected with a reversible drive means 374 remotely controlling by the controlling means 307 for effecting the relative movement with the shafts 372 and 373 between the mill barrels 371A to 371D and the frame 370.

Each of the mill barrels 371A to 371D of the directing mill cutter 368 that is capable of being forced into interaction with the facial wall of the hole section 302' being formed to urge the front link 314' located remotely from the adjacent following hinge 315 about the following hinge 315 in a direction crossing the central longitudinal axis of the excavated section 302' from the direction B' correspondingly aside and has the ability to control the direction B of the excavated section b.

The cutter bits of the directing mill cutter 368 that are adapted for forcing the facial wall in the crossing direction from the direction B' and are operable to move the forming means 311, with the mill barrels 371A to 371D, relative to the facial wall being forced toward the direction B' by the rams 340 and the activating and drive means 374 capable of forcing the bits against the facial wall and have the ability to control the force and direction of deformation of the facial wall of the excavated section 302' being formed. The direction of deformation is controlled with the direction of rotation of the mill barrels 371A to 371D that is shown by arrows T and V in FIGS. 49A to 49C by the activating and drive means 374, the force of deformation is controlled by the rams 340 and units 346 of the urging links 314' that are shown in FIGS. 34 to 36.

Figures 45, 46, 47, 48, 49A, 49B, 49C, 50, 51, 52A, 52B, 52C:
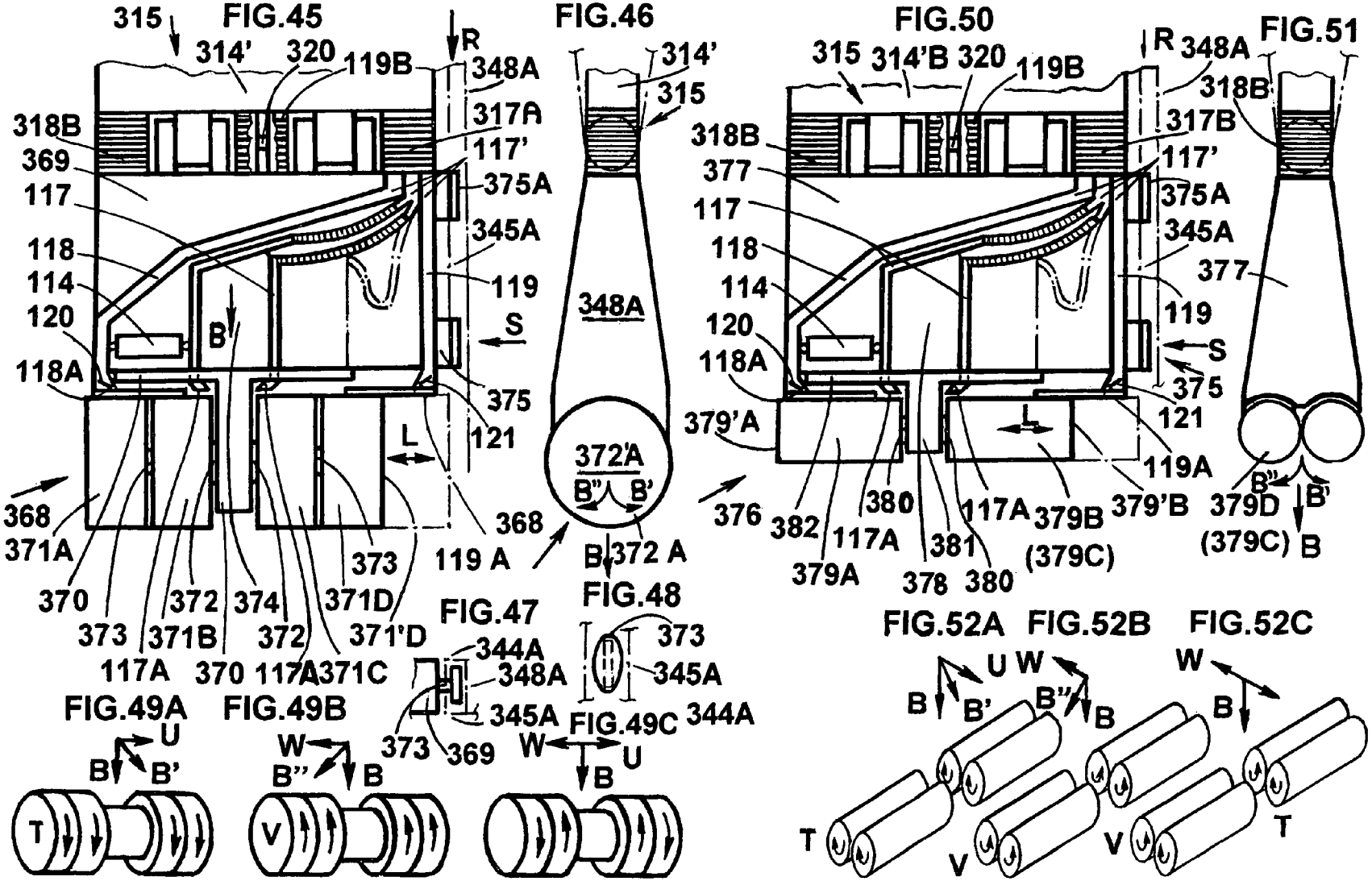
FIGS. 45 and 46 are side views of the preferred one-rowed and end-and-face mill cutter embodiment 368 of the directing making means 316A and guided making means 316B provided with the motionlessly attached embodiment 373 of the directing means 321 in FIG. 32 according to the invention.
FIGS. 47 and 48 are views of the directing member 373 in directions shown by arrows R and S in FIG. 45.
FIGS. 49A, 49B and 49C are views illustrating by arrows T and V directions of the turning movement of the mill barrels 372A to 372D, by arrows U and W directions of forcing the frame member 371 and by arrows B, B' and B" directions of the advancement of the mill cutter embodiment 368 in FIGS. 45 and 46.
FIGS. 50 and 51 are side views of the preferred two-rowed and end-and-face mill cutter embodiment 376 of the directing making means 316A and guided making means 316B in FIG. 32 that is provided with the directing members 373 according to the invention.
FIGS. 52A, 52B and 52C are views illustrating by the arrows T and V the directions of the turning movement of the mill barrels 379A to 379D, by the arrows U and W the directions of forcing the frame member 381 and by the arrows B, B' and B" the directions of the advancement of the mill cutter embodiment 376 in FIGS. 50 and 51.

In excavating a hole section 302', the directing mill cutter 368 operates similarly to the mill cutter 130 (above described) but moreover, when the rams 340 urges the cutter 368 with the motive means 314 in the advancing direction B (see FIGS. 49A to 49C) and the drive means 374 when engaged with the mill barrels 371A to 371D is supplied with motive power to rotate and thereby urge the all cutter bits in a tangential direction shown by an arrow T in FIG. 49A and crossing the central longitudinal axis of the excavated hole section 302' from the direction B', so that the mill barrels 371A to 371D force the facial wall of the hole section 302' being formed in the direction T and urges the frame link 369 with the frame 370 in the opposite direction shown by an arrow U in FIG. 49A that crossing the longitudinal axis of the excavated hole section 302' remotely from the hinge 315 and toward the direction B', controls the force and direction of deformation of the facial hole wall and moves the directing forming means 311, with the mill barrels 371A to 371D, relative to the facial wall being forced in the direction U toward the direction B'.

When the drive means 374 is supplied with motive power to rotate and thereby urge the cutter bits in directions shown by arrows V in FIG. 49B so that the cutter 368 urges the frame link 369 with the frame 370 about the hinge 315 in the opposite direction shown by an arrow W in FIG. 48B toward an intended diverged advancing direction B" and move the forming means 311, with the cutter 368, relative to the facial hole wall being forced in the direction W toward the direction B".

When the drive means 374 is supplied with motive power to rotate and thereby urge the cutter bits of the mill barrels 371A and 371B, 371C and 371D in opposite directions shown by the arrows T and V in FIG. 49C to force the facial hole wall in the opposite directions T and V so that the cutter 368 urges the frame link 369 with the frame 370 in the opposite directions U and W and therefore the forming means 311 moves with the frame 370 in the direct direction B (the arrows B', B", U and W in FIGS. 49A to 49C are not respective exactly to the real directions of movement).

The guided embodiment of the mill cutter 368 comprises the same preferably hole-directing members 375 each of which is secured on the front and rear, relative to the advancing direction B, ends of the portion 314'D which is substantially similar to a rear, relative to the advancing direction shown by the arrow A in FIG. 32, end wall of the frame link 369 and has T-shaped cross-section and a backward oriented, relative to the direction A, 0-shaped directing portion 375A for forcing the side walls 302'A and 302'B of the adjacent from behind formed hole section 302'.

Each of the directing members 375 is capable of being forced into interaction with the walls 302A and 302B of the adjacent from behind formed hole section 302' to urge the forming means 312 or 313 in a direction crossing the tangent of the central longitudinal axis of the excavated section toward the intended advancing direction B' by the aid of movable engagement with the directing and supporting means 321 in FIG. 32 which is substantially similar to the stiffeners 344A and 345A and the end wall 348 of the adjacent from behind directing and forming means 311 or a next in turn directing and forming means which is substantially similar to the forming means 312 and represented by chain-dotted lines in FIGS. 45, 47 and 48.

Each of the directing portions 375A is being engageable with the guiding and supporting stiffeners 344A and 345A and end wall 348 (represented by chain-dotted lines) of the links 314' of the adjacent from behind and respective associated directing forming means 311 or 312 and operable to move the forming means 312 or 313, with the member 365, relative to the walls 302'A and 302'B supporting the links 314' and being forced by the links 314' of the forming means 311 or 312 toward the advancing direction by the rams 340 capable of forcing the portions 365A against the walls 302'A and 302'B via the stiffeners 344A and 345A, end wall 348 and side portions 314'B and 314'C that are substantially similar in construction to the side wall-supporting portions 344 and 345 of the side wall-supporting members 334 and 335 in FIGS. 34 to 36. The portions 365A have the ability to control the force and direction of deformation of the side walls 302'A and 302'B of the adjacent formed hole 302' by the aid of the rams 340 and units 346 of the urging links 314' and the remote controlling means 307.

In FIGS. 50 to 52C there is shown a second end-and-face mill cutter embodiment 376 of the directing making means 316A and guided making means 316B that is partly and substantially similar to the above-described end-and-face mill cutter 16D (shown in FIGS. 20 and 21) but differs from the mill cutter 16D with the hinge 315, a motive frame link 377 for supporting components of the cutter 376, an activating and reversible drive means 378, the same preferably barrels each of which is provided with outwardly and radial oriented double-acting or reversible cutting portions or bits (not shown) arranged on the end faces and shells of each barrel to form end- and face mill barrels 379A, 379B, 379C, 379D each of which is supported with the same preferably shaft 380 by a frame 381 for power reversible rotation.

In excavating a hole section 302', the directing cutter 376 operates similarly to the cutters 103 and 16D described above and works like a deep-well displacement or piston pump and also as the cutter 368. When the rams 340 urges the cutter 376 with the motive means 314 in the direction B (see FIG. 52A) and the drive means 378 when engaged with the mill barrels 379A to 379D is supplied with motive power to rotate and thereby urge the cutter bits in the tangential direction shown by the arrow T and crossing the central longitudinal axis of the excavated hole section 302' from the direction B' so that the cutter 376 forces the facial wall of the section being formed in the direction T and urges the frame link 377 with the frame 381 in the opposite direction shown by the arrow U and crossing the central longitudinal axis of the excavated section 302' toward the direction B', controls the force and direction of deformation of the facial wall and moves the directing forming means 311, with the cutter 376, to the facial wall being forced in the direction T toward the direction B'.

Similarly, when the drive means 378 is supplied with motive power to rotate and thereby urge the cutter bits in directions shown by arrows V in FIG. 52B so that the cutter 376 urges the frame link 377 with the frame 381 in the opposite direction shown by an arrow W in FIG. 52B toward an intended diverged advancing direction B" and move the frame link 377, with the mill barrels 379A to 379D, relative to the facial wall being forced about the hinge 315 in the direction W toward the direction B".

When the drive means 378 is supplied with motive power to rotate and thereby urge the cutter bits of the cutters 379A and 379B, 379C and 379D in opposite directions shown by the arrows T and V in FIG. 52C to force the facial wall in the opposite directions T and V so that the cutter 376 urges the frame link 377 with the frame 381 in the opposite directions U and W and therefore the forming means 311 moves with the cutter 376 in the direct direction B.

The guided embodiment of the mill cutter 376 comprises the same preferably hole-directing members 375 which are described above and secured on the front and rear ends of the end wall of the frame link 377.

Figure 53:
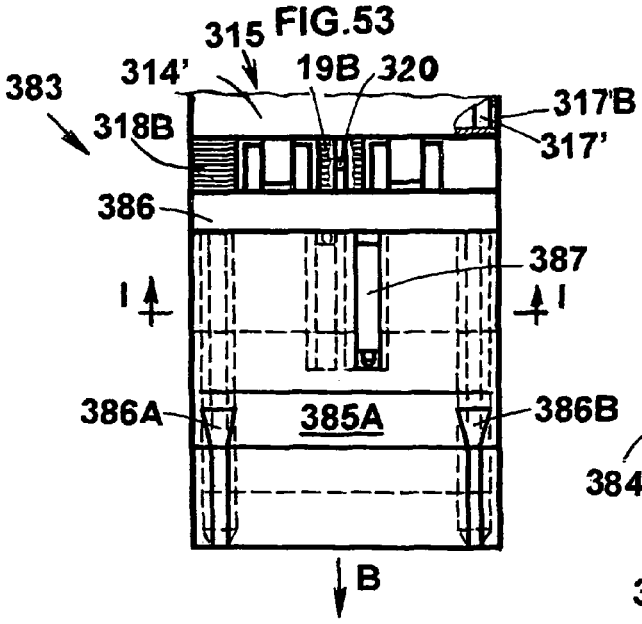
FIGS. 53, 54 and 55 are side and partial cross-sectional views of the preferred two wedges-shaped embodiment 383 of the directing making means 316A in FIG. 32.
Figure 55:
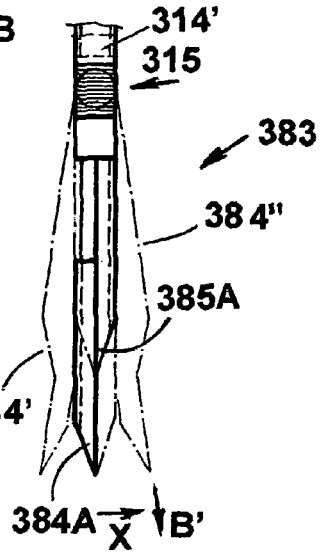
Figure 54:
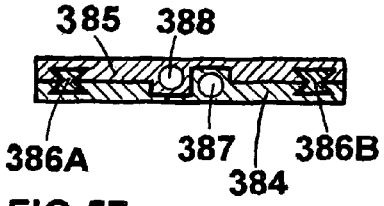

In FIGS. 53 to 55 there it is shown a second wedge-shaped cutter embodiment 383 of the directing making means 316A in FIG. 32 that is composed of two the same preferably longitudinally displaceable elongate, adjacent side-by-side and mirror symmetrical, one-sided wedge-shaped cutters 384 and 385 generally oriented along the longitudinal axis of the cutter 383 and excavated hole b being formed. Each of the cutters 384 and 385 has an aside and forward oriented wedge-shaping cutting portion 384A or 385A and a rear oriented holding portion 3848 or 385B which are supported and guided by a front motive frame link 386 of the motive means 314 for longitudinal displacement in the directions shown by the arrows B and C in FIG. 32 along guiding and supporting portions 386A and 386B of the frame link 386 by the motive means 314 to penetrate the facial wall of the hole 302'. The portions 384A and 385A form the adjacent angles of sharpness 45° to 60° and the cutting angles which are equal to about 180°. To force or shift the cutters 384 and 385 individually or together relative to the frame 386 there are provided hydraulic cylinder and plunger units 387 and 388 which are located in the portions 384B and 385B and pivotally secured at the rear to the frame 386. The frame 386 is supported by the front portion of the front link 314' with the hinge 315 and contains the conduit section 317', 318' and 319' (not shown) which are connected to the corresponding conduit sections of the link 314' by the connecting means 317'A, 318'A and 319'A and the measuring means 320.

Each of the wedge-shaped cutters 384 and 385 is capable of being forced into interaction with the facial wall of the hole section 302' being formed to urge the frame link 386 located remotely from the adjacent following hinge 315 about the following hinge 315 in a direction shown by an arrow X in FIG. 55 and crossing the central longitudinal axis of the excavated section 302' toward the diverged direction B' and has the ability to control the direction B of the section 302'.

Each of the wedge-shaping cutting portions 384A and 385A is adapted for forcing the facial wall in the crossing direction from the direction B' and are operable to move the directing forming means 311, with the mill barrels 371A to 371D, relative to the facial wall being forced toward the direction B' by the rams 340 and the activating and drive means 374 capable of forcing the bits against the facial wall and have the ability to control the force and direction of deformation of the facial wall of the excavated section 302' being formed. The direction of deformation is controlled with the direction of rotation of the mill barrels 371A to 371D that is shown by arrows T and V in FIGS. 49A to 49C by the activating and drive means 374, the force of deformation is controlled by the rams 340 and units 346 of the urging links 314' that are shown in FIGS. 34 to 36. During the direct excavating operation, the cutters 384 and 385 are located preferably at rear working positions close to the frame 386 and advanced to penetrate the facial wall with the frame 386. In a second way, the cutters 384 and 385 are located at front advanced working positions and the units 387 and 388 are extended and blocked in known manner.

During the turning excavating operation in the diverged direction B' in FIG. 55, the unit 387 of the cutter 384 or the unit 388 of the cutter 385 when which is located in the rear working position and remotely from the direction B' is supplied with pressure fluid to extend and thereby urge the respective cutter 384 or 385 in the advancing direction B toward the facial wall relative to the frame 386 to penetrate and force the wall in a direction from the direction B' at a point which is located remotely from the front hinge 315 than the other cutter 385 or 384 so that the advanced cutter 384 or 385 creates the yawing or turning moment about the front hinge 315 and urges the frame 386 to move about the front hinge 315 in a direction shown by an arrow X in FIG. 55 toward the direction B'. The reminder inoperated unit 387 or 388 is preferably shortened and blocked so that the reminder cutter 385 or 384 remains in the rear working position which is used for the direct excavating operation.

In second way, the unit 387 of the cutter 384 or the unit 388 of the cutter 385 when located in the advanced working position remotest from the frame 386 and nearest, relative to the other cutter 385 or 384, to the direction B' releases pressure fluid to shorten and thereby allow the corresponding cutter 384 or 385 to be urged by the facial wall toward the frame 386 so that the other advanced cutter 385 or 384 penetrates and forces the facial wall in a direction from the direction B' at a point more remote from the hinge 315 than the other cutter 385 or 384 and thereby creates the greater yawing or turning moment about the front: hinge 315 and urges the frame 386 to move about the hinge 315 in the direction X toward the direction B'. The other unit 387 is preferably extended and blocked so that the reminder cutter 385 or 384 remains in the advanced working position being used for direct advancement.

In FIG. 56 there is shown schematically the cross-section of a section of the underground curved and narrow structure 301 consisting of wall portions 301A and a wide stratum portion 301B that is constructed under a ground water channel as one of some schemes of underground controllable curved paling-shaped structures which could be constructed in a multihole cylindrical narrow excavation like joined together a gallery between trenches formed of a predetermined depth and distance up to 100 meters and more and a thickness of 0.15-0.30 meter and more, preferably 0.20-0.25 meter in the ground 303 with using the described apparatus 300 and the method according to the present invention.

In constructing the underground multisectional stratum and wall 301 by the use of the apparatus 300 constructed described above, a trench 389 having a predetermined width and depth is dug in the ground 303 at a position where the underground multisectional structure 301 is to be formed by means of a known trencher (not shown). The forming means 311, for example, is then assembled of the respective to the mechanical characteristics of the ground 303 making means 316A and the urging links 314' and placed by the aid of the crane 327 into the trench 389. Thereafter, correspondingly the unit 354 in FIGS. 37 to 40 is supplied with pressure fluid to move and thereby displace the cutter 350 with the drive means 353 into the direct working position or the units 387 and 388 in FIGS. 53 to 55 that are supplied with pressure fluid to move and thereby displace the cutters 384 and 385 into the same working positions or the activating and drive means 370 or 378 are supplied with motive power to rotate the mill barrels 371A to 371D of the cutter 368 in FIGS. 45 and 46 or the mill barrels 379A to 379D of the cutter 376 in FIGS. 50 and 51 in the directions T and V shown in FIGS. 49A to 49C and 52A to 52C, while the units 114 in FIGS. 45 and 50 are supplied with pressure fluid to reciprocate the mill barrels 371A to 371D with the frame 370 or the mill barrels 379A to 379D with the frame 381 and the units 346 in FIGS. 34 to 36 are supplied with pressure fluid to extend and thereby urge the members 334 and 335 outwardly into compressive engagement with the walls of the trench 389 and the units 326 are supplied with pressure fluid to move and thereby urge the frames 333 in the direction G so that the above-mentioned embodiment 350 or 368 or 376 or 383 of the making means 316A forms a hole section 302' in the straight advancing direction B in the ground 303 while the activating means of the crane 327 is supplied with motive power to move and thereby urge the spare and respective units 314' to assemble to the motive means 314.

When the direction B' of excavating the hole section 302' is diverges from the tangent of the central longitudinal axis of the excavated section 302' being formed (shown in FIG. 33), the unit 354 is supplied with pressure fluid to move and thereby displace the cutter 350 with the drive means 353 into an intended diverged working position 350' shown in FIG. 40 toward the diverged direction B' or the units 387 and 388 that are supplied with pressure fluid to move and thereby advance the cutter 384, for instance, which is located remotely from the direction B' into an advanced relative to the cutter 385 working position shown in FIGS. 53 and 55 or move the cutter 385 which is located closely to the direction B' from its advanced working position which is adjacent to the advanced cutter 384 into a rear working position that is located behind the cutter 384 or the activating and drive means 374 or 378 are supplied with motive power to rotate the mill barrels 371A to 371D or 379A to 379D in the same directions T or V shown correspondingly in FIGS. 49A or 49B and 52A or 52B to force the facial wall of the excavated section 302' being formed from the direction B' and thereby urge the respective associated frame 370 or 381 with the mill cutter 368 or 376 about the hinge 315 toward the direction B', so to advance the excavated hole section 302' in the direction B'. The links 314' interact with the walls 302'A and 302'B of the hole section 302' being formed and be urged by the walls 302'A and 302'B to move about axes of the hinges 315 and in the direction B' in the formation of the curvilinear excavated section 302', while the portions 314'A and 314'B of the links 314' that are substantially similar to the portions 344 of the members 335 and the portions 345 of the members 336 are operated by the rams 340 to move the links 314' about the hinges 315, force and deform the walls 302'A and 302'B in a cylindrical shape in order to move the links 314' along the length of the section 302'. So, the forming means 311 forms direction-controlly the hole section 302' up to the intended depth and distance and stops to be supported by the walls 302'A and 302'B.

Then the crane 327 when is supplied with motive power that moves the wire 327C and thereby urges the suitable making means 316B, such as the cutter 360 or the cutters 368 or 376 or the cutters 383 and the front urging link 314' and then the respective spare links 314' to assemble the forming means 312 and forces the directing members 365 of the cutter 360 or the members 375 of the cutters 368 or 376 into movable engagement with the supporting and guiding portions shown by chain-dotted lines 344A, 345A and 348A of the links 314' of the forming means 311 and places the forming means 312 into the trench 389. Thereafter, the corresponding activating and drive means 374 or 378 when are supplied with motive power rotate the mill barrels 371A to 371D or the mill barrels 379A to 379D in the directions T and V shown in FIGS. 49C and 52C, while the frames 333 are advanced in the direction B in FIGS. 32 and 33 by the above-described operating the units 326 and the rams 340 to move the members 334 and 335 to form a next hole section 302' closely to the formed section 302' which is occupied by the forming means 311. When the direction B' of the excavation diverges from the central longitudinal axis of the hole section 302' being formed, the corresponding directing member 365 or 375 forces the walls 302'A and 302'B of the formed section 302' at the members 365 or 373 by the aid of the supporting and guiding portions 344A, 345A and 348A and the side wall-forcing portions 314'A and 314'B of the links 314' of the forming means 311 in a direction opposite of the diverged direction B' to cause the members 365 or 375 and the frame 362 of the cutter 360 or the frame 370 of the cutter 368 or the frame 378 of the cutter 376 to be forced toward and in the direction B' to advance the excavated section 302' in the direction B'. So, the forming means 312 forms the next hole section 302' up to the intended depth and distance and stops to be supported by the walls 302'A and 302'B.

Then the units 366 of the cutter 360 or the ram 114 of the cutters 368 or 376 are supplied with pressure fluid to shorten and thereby urge the directing members 365 out of the engagement with the portions 344A, 345A and 348A into the pockets 367 or the cutters 368 or 376 from the forming means 311 to allow the forming means 311 to move in the returning direction C by the above-described operating the rams 340 and units 346 of the links 314' that are supplied with pressure fluid to reciprocate and thereby urge the frames 333 and the members 334 and 335 toward above the ground level 305 and in the intended direction C of emptying the formed hole section 302' so that the forming means 311 forms a gap in the formed section 302' in the interior between the walls 302'A and 302'B and the portions 314'D of the links 314'. The crane 327 when located with its wire 327C and the carrier member 310 engaged with the upper link 314' of the forming means 311 that appears above the ground level 395 is supplied with motive power to move the wire 327C to disassemble the upper link 314' from the forming means 311 and move the disassembled spare link 314' in the direction A to assemble again together with the forming means 313 being inserted into the ground 303, while the structure material 301', such as a cement-clay mixture is let into the gap 302' being formed through the opening 317'B of the conduit 317' provided in the links 314' of the forming means 312 as shown by the arrow E in to form a section of a clay-cement structure 301.

Figure 57:
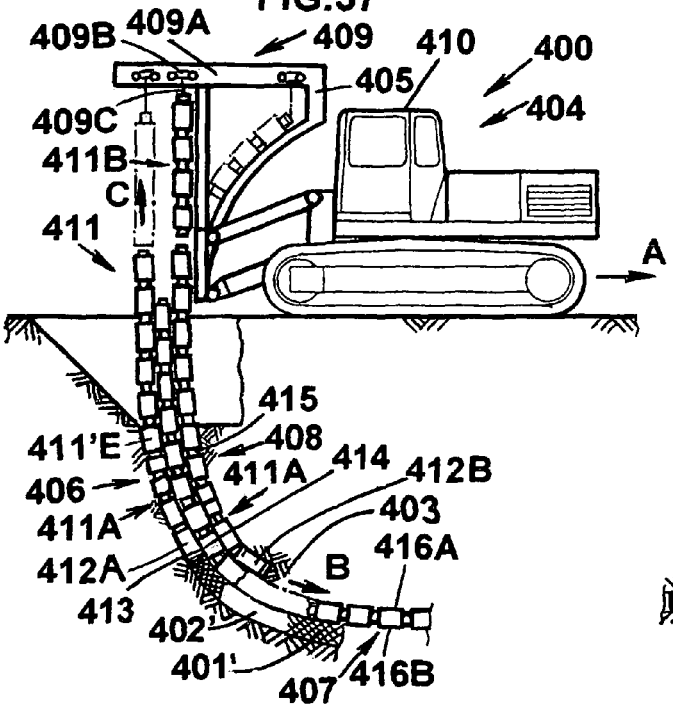
FIGS. 57 and 58 are side and rear views of the preferred embodiment 400 of an apparatus according to the invention for constructing an underground double-curved and narrow, horizontally and vertically extending structure in a multihole excavation being formed in the ground.
Figure 58:
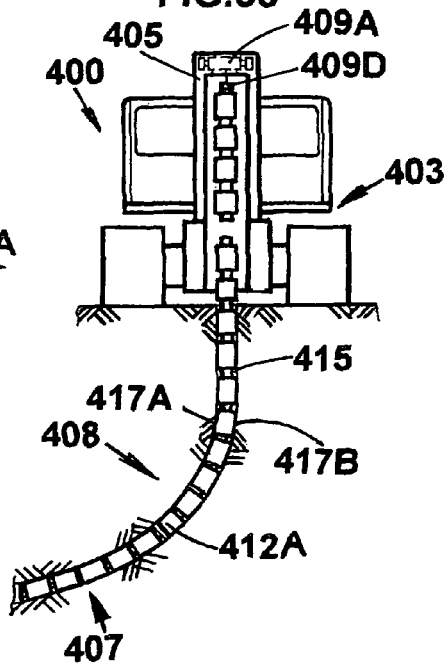

FIGS. 57 and 58 show an embodiment 400 of an apparatus for constructing an underground complicatedly curved and narrow horizontally and vertically extending structure, such as stratum and wall 401, which is consisted of adjacent well-shaped sections in a multihole excavation 402 being formed in the ground 403. The apparatus 400 comprises a chassis, such as a caterpillar tractor 404 for supporting components of the apparatus 400 and supplying power and materials to the components, where the tractor 404 being movable in an intended horizontal advancing direction shown by an arrow A in FIG. 57 along the length of a structure line and stoppable at working positions on heads of well section lines crossing the structure line and is provided with a known controlling and pressure fluid pumping means (not shown) being driven by an engine and a framework 405 which is adapted to connect the tractor 404 to a number or a set of a means 406 to 408, for instance, for forming the structure 401 and to dispose the forming means 406 to 408 and insert into the ground 403 in an intended advancing direction shown by an arrow B in FIG. 57 to form a hole section 402' and withdraw out of the formed hole section 402' in a direction shown by an arrow C in FIG. 57 to form a structure section 401' and provided with a pile driver 409 comprising a rails beam 409A, a hoisting winch 409B, a winch wire 409C and a carrier member 409D for engaging forcedly each of the forming means 406 to 408, a remote controlling means at a tractor cabin 410 for controlling operations of the apparatus 400.

The forming means 406 is adapted for constructing direction-controlly the first or initial space- or spatial-curvilinear section 401' of the structure 401 and the forming means 407 and 408 are adapted for further constructing next space-curvilinear sections 401' of the structure 401, where each of the next sections 401' is constructed along a last section 401' formed previously. Each of the forming means 406 to 408 comprises an elongate, flexible like a chain and longitudinally displaceable motive means 411 which is extensible by connecting in consecutive order and in end-to-end relationship spare extension and articulated short-linked motive links 411' to the motive means 411. The forming means 406 comprises a means 412A for making direction-controlly the first excavated hole section 402' and each of the forming means 407 and 408 comprises a means 412B for making guidedly further hole sections 402' ahead of its respective motive means 411 and a means 413 for supporting and guiding the following guided forming means 407 and 408 (later described). Each of the forming means 407 and 408 has a means 414 for directing the excavation of the next excavated hole sections 402' (later described).

The making means 412A is able to force the front link 411' from its position toward the intended advancing direction B and control the direction B of the advancement of the hole 402' and comprises hole-directing and making members (later described), where each of the members is capable of being forced into interaction with the working end facial wall of the hole section 402' being formed to urge the forming means 406 in a direction crossing the central longitudinal axis of the excavated section 402' toward the direction B and has the ability to control the direction B of the excavated section 402' and excavation-directing portions for forcing the facial wall in the crossing direction that have the ability to control the force and direction of deformation of the facial wall and operable to move the forming means 406, with the members, relative to the wall being forced toward the direction B by an activating means (later described) capable of forcing the portions against the wall.

The directing means 414 is able to force the making means 412B with the front link 411' from their positions toward the direction B and control the direction B of the advancement of the next excavated hole section 402' and has excavation-directing members (later described) each of which is capable of being forced into interaction with walls 402'A and 402'B of an adjacent from behind formed hole section 402' via the guiding and supporting means 413 and the motive means 411 of the respective directing forming means which is substantially similar to the forming means 406 at first and then the forming means 407 being in the formed hole 402' and supported by its walls 402'A and 402'B to urge a respective next in turn guided forming means, such as the forming means 408 in the crossing direction and has an excavation-directing portion for forcing a guiding and supporting portion of the guiding and supporting means 413 of the respective forming means 406 and then the forming means 407 in the crossing direction, where the supporting and guiding portion is operable to move the guided forming means 407 at first and then the forming means 408 with the guiding and supporting means 413 relative to the walls 402'A and 402'B supporting and being forced by the forming means 406 and then forming means 407 toward the advancing direction B by the activating means capable of forcing the portion against the walls 402'A and 402'B.

Each of the links 411' comprises known conduits for transmission a drill or wash liquid and pressured air into an excavated hole section 402' being formed, a debris material after penetration of the facial wall out of the section 402', the material 401A of the structure 401 into the formed hole section 402', power and controlling signals to an activating means of the forming means 406 to 408 that are extending from the upper end into and along the length of the motive links 411' and having a known and like above described connecting inlet means which is located above the ground level, flexible and armoured transit quick-acting, connecting and coupling means, branched lower outlet ends opening at the activating means and the lower end of the forming means 406 to 408 for letting or jetting or pouring the drill or wash liquid, pressured air and the materials 401A into a hole section 402' being formed and then emptied.

The shorten links 411' are connected together separately or in groups with a preferable ball-and-socket hinge means 415 for movement about axes crossing the central longitudinal axes of the adjacent links 411' and perpendicular to the directions B and C, so that each of the links 411' is capable of being forced into interaction with the surrounded walls of the hole section 402' being formed and then emptied to urge the forming means 406 to 408 with the links 411' in a direction crossing the central longitudinal axis of the section 402' toward the direction B in the formation of the hole section 402' and then toward the direction C in the formation of the structure section 401'.

Each of the links 411' takes the form of a box-like structure and has opposite side portions 416A and 416B, 417A and 417B for supporting and forcing the surrounded walls 402'A, 402'B, 402'C, 402'D (shown in FIG. 63) of the hole section 402' being formed and then emptied in the crossing direction in formation of the curved walls 402'A to 402'D and movement of the forming means 406 to 408, with the links 411', about the axes of the hinges 415 relative to the walls 402'A to 402'D being forced toward the directions B or C in order to move the links 411' along the length of the excavated hole section 402' by an activating means (later described) of the apparatus 400 that is capable of forcing the portions 411'A to 411'D against the walls 402'A to 402'D.

In FIGS. 59 to 68 there are shown embodiments of components of the forming means 406 to 408 in FIGS. 57 and 58 that are provided with a drilling mill cutter embodiment, for example (later described) of the making means 412A and 412B.

In FIGS. 59 to 61 and 63 it is shown more clearly an embodiment 418 of an urging motive link set 411A in FIGS. 57 and 58 that consists of four motive links 411'A to 411'D which are connected together in consecutive order of two telescopic motive link group 418A and 418B for relative longitudinal displacement and have the quadrangular cross-section. The frontally disposed, relative to the direction B, link group 418A comprises a front motive link 411'A which has an outer telescopic sleeve portion 419 and a rear portion of a front hinge 415A of the coupling connection to the making means 412 and a rear motive link 411'B which has an inner telescopic bush pipe 420 and a front portion of a following hinge 415B of the connection to the rear link group 418B which comprises a forward oriented inner telescopic bush pipe portion 421 of a motive link 411'C which has from the front end a rear portion of the hinge 415B and a rearward oriented motive link 411'D which has from the front end an outer telescopic sleeve portion 422 and from the rear end a front portion of a following hinge 415C of the coupling connection to the next link 411'. To force or shift the links 411'A to 411'D in their longitudinal direction there are provided double-acting hydraulic cylinder and piston units or rams 423 and 424 which are pivotally connected via linkages or brackets to the front end of the sleeve portion 419 and to the rear end of the sleeve portion 422 where the rams 423 and 424 are pivotably connected together with the cylinder ends and to the inner portion of the hinge 415B.

The hole walls-supporting portions 416A, 416B, 417A and 417B shown in FIGS. 57 and 58 of the links 411'A and 411'D that are formed with a plurality of outward oriented hole wall-supporting portions 425A of the plurality of disposed on the sides of the sleeve portion 419 and preferably the same wall-supporting members 425 of the link 411'A and with a plurality of outward oriented hole wall-supporting portions 426A of the plurality of disposed on the sides of the sleeve portion 422 and preferably the same wall-supporting members 426 of the link 411'D, where the members 425 and 426 have the ability to be expanded and outwardly forced into more effective compressive engagement with the hole walls being supported by the members 425 and 426 to immobilise securely the members 425 and 426 and the sleeve portions 419 and 422 relative to the walls. The portions 425A and 426A are reciprocatingly movable in opposite outward directions shown by arrows D and inward directions shown by arrows E in FIGS. 59 to 61, capable of compressively engaging the walls 402'A to 402'D of the excavated hole section 402' and operable to expand the supporting members 425 and 426 for immobilising securely the members 425 and 426 and the sleeve portions 419 and 422 relative to the walls 402'A to 402'D by an activating means, such as the same preferably and expansible by pressure fluid hydraulic power tubs or chambers of an elastic material, such as a rubber, or telescopically connected together hydraulic power cylinders units 427 of the link 411'A and the same preferably power hydraulic units 428 of the link 411'D that are capable of outwardly moving the portions 425A and 426A to engage compressively the walls 402'A to 402'D. The sleeve portions 419 and 422 are shaped to provide the same preferably pockets or recesses 429 and 430 for accommodating, supporting and guiding the respective members 425 and 426 for expansion and for accommodating the tubs 427 and 428 between the sleeve portions 419 and 422 and the members 425 and 426. It is possible to provide a group of rams 423 and 424 for each group of the members 425 and 426.

While the members 425 in FIG. 55 and the members 426 in FIG. 56 are in their operating positions, stationary and being expanded within the hole, the portions 425A and 426A are faced and pressing on the walls 402'A to 402'D relative to the sleeves 419 and 422 by the activating tubs 427 and 428 being supplied with pressure fluid to expand and thereby urge the members 425 and 426 to expand in order to be compressingly engaged with the walls 402'A to 402'D and subjected to above-mentioned backpressure by the walls 402'A to 402'D to impede securely displacement of the portions 425A and 426A relative to the walls 402'A to 402'D.

During the excavating operation, the making means 412A is advanced to penetrate the facial wall of the hole 402' with supplying pressure fluid firstly to the tubs 428 associated with the members 426 so that the tubs 428 expand and thereby urge the members 426 to expand toward and against the walls 402'A to 402'D to compressively engage the walls 402'A to 402'D so that the link 411'D remains stationary and secondly to the rams 423 and 424 associated therewith so that the latter extend and thereby urge the links 411'B, 411'C and the making means 412 with the link 411'A in the advancing direction A toward the facial wall. The direction of advancement of the links 411'A and 411'B that is controlled by the making means 412A (later described), the direction of advancement of the links 411'B to 411'D that is controlled by the link 411'A. When the rams 423 and 424 have been extended so that the link groups 418A and 418B extend and the making means 412 advances a hole section 402' then the rams 423 and 424 have been stopped and can be operated in a reverse sense to retract and draw up the links 411'B, 411'C with the link 411'D forward. During this latter phase when the links 411'B to 411'D are drawn up, firstly the tubs 428 are evacuated with releasing pressure fluid to narrow and thereby release the members 426 out of their compressive engagement with the walls 402'A to 402'D and the tubs 427 are supplied with pressure fluid to expand and thereby urge the members 425 to expand toward and against the walls 402'A to 402'D so that the members 425 and the link 411'A remain stationary and secondly the rams 423 and 424 are supplied with pressure fluid to shorten and thereby urge the links 411'B and 411'C with the link 411'D toward the link 411'A so that the link groups 418A and 418B shorten and are ready to advance the section 402'. The direction of advancement of the link 411'B that is controlled by the link 411'A, the direction of advancement of the links 411'C and 411'D that is controlled by the link 411'B. The movement of the links 411'B to 411'D relative to the link 411'A in the advancing direction b is effected by the rams 423 and 424 at a speed which must be equal to a speed of movement of the forming means 408, for example, with the motive means 411 in the same direction B by an activating means of the derrick 403 to decrease the pushing force by the derrick 403 and the overturning moment about the derrick 403. The operation of advancement the hole sections 402' in this way is carried out as part of an overall sequence involving the advancement of the forming means 408 to 410.

The structure 418A and 418B is provided with a known means for remote measuring angles of the relative diverging with the hinge 415 between the making means 412A and the link 411'A, the links 411'A and 411'B, the links 411C and 411'D, that is similar to a known strain metering means which is located at the hinges 415A to 415C and a known photoelectrical means which is located on the rear end of the making means 412A, for instance, and with a known means for remote measuring distances between the links 411'A and 411'D, that is similar to a known length-measuring tape means extending between the hinges 415A and 415C and provided with guiding pulleys, rolling reels and strain metering spirals (not shown) being capable to signal about the relative positions of the links 411'A and 411'D and connected by the length of cables to the remote controlling means 410.

In operation, while the members 425 and 426 are in their operating positions, stationary and expanded within the hole section 402', the portions 425A and 426A are faced and pressing on the walls 402'A to 402'D in order to be compressively engaged with the walls 402'A to 402'D and are subjected to backpressures by the walls 402'A to 402'D that is equal up to about the ground compression strength (see above). If dimensions of the same preferably portions 425A and 426A are: the width—50 centimeters and the length—50 centimeters, then the static friction forces between the walls 402'A to 402'D and the sleeves 419 and 422 each of which is provided with four oppositely disposed members 425 and 426 with the portions 425A and 426A being moved apart against the walls 402'A to 402'D that can correspondingly reach up to about 30 tons and more. While the members 425 and 426 are in their inoperative positions and out of the compressive engagement with the walls 402'A to 402'D or decreased in its volume by the active pressure of the walls 402'A to 402'D, which is equal up to about 0.5 kg/cm$^2$, for instance, so the sliding adhesion and friction forces between the walls 402'A to 402'D and the surface of the links 411'A to 411'D that impede the displacement of the links 411'A to 411'C of the length being increased from 50 cm up to about 150 cm, for instance, within the hole 402' that can reach up to about 8 tons. The friction force in a hole section 402' having the stable walls 402'A to 402'D that is lesser than the own weight of the motive means 411 and the links 411'A to 411'D and equal to about 1 ton, for instance. Therefore, the rams 423 and 424 can extend and thereby urge the links 411'A to 411'C and the making means 412A forward relative to the link 411'D with a force equal up to correspondingly 25 tons to advance the section b and can shorten and thereby urge the links 411'B to 411'D and next links 411' forward relative to the link 411'A with the force equal up to 25 tons to advance the motive means 411 with the link 411'D (as that is later described). So, an intended plurality of the urging link sets 411A and their locations along the length of the motive means 411 are corresponding to the mechanical characteristics of the ground 403, the length of a plurality of the links 411' inserted into the hole section 402' being formed and an intended embodiment of the making means 412A. For adjacent in tandem order two link sets 411A there is a constant length between the hinge 415A of the front set 411A and the hinge 415C of the second set 411A and the constant lengths of sections of the conduits which are extending within the links 411'A to 411'D.

Figures 59, 60, 61, 62, 63, 64, 65, 66, 67, 68A, 68B, 68C, 68D, 68E:
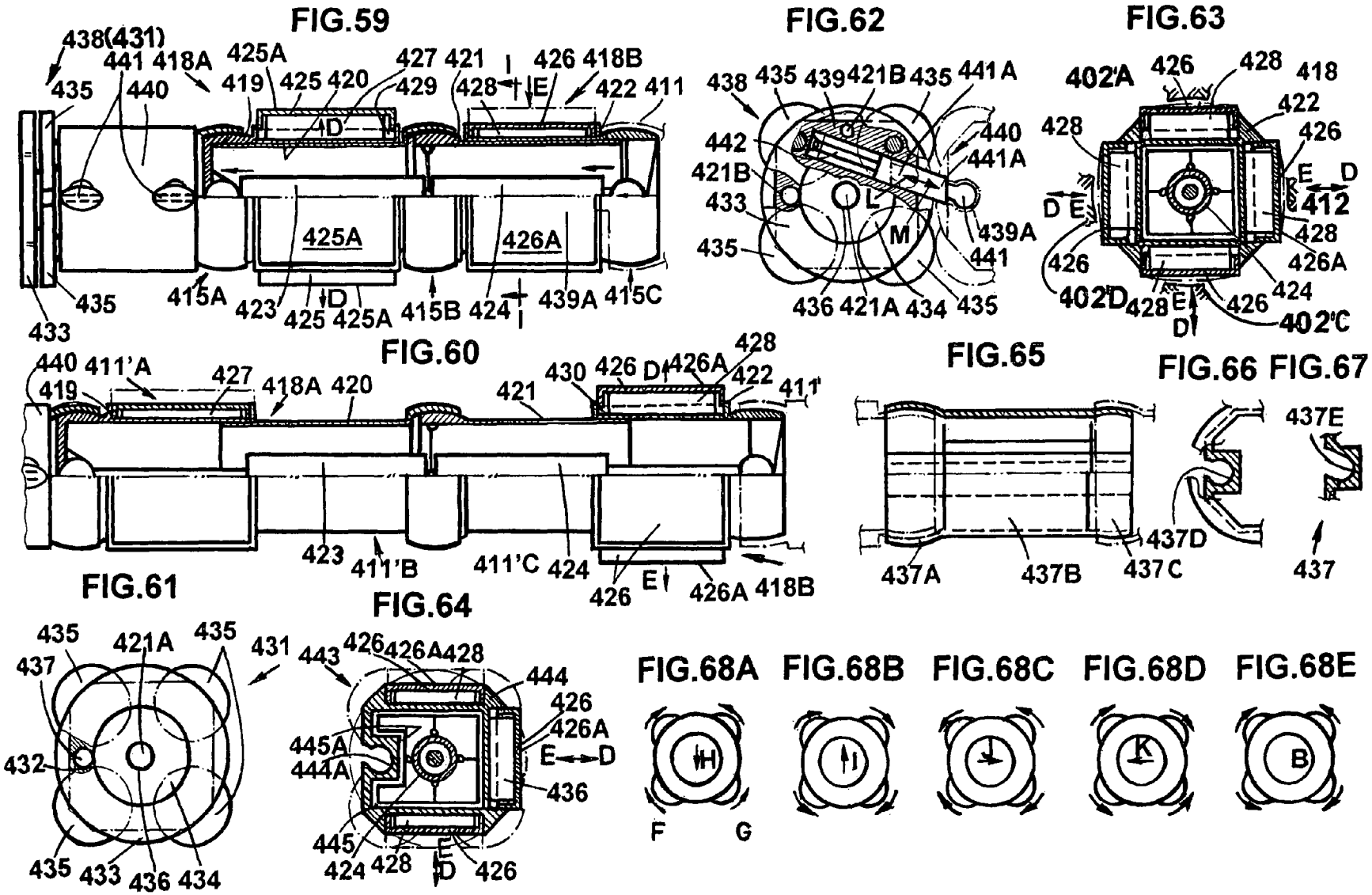
FIGS. 59 and 60 are side and partly longitudinal axial sectional views illustrating the preferred end mill cutter embodiment 438 of the guided making means 412B that is assembled with the preferred embodiments 418A and 418B of the urging motive link group 411A of the motive means 411 in FIG. 57.
FIG. 61 is front and partly cross-sectional views of the end mill cutter embodiment 431 of the directing making means 412A in FIG. 57.
FIG. 62 is front and partly cross-sectional views of the mill cutter embodiment 438 of the guided making means 412B and the embodiment 440 of the directing means 414 in FIG. 57.
FIG. 63 is a cross-sectional view of the urging motive group 418B shown by arrows 1-1 in FIG. 59.
FIG. 64 is a cross-sectional view of the embodiment 443 of the urging motive group substantially similar to the group 418A in FIG. 59 that is adapted to be disposed in a working position between the urged motive link groups 411B in FIG. 57.
FIGS. 65, 66 and 67 are side and partly cross-sectional views of the preferred embodiment 437 of the urged motive link 411' in FIG. 57 that is provided with the preferred embodiments 437D and 437E of the guiding and supporting means 413 in FIG. 57.
FIGS. 68A, 68B, 68C, 68D and 68E are views illustrating schematically the directions shown by arrows F and G of turning movement of the directing end mill cutters 435 in FIGS. 59, 61 and 62 and the directions shown by arrows H, I, J, K and B of the resultant movement of the directing end mill cutter means 431.

In FIGS. 59 and 61 there it is shown a directing and drilling embodiment 431 of the making means 412A in FIG. 57 that comprises a frame 432 for supporting components of the drilling cutter 431, the intended number, two preferably of central main end mill cutters 433 and 434 which are located co-axially and ahead of the frame 432 for rotation about the central longitudinal axis of the cutter 431 that is extended along the axis of the hole section 402' in opposite directions shown by arrows F and G in FIG. 68A and an intended number, four the same preferably end mill cutters 435 which are located behind the cutters 433 and 434 and ahead of the frame 432 and supported by the frame 432 for rotation in the controlling intended directions F and G (later described) about the axes parallel preferably to the central axis. Each of the cutters 433 to 435 has forward oriented cutter bits or portions (not shown) which are arranged on the face of the cutters 433 to 435 and each of the cutters 435 has the cutter bits which being capable of acting in the directions F and G. The frame 432 is supported by the front portion of the link 411'A with the hinge 415A and contains sections of the conduits, where a front end wash liquid-injection conduit section is substantially similar to a hollow shaft 436 of the cutter 434 and has a lower outlet opening at the lower end of the shaft 436 and lower b ends 437 of the withdrawing conduit section are located around the cutter 434 and between the cutters 435. The drill cutter 431 comprises a known drive means which is located in the frame 432, servicing for providing motive power to the cutters 434 and 435, and has preferably a remotely controllable set of a hydraulic motor and a gear (not shown).

Each of the cutters 435 is capable of being forced when rotated into interaction with the facial wall of the hole section 402' being formed in the directions F and G to urge the links 411' with the frame 432 in directions shown by arrows H in FIG. 68A, I in FIG. 68B, J in FIG. 68C, K in FIG. 68D, B in FIG. 68E and crossing the central longitudinal axis of the excavated section 402' toward the intended advancing direction B or in the opposite directions shown in FIG. 68E to move straight in the direction B so that to control the direction B of the section 402'. The cutter bits are capable of forcing the facial wall in the crossing direction and controlling the force and direction of deformation of the wall and operable to move the forming means 409, with the cutters 435, to the wall being forced in the directions H to K toward the advancing direction B by the activating means of the apparatus 400 that are capable of forcing the bits of the cutters 435 against the wall in the intended directions F or G to control the direction B of the advancement of the section 402' and to force the motive link 411'A with the frame 432 toward the direction B. It is possible to provide further combinations of the rotation directions of the cutters 435 for forcing the frame 432 in intermediate directions between the directions H to K.

In FIGS. 64 to 66 there is shown an embodiment 437 of the urged motive link 411'E shown in FIGS. 57 and 58 and provided with the hole wall-forming and supporting portion 437A, portions 437B and 437C of the hinges 415, and an embodiment of the guiding and supporting means 413 shown in FIG. 57 that is substantially similar to a groove portion 437D longitudinally extending through the portions 437A to 437C and having a geometrically closed shape like a swallow-tail for engagement of the link 411'E of the guiding and supporting forming means 407, for example, with the directing means 420 shown in FIG. 57 (later described) of the guided and supported forming means 408 for relative longitudinal movement. The intended, preferably front link 411'E has an end outlet groove portion 437E of a geometrically open shape shown in FIG. 67 and being capable to allow releasing the guiding forming means which is similar to the forming means 406 with the guiding means 413 out of the engagement with the directing means 420 for movement in the returning direction C out of the formed hole 402'.

In FIGS. 59 and 62 it is shown a guided drilling cutter embodiment 438 which is similar to the cutter 431 and has the cutters 433 to 435 and a frame 439 for supporting and guiding components of the cutter 438 and an embodiment 440 of the directing means 414 shown in FIG. 57 that comprises a directing member 441 being displaceable longitudinally with the frame 439 in the advancing direction B and relative to the frame 439 in an axial direction shown by an arrow L in FIG. 67 from an operative position represented by full lines into an inoperative position represented by chain-dotted lines and a drive means, such as a hydraulic cylinder and piston unit 442 formed in a rear holding portion 441A of the member 441 conjugated for the sliding swallow-tail engaging connection with the guiding and supporting groove portions 437D and 437E of the adjacent links 411'E of the directing and forming means which is substantially similar to the forming means 406 and 407. The directing member 441 is able in its operative position to force the frame 439 from its position toward the direction B and control the direction B of the advancement of a next excavated hole section 402' and is capable of being forced by the unit 442 and an activating means of the framework 406 into sliding engagement with the groove 437D of the located above the ground level link 411'E of the forming means 407 being in the hole section 402' formed previously and into interaction with the respective side walls 402'A to 402'D of the section 402' via the links 411'E supported by the respective walls 402'A to 402'D to urge the forming means 408, for instance, with the making means 412B being inserted into the ground 403 in a direction crossing the central longitudinal axis of the excavated section toward the direction B. The member 441 is capable of forcing the walls 402'A to 402'D through the links 411'E in the crossing direction and operable to move the links 411' of the forming means 408 with the frame 439 and the member 441 relative to the walls 402'A to 402'D being forced toward the direction B by the activating means of the apparatus 400 that capable of forcing the member 441 through the links 411'E of the forming means 407 against the walls 402'A to 402'D. The portion 437E of the suitable, preferably front link 411'E allows the member 441 to be displaced out of the engagement from the operative position into the inoperative position.

In FIG. 64 there is shown the cross-section I-I of an embodiment 443 of the urging link groups 418A and 418B in FIGS. 59 and 60 that is adapted for assembling the urging motive set 411A between the urged links 411'E, where each of the links 411'A and 411'D is provided with a sleeve frame 444 having a groove portion 444A and each of the links 411'B and 411'C has a bush pipe section 445 having a groove portion 445A.

In operation, the guiding and supporting grooves 437D and 437E in FIGS. 65 to 67 of the links 411'E in FIG. 57 and the groove 444A in FIG. 64 of the set 411A in FIGS. 57 and 58 that being filled up with wash liquid, and the directing member 441 of the drill cutter 438 being inserted into the ground 403 inserts into the respective grooves 437D and 444A and forces the frame 440 from its position toward the intended advancing direction B and controls the direction B of the advancement of the next hole section 402' close to the adjacent from behind hole 402' formed previously.

Figures 69, 70, 71, 72, 73A, 73B, 74, 75:
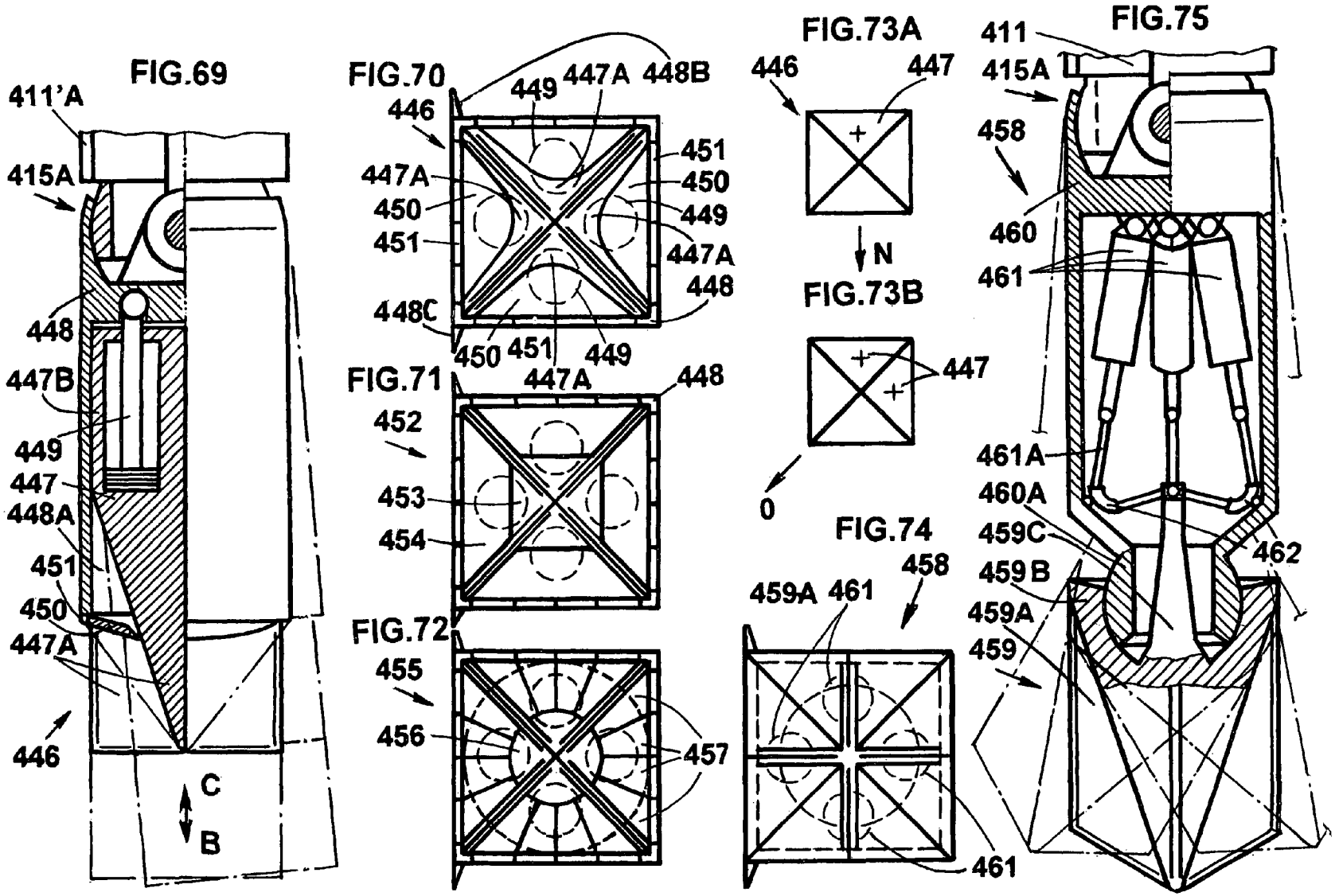
FIGS. 69, 70, 71 and 72 are side, partly longitudinal axial sectional and front views of the preferred loose multiwedge-shaped cutter embodiments 446, 452 and 455 of the directing making means 412A according to the invention.
FIGS. 73A and 73B are views illustrating schematically the directions shown by arrows N and 0 of turning and lateral movement of the cutter embodiment 446 or 452 or 455 when the only one or two wedge-shaped cutters 447 in FIGS. 69 to 72 that moved out as designed by a mark "+"
FIGS. 74 and 75 are front, side and partly longitudinal axial sectional views of the preferred solid multiwedge-shaped cutter embodiment 458 of the directing making means 412A in FIG. 57 according to the invention.

In FIGS. 69 and 70 there it is shown a preferred wedge-shaped embodiment 446 of the directing and making means 412A in FIG. 57 that is composed of a plurality or a set of four preferably the same elongate, loose and longitudinally displaceable hole sections-making and concave wedge-shaped cutter members 447 generally oriented along the longitudinal axis of the cutter 446 and an excavated hole section 402'. Each of the cutter members 447 has a forward oriented, relative to the advancing direction B, concave wedge-shaping cutting portion 447A and a backward oriented holding portion 447B which is supported and guided by a frame 448 for longitudinal displacement in the direction B with the motive means 411 to penetrate the facial wall of the hole section 402' being formed. The portions 447A have a substantially (-shaped broad profile and the holding portions 447B have a prismatic shape and a square profile. To force or shift the cutter members 447 individually or in groups in the directions B and C relative to the frame 448 there are provided the same preferably double-acting hydraulic cylinder and piston units 449 which are formed in the portions 447B and pivotally secured at the rear to the frame 448. This frame 448 has a pocket 448A for spacing, directing and supporting the cutter members 447 for longitudinal relative displacement by the units 449 when perform both cutting and directing functions. The same preferably scrapers 450 conjugated with the portions 447A that are supported by the portions 447A and the frame 448 with a known torsional hinge 451 for displacement ahead of and about the front edge of the frame 448 between the cutter members 447 and the frame 448 and form an additional and forward-oriented wedge-shaping cutting portion of the cutter 446 to facilitate penetration the facial wall. The frame 448 is supported by the front portion of the link 411'A with the hinge 415A and contains sections of the supplying conduits connected to the corresponding conduit sections of the link 411'A by the known flexible connecting and coupling means and an embodiment of the guiding and supporting means 413 in FIG. 57 that is substantially similar to shelf rail-shaped guiding and supporting portions 448B and 448C.

In FIGS. 71 and 72 there are shown views from the front of shaped and acting similarly to the cutter 446 pyramid-forming embodiment 452 of a plurality or a set of the same preferably wedge-shaped cutters 453 each having the triangular cross-section and oriented aside triangular cutting portion and the plurality or the set of the same preferably trapezoidal-shaped scrapers 454 (see FIG. 71) and a cone-forming embodiment 455 of a plurality or a set of the same preferably cutters 456 each having a sector-shaped cross-section and oriented aside conical cutting portion and the plurality or the set of conjugated and the same preferably about trapezoidal-shaped scrapers 457.

During the direct excavating operation all the cutters 447 are located preferably at rear working positions within the pocket 447A and being advanced to penetrate the face by the frame 448 through the units 449 shortened and blocked in known manner. In a second way, all the cutters 447 are located at front working positions and the units 449 are extended and blocked.

During the turning excavation, the single cutter 447 in FIG. 73A or a group of two cutters 447 in FIG. 73B, for example, that located relative remotely from a determined advancing direction, which diverges from the tangent of the central longitudinal axis of the excavated section 402', is or are advanced relative to the frame 448 to penetrate and force the facial wall in a direction from the diverged direction in a point located remotely from the hinge 415A than other cutters 447 and thereby to create the yawing or turning moment about the hinge 415A and urge the frame 448 to move about the hinge 415A in a direction shown by an arrow N in FIG. 73 and an arrow O in FIG. 73B with supplying pressure fluid to the corresponding unit 449 or the group of two units 449 associated therewith so that the latter extends or extend. The other units 448 are preferably shortened and blocked so that the reminder of the cutters 447 remain stationary relative to the frame 448 at the rear working positions using for direct advancement.

In the second way, the single cutter 447 or the group of two cutters 447 that located nearly to the determined diverged advancing direction that is or are moved backward relative to the frame 448 by supplying pressure fluid to the corresponding unit 449 or the group of two units 449 associated therewith so that the latter shortens or shorten to penetrate and force the facial wall in the direction from the diverged direction in a point located nearly from the hinge 415A and thereby to create the yawing or turning moment about the hinge 415A and urge the frame 448 to move about the hinge 415A by the reminder of the cutters 447 remain stationary relative to the frame 448 at the advanced working positions using for direct advancement.

Each of the cutters 447 is able to be reciprocated and advanced alternately ahead of and relative to the frame 448 by the unit 449 and stopped temporarily ahead of the frame 448 which being advanced by the activating means of the apparatus 400. Each of the units 449 performs its pushing forward working stroke and then its backward stroke under pressure from behind by the frame 448 being advanced and pressure from the front by the cutter 447 being stopped by the ground 403. The frame 448 is able to urge forward simultaneously an intended number of the cutters 447 accordingly to the compactness of the ground 403, so that the very compacted ground 403 can be cut through with the cutters 447 which are capable to be advanced alternately.

In FIGS. 74 and 75 there is shown a solid wedges-shaped cutter embodiment 458 of the making means 412A, that comprises a crossing wedges-shaped cutter 459 having two preferably forward oriented and crossing wedges-shaping cutting portions 459A, a rearward oriented, sphere-shaped heel portion 459B, a direction-controlling portion 459C and being supported for displacement in its longitudinal direction and about the sphere center of the portions 459B and a spherical-shaped step-bearing portion 460A of a main frame 460 for supporting the cutter 459. The portions 459A and 459C are protruded remotely from the sphere center. To force or move turningly the cutter 459 there are provided a drive means, such as a set of four disposed oppositely in pairs and interacting selsyn-like hydraulic cylinder and piston units 461 each of which is pivotably connected at the end via a linkage or bracket to the frame 460 and via the length of a chain, preferably the anchor chain or steel rope 461A extending around sprockets 462 to the direction-controlling portion 459C at a point located remotely from the sphere center.

During the excavating operation, the cutter 459 is advanced longitudinally in the advancing direction B to penetrate the facial wall of an excavated hole section 402' with the frame 460. When the direction B diverges from the central longitudinal axis of the hole section 402' and is determined and the units 461 when are located with their ends engaged by the chain with the direction-controlling portion 459C and supplied with pressure fluid to extend and shorten and thereby urge the portion 459C toward and into an intended turned working position and blocked in known manner so that the cutting portions 459A shift also into and immobilised relative to the frame 460 in a corresponding intended turned working position.

In FIGS. 76 to 79 there it is shown an embodiment 463 of the urging link set 411A in FIG. 57 that is similar on the whole to the embodiment 418 in FIGS. 59 to 61 but differs from the embodiment 418 with an embodiment 464 of the guiding and supporting means 413 in FIG. 57. An outer frame 465 of the link 411'A that has longitudinally extending, guiding and supporting shelf rail-shaped portions 465A and 465B (not shown). An outer frame 466 of the link 411'D has the same rail portions 466A and 466B. An inner bush pipe 467 of the link 4118 and an inner bush pipe 468 of the link 411C each has a rectangular cross-section.

Figures 76, 77, 78, 79, 80, 81, 82:
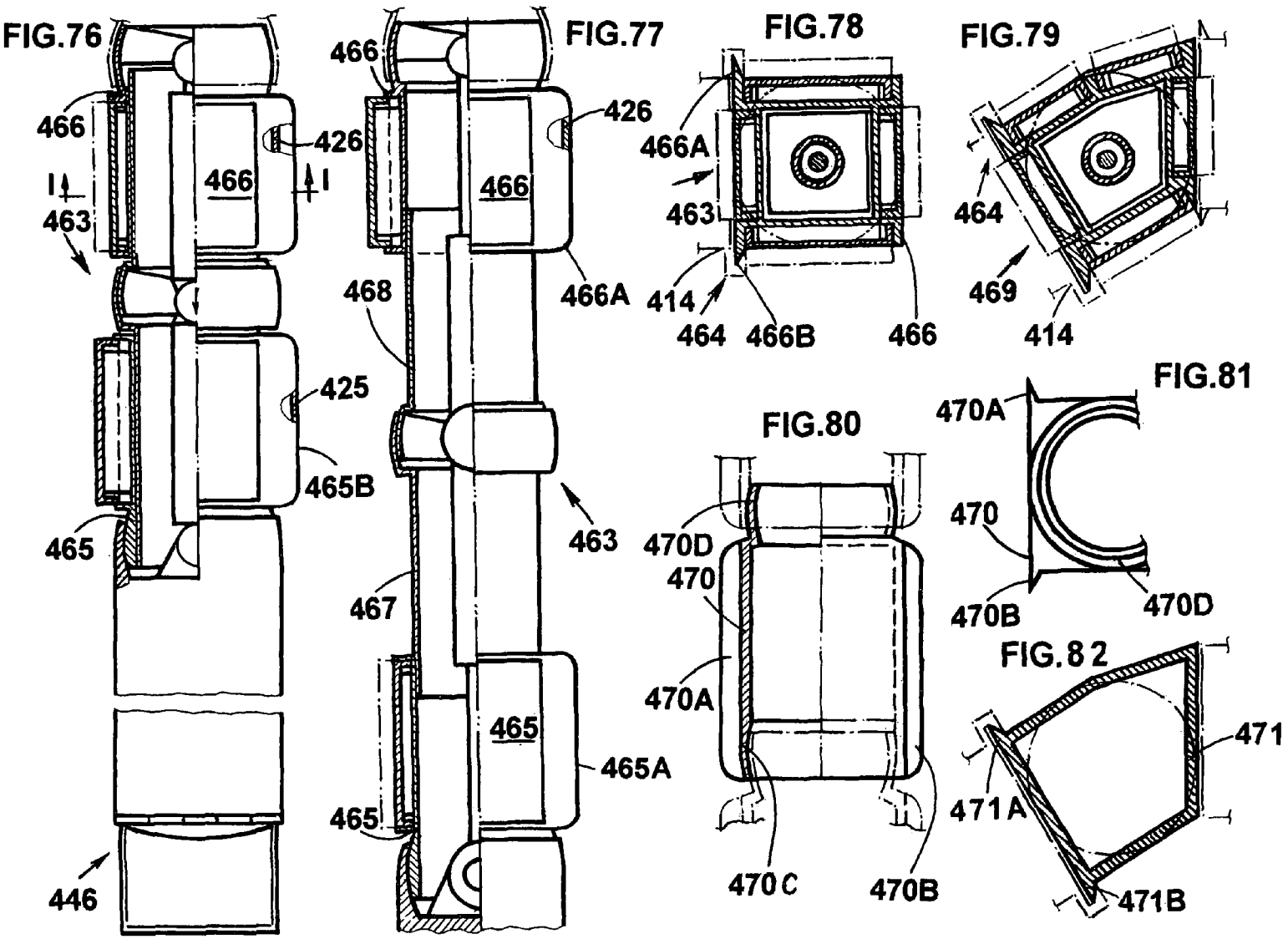
FIGS. 76 and 77 are side and partly longitudinal axial sectional views of the preferred embodiment 463 of the urging motive link groups 418A and 418B in FIGS. 59 and 60 that are assembled with the multiwedge-shaped cutter 446 in FIGS. 69 and 70 according to the invention.
FIG. 78 is a cross-sectional view of one of the urging groups 463 shown by arrows 1-1 in FIG. 76.
FIG. 79 is a preferred cross-sectional view of urging groups like the groups 463 shown in FIG. 76 that are adapted to be assembled into any of the forming means 406 to 408 for constructing a structure section located in the vertex of an angle of divergence of the structure line.
FIGS. 80 and 81 are side and partly longitudinal and cross-sectional views of the preferred embodiment 470 of the urged motive link 411' in FIG. 57.
FIG. 82 is a preferred cross-sectional view of an urged motive link like the motive link 470 shown in FIGS. 80 and 81 that is adapted to be assembled into any of the forming means 406 to 408 for constructing a structure section located in the vertex of an angle of divergence of the structure line.

In FIG. 78 it is shown the cross-section I-I in FIG. 76 of the links 411'C and 411'D, for example, which are adapted for constructing a cylindrically shaped underground structure 401 and in FIG. 79 it is shown a cross-section of an embodiment 469 of the urging motive link group 418A and 418B in FIGS. 59 and 60 that is adapted for constructing a 30° angle corner-shaping, for example, curvilinear hole section 402' in constructing a curved underground structure 401 having a complicated conformation.

In FIGS. 80 and 81 there are shown side and partly axial sectional views of a rectangular pipe-shaped embodiment 470 of the urged motive link 411'E in FIG. 57 that is provided with longitudinally extending guiding and supporting shelf rail-shaped portions 470A and 470B and hinge-forming end portions 470C and 471D. In FIG. 82 it is shown a cross-sectional view of an analogous pipe-shaped and corner-shaping embodiment 471 of the urged link 411'E for forming corner-shaping hole sections 402' in constructing corner-shaping sections 401' of the structure 401, that comprises shelf rail portions 471A and 471B.

Figures 83, 84, 85:
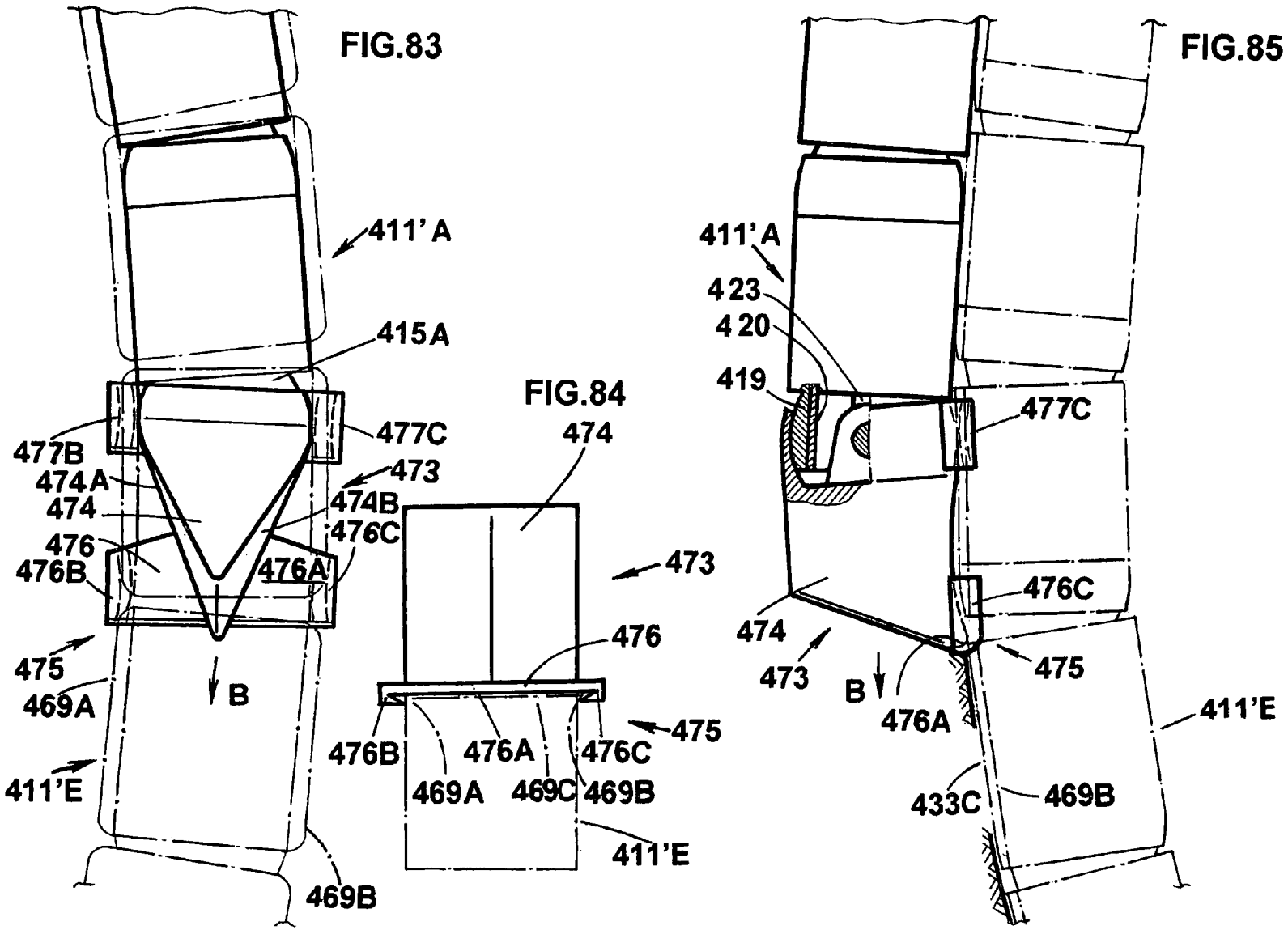
FIGS. 83 to 85 are front, side and partly axial views of the preferred wedge-shaped embodiment 473 of the guided making means 412B in FIG. 57 and the directing means 475 according to the invention.

In FIG. 83 to FIG. 85 there it is shown a wedge-shaped embodiment 473 of the guided making means 412B in FIG. 57, that comprises a wedge-shaped cutter 474 which has forward oriented, relative to the advancing direction B, wedge-shaping portions 474A and 474B forming the cutting angle equal to about 30-90°, 60° being preferable, and the tool angle of sharpness equal to about 30-60°, 45-60° being preferable, that are supported frontally by the front end of the link 411'A with the hinge 415A. The cutter 474 is provided with an embodiment 475 of the directing means 414 in FIG. 57 that comprises a front directing blade 476 which is secured on and perpendicularly to the rear oriented, relative to the advancing direction A in FIG. 57, portion of the cutting edge 474A and a rear, relative to the advancing direction B, directing blade 477 which is secured on the rear oriented, relative to the direction A, portion 474B. Each of the blades 476 and 477 has a respective rear oriented broad directing portion 476A and 477A (latter not shown) for leaning against and sliding along forward oriented, relative to the direction A, guiding and supporting walls of the motive links 411'E, such as the wall 470C which is shown in FIG. 81 and directing and hook-shaping end portions 476B and 476C, 477B and 477C for sliding engagement with guiding and supporting portions 470A and 470B of the link 471.

In operation, the winch 409B when is located with its wire 409C engaged with the front portion of the forming means 408 and supplied with motive power to move the forming means 408 and thereby urge the directing blades 476 and 477 with the cutter 474 at a working position above the ground level toward the upper link 411'E of the forming means 407 being in the formed hole section 402' so that their directing hook portions 476B and 476C, 477B and 477C and the conjugated guiding and supporting rail portions 471A and 471B of the link 411'E mate to engage movingly the forming means 408 and the forming means 407 together for relative movement in the directions B and C.

In constructing an underground complicate or double-curved multisectional structure 401, such as a paling-shaped stratum and wall, or a holes-bunch-shaped air or drain trunk by the use of the apparatus 400 constructed described above, first an excavation 478, such as a hole or pit or trench having a predetermined depth and width that is equal to the width of the motive means 411 is dug in the ground 403 at a position where the underground structure 401 is to be formed by means of a known ground excavator (not shown).

Figures 86A, 86B, 86C, 86D, 86E, 86F, 86G, 87A, 87B, 87C, 87D, 87E, 87F, 87G, 88A, 88B, 88C, 88D, 88E, 88F, 88G, 88H, 88I:
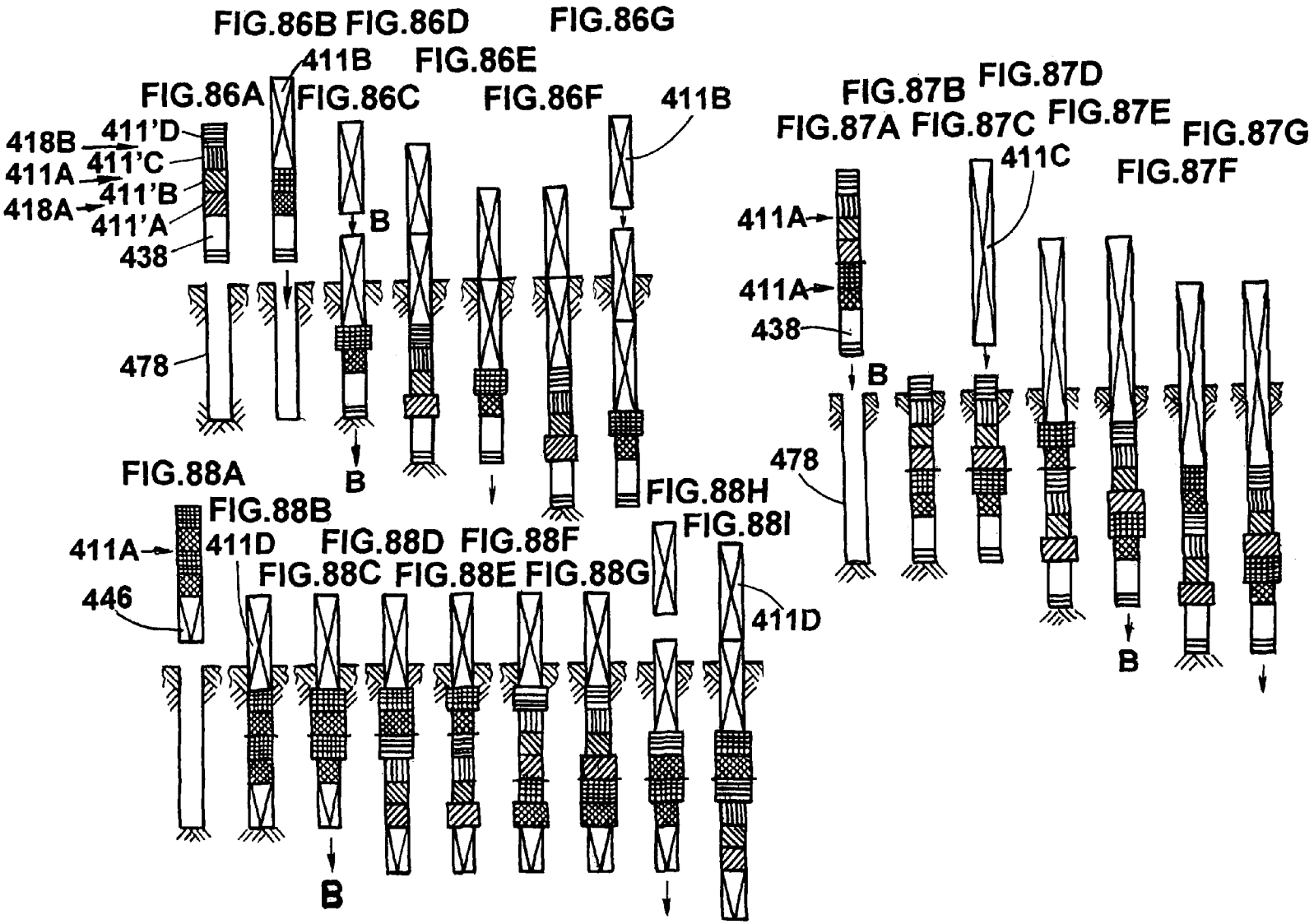
FIGS. 86A, 86B, 86C, 86D, 86E, 86F and 86G are views illustrating the steps of the method of inserting into the ground the end mill cutter means 438 and the urging motive link set 411A in FIG. 57 according to the invention.
FIGS. 87A, 87B, 87C, 87D, 87E, 87F and 87G are views illustrating the steps of the method of inserting into the ground the end mill cutter means 438 and the constant long tandem of two urging motive link set 411A in FIGS. 57, 76 and 77 according to the invention.
FIGS. 88A, 88B, 88C, 88D, 88E, 88F, 88G and 88H are views illustrating the steps of the method of inserting into the ground the multiwedge-shaped cutter means 446 or 452 or 459 in FIGS. 69 to 72 and 75 and two urging motive link set 411A in FIGS. 57, 76 and 77 according to the invention.

In a first preferred way, the pile driver 409 assembles in consecutive order the directing making means 412A, such as the end mill cutter 438, the urging link set 411A shown in FIGS. 59, 60 and 63 and composed of the telescopic group 418A of the link 411'A shown in FIG. 86A by signs /// and the link 411'B shown by mirror symmetrical signs relative to the previous signs and being moved relatively by the ram 423 and the telescopic group 418B of the link 411'C shown by signs III and the link 411'D shown by signs = and _ being moved relatively by the ram 424, where the rams 423 and 424 are shown as extended and then shortened and the links 411'A and 411'B, 411'C and 411'D are shown as combined in pairs and an urged motive set 411B of the links 411'E (shown in FIG. 86B). This assembly is inserted by the winch 409A into the excavation 478 (see FIG. 86C) so that the wall-supporting members 425 and 426 are adjacent to the excavation walls. Thereafter, the mill cutter means 438 is driven by means of the hydraulic motor supplied with pressure fluid in the directions F and G shown in FIGS. 68A and 68E, the hydraulic tubs 428 of the link 411'D which is stationary are supplied with pressure fluid to expand and thereby urge the members 425 and 426 to expand into compressive engagement with the walls (see above) and the rams 423 and 424 also are supplied with pressure fluid to extend and thereby urge the making means 438 and the links 411'B and 411'C with the link 411'A in the advancing direction B with the force equal up to about 10 tons (above described) while the members 426 are adjacent to the side only walls of the trench or up to 25 tons while the members 426 are adjacent to the surrounded walls of the hole to penetrate the facial wall of and advance the hole section 402' by aid of the cutter 438 which can be connected to the any suitable supplying means and supplied with a mud solution or a wash liquid for a wet drilling the ground 403 and with pressured air so that the debris material excavated by the penetration the facial wall with the cutter 438 that can be removed and lifted by the aid of any suitable appliance located above the ground level. Then (see FIG. 86D) the next urged motive set 411B is assembled and connected to the previous set 411B by the pile driver 409 and the tubs 428 of the link 411'D release pressure fluid to shrink and thereby release the members 426 out of compressive engagement with the side walls and the tubs 427 of the stopped link 411'A are supplied with pressure fluid to expand and then the rams 423 and 424 are supplied with pressure fluid to shorten and thereby urge the links 411'B and 411'C and the set 411B with the link 411'D in the advancing direction B. The operations are repeated (shown in FIGS. 86E and 86F), while the further urged motive set 411B is assembled and connected to the previous set 411B by the pile driver 409 (shown in FIG. 86G).

In FIGS. 87A to 87G there are shown a second preferred way using an urging portion of the motive means 411 of the two assembled tandem urging motive link sets 411A of a constant total length, where the rams 423 and 424 of the front set 411A are shortened and the rams 423 and 424 of the next set 411A are extended, for example (shown in FIG. 87A). The pile driver 409 assembles and inserts this assembly into the excavation 478 (shown in FIG. 87B) and then assembles a following urged portion 411C of the motive means 411 to the second set 411A and thereafter the tubs 428 of the front set 411A and the tubs 427 of the second set 411A that are stationary are supplied with pressure fluid to expand (shown in FIG. 87C) and then the rams 423 and 424 of the front set 411A are supplied with pressure fluid to extend and thereby urge the links 411'B and 411'C with the link 411'A in the direction B and the rams 423 and 424 of the second set 411A are also supplied with pressure fluid to shortened and thereby urge links 411'B and 411'C with the link 411'D in the direction B (see FIG. 87D). Then the tubs 427 of the front set 411A and the tubs 428 of the second set 411A which are stationary are supplied with pressure fluid to expand (see FIG. 87D), the rams 423 and 424 of the front set 411A are supplied with pressure fluid to extend and thereby urge the making means 438 and the links 411'B and 411'C with the link 411'A in the direction B and the rams 423 and 424 of the second set 411A also are supplied with pressure fluid to shorten and thereby urge the links 411'B and 411'C with the link 411'D in the direction B (shown in FIG. 87E) and the operations are repeated.

FIGS. 88A to 88I there are shown the steps of advancement of the forming means 406 to 408 which are provided with the wedge-shaped cutter 446 demanded a great pushing force which being applied by the motive means 411. The pile driver 409 assembles the cutter 446 and the tandem of two, for example, motive urging sets 411A where the rams 423 and 424 of the both sets 411A are shortened and a set 411D of the urged motive links 411'E and inserts this assembly into the excavation 478 (see FIGS. 88A and 88B). Then the tubs 428 of the stationary front set 411A and the tubs 427 and 428 of the stationary second set 411A that are supplied with pressure fluid to expand and then the rams 423 and 424 of the front set 411A are supplied with pressure fluid to extend and thereby urge the cutter 446 and the links 411'B and 411'C with the link 411'A and with the pushing force equal up to about 30 or 75 tons (see above) to penetrate the bottom of the excavation 478 and advance the hole 402' in the direction B (see FIG. 88D). Then the tubs 428 of the front set 411A and the tubs 427 of the second set 411A release pressure fluid and the respective members 426 and 425 out of compressive engagement with the walls, the tubs 427 of the front set 411A are supplied with pressure fluid to expand and the rams 423 and 424 of the front set 411A are supplied with pressure fluid to shorten and thereby urge the links 411'B and 411'C with the link 411'D in the direction B and with the force which is equal up to about 15 or 25 tons relative to the front link 411'A and simultaneously the rams 423 and 424 of the second set 411A are supplied with pressure fluid to extend and thereby urge the links 411'B and 411'C with the link 411'A of the second set 411A in the direction B and with the pushing force which is also equal to about 15 or 25 tons. Then (see FIGS. 88E and 88F) the tubs 427 of the stopped front set 411A are supplied with pressure fluid to expand and the rams 423 and 424 of the front set 411A are supplied with pressure fluid to shorten and thereby urge the links 411B and 411C with the link 411'D in the direction B and then the rams 423 and 424 of the second set 411A are simultaneously supplied with pressure fluid to expand and thereby urge the links 411'B and 411"C with the link 411'A in the direction B. Then the tubs 428 of the second set 411A release pressure fluid to shrink and the tubs 428 of the front set 411A and the tubs 427 of the second set 411A are supplied with pressure fluid to extend and then the rams 423 and 424 of the second set 411A are supplied with the pressure fluid to shorten and thereby urge the links 411'B and 411'C of the second set 411A in the direction B. Thereafter the pile driver 409 assembles a next urged portion 411D of the motive means 411 to the previous portion 411D so that the both sets 411A are ready for the same further operative cycles (see FIGS. 88H and 88I). The operative cycles of advancing the excavated hole sections 402' in these ways are carried out repeatedly up to the predetermined depth or distance as part of an overall sequence involving the advancing of the forming means 406 to 408.

A method for continuous advancement of a section of a hole excavation by means of the forming means 406, for instance, the method comprises the following steps:

operating the rams 423 and 424 (see FIGS. 59, 60) to effect longitudinal movement between the motive means 411 and each of the stopped and immobilized support members 425 and 426 to advance the motive means 411 at a speed, V1, where the speed must be equal to an intended speed of advancement of the making cutter 431 with the motive means 411 to cause the forming means 406 to decrease the traction relative and overturning moment about the tractor 404;

operating the rams 423 and 424 to effect the alternate longitudinal uninterruptible advancement of the support members 425 and 426, n, with the same preferably distances and speeds, V2, relative to the motive means 411 and V3, relative to the ground, where the speeds must be equal to no less than about $V2=(0.5\ n-1)\times V1$, and $V3=0.5\ n\times V1$. The same cycles are repeated until the entire predetermined length of the excavation is passed by the forming means 406 being continuously advanced.

For the returning movement of the forming means 408, for instance, the speed V1 must be equal to an intended speed of emptying of the hole sections and simultaneously feeding into and laying the materials in the emptied sections.

Such apparatuses must act accordingly to the present invention and form in the ground in situ cut off and impervious and retaining, conical- or cylindrical- or pyramid-shaped barriers or curtains or wall of a thickness of from 0.2 to 1.0 meters and more (0.3 meter mainly) and of the depth of from 10 to 100 meters and more, and flat-lying and water-draining or impervious stratums and trough-shaped layers of the such dimensions. The forming means of such apparatus can have several shapes, such as a prism or a chain of the prisms or a circular cylindrical arched plank or triangular dagger or conjugated parts of helical surface. The prismatic forming means can move in the ground at a desired angle to the horizontal plane from 30° to 150° while an apparatus is advanced above the ground level, and at an angle from 0° to 150° when it is advancing above the ground level and near and along a slope's foot, and at any desired angle when it is advancing underground. The excavation-making means of the forming means are interchangeable depending on mechanical characteristics of the ground and have conventional forms, such as a wedge-shaped knife or endless chain cutter or drill cutter or a shearer mounted to a front end of the motive frame means and forced toward and backward by the motive member relative to side wall-supporting members, acting by the aid of conventional activating and drive means such as hydraulic cylinder and piston units, and using well-known drilling fluids and pressured air lifting. Urging the wall-forming means into the ground and out of a formed hole section can be carried out by forcing the forming means forward and backward relative to its hole walls-supporting members in the continuous uninterrupteable manner and in an interrupted step-by-step manner while using conventional methods for feeding of a material of the proposed structure into the hole section being emptied. In one's capacity as a material of the proposed impervious screen and wall can be used waterproof sealing materials, such as a clay-cement mortar, and as a material of underground drainage stratums and walls water-permeable materials, such as metal, sand and gravels can be used. The extensible forming means can be assembled from separate spare units which are connected for relative movement about connecting axes between and disassembled by a conventional appropriate pile driver which is mounted on any movable and power- and material-supplying chassis means, such as a towed trailer and trolley, a flat-car, a truck provided with conventional means for remote controlling the activating and drive means and a means for preparation and feeding the drilling and sealing materials.

We claim as our invention:

1. An apparatus for digging a curvilinear and steeply extending slit and slot hole-shaped excavation when constructing an underground filling wall and stratum structure, the apparatus comprising:

a supporting framework means disposed over the ground to produce the hole along a hole line;

an elongate, longitudinally displaceable, curvilinear hole-forming means adapted to be disposed in working positions and extended into the ground from the framework means up to a predetermined depth in an advancing direction to excavate, form and support side walls of excavated curved sections of the hole being formed along the length of the line, and to be displaced out of the hole, the forming means comprising:

a curvilinear hole-forming motive frame means for supporting components of the forming means, that is capable of being curved and has a front, in relation to the advancing direction, end portion oriented in the advancing direction, and the other rear end portion which being supported and guided by the framework means for movement in the directions;

a cutter means for making excavated curvilinear sections of the hole,_the cutter means being supported from ahead on a front end of the front portion and defining at least a substantially horizontal cutting front against an oriented in the advancing direction facial wall of the front hole section, wherein the cutting front being ahead of and perpendicular to the front end portion;

wherein the cutter means has the ability of modifying the line by causing the cutting front and the working facial wall to pivot about a horizontal axis, the axis crossing a central longitudinal axis of the front end portion, relative to a portion of the motive means that being adjacent to the front end portion; and wherein the cutter means has the ability to pivot relative to the adjacent portion; and wherein the forming means comprises activating drive means engaged between the cutter means and the front end portion so that operating the activating drive means causes the cutter means and the front end portion to pivot relative to the adjacent portion of the motive means.

2. The apparatus according to claim 1, wherein the motive means comprises a number of short motive link members, and the making means and the follower link members are connected in consecutive order, relative to the advancing and emptying directions, for movement about connecting axes on a central longitudinal surface of the adjacent members and perpendicular to the direction of advancement of the members to form an articulated forming means.

3. The apparatus according to claim 2, wherein the hole-making and directing cutter means comprises a number of hole-making and directing cutter members, where each of the making and directing cutter members that is capable of urging the front end link member to pivot about the front connecting axis in lateral directions and has excavation-making and directing portions for forcing the facial wall in directions opposite to the diverged sections of the line, where the cutting and directing portions are operable to move the forming means in the intended diverged directions by an activating guide means engaged between the front member and the making and directing members and capable of forcing the cutting and directing portions against the wall in the opposite directions, wherein the making and directing cutting portions are capable of forming the side walls and are operated by the activating drive means to pivot the follower members about the connecting axes in order to move the members along the length of the curvilinear line.

4. An apparatus for excavating a hole when constructing an underground, steeply extending, filling pile-shaped wall and stratum structure, the apparatus comprising:

a connecting framework means disposed over the ground to produce the hole;

an elongate, hole-forming means adapted to extend into the ground in an advancing direction to form a hole and to extract out of the hole, and having:

a longitudinally displaceable elongate motive frame means extending from the framework means and having a rear, in relation to a direction of advancement of the hole, end portion supported and guided by the framework means for movements in the directions, and a front end oriented in the advancing direction;

wherein a chain driving wheel is disposed on the front end; and an elongate guide frame member is disposed substantially horizontally and extending at ahead, in relation to the advancing direction, of the chain driving wheel and perpendicularly to a central longitudinal axis of the front end and supported from above by the front end and having side ends disposed ahead of the front end; and an elongate shaft is disposed rotatable on the side end; and a chain sprocket is disposed on the shaft accordingly to the chain driving wheel, and a chain sprocket is rotatably connected to the other side end; and an endless chain is extending around the chain driving wheel and the chain sprockets and a number of cutter bits are arranged on the endless chain to form an end endless chain cutter defining a substantially horizontal cutting front against an oriented in the advancing direction facial wall of the hole; and a number of lateral chain sprockets are disposed on the shaft adjacently to the chain sprocket and the number of lateral chain sprockets are connected to the other side end adjacently from aside to the chain sprocket and below the chain driving wheel, and the number of endless chains provided with a number of cutter bits that are extending around of the lateral chain sprockets to form the number of lateral endless chain cutters disposed adjacently in side-by-side order, in relation to the endless chain cutter, and below the chain driving wheel and extending substantially horizontally and perpendicularly to the axis and the advancing direction and defining a substantially horizontal cutting front against a front facial wall of the hole being excavated;

where an activating drive means is engaged between the front end and the chain driving wheel for effecting relative movement between the endless chains and the guide member to effect advancement of the hole; and where a number of injection pipes and a number of removal pipes are extending from the framework means into the motive member and the guide member and having branched remote injection and removal ends, wherein the injection ends opening at incoming ends of the endless chain cutters and the removal ends opening at unloading ends of the endless chain cutters.

5. The apparatus according to claim 4, wherein the chain sprockets are capable to be exchanged into chain driving wheels supported on a common shaft.

6. The apparatus according to claim 4, wherein the lateral endless chain cutters have a number of cutter and director bits arranged on the lateral endless chains to form a guidable multiple end chain cutter means of a multiple end chain forming means.

7. The apparatus according to claim 4, wherein the multiple end chain cutter means and follower motive frame link members are connected in consecutive order, relative to the direction, for pivoting about connecting axes on the central longitudinal surface of the adjacent link members and parallel to the cutting front with the ability to interact with side walls of the curvilinear excavated section to urge the members to pivot in the lateral directions about the connecting axes in the formation and emptying of the curvilinear section.

8. The apparatus according to claim 7, wherein the multiple end chain forming means comprises a guide means situated in the end chain cutter means and capable of modifying the hole line by causing the cutting front to pivot in the substantially vertical plane relative to the follower members;

wherein the direct able end chain cutter means is capable of pivoting relative to the follower members; and wherein the guide means comprises a number of activating drive means engaged between the rear chain driving wheel and the front link member, so that actuating the guide means causes the direct able multiple end chain cutter means to pivot relative to the follower motive link members of the direct able end chain forming means, wherein the making and guiding cutter bits are capable of forming side walls of the hole in a cylindrical shape and are operated by the activating guide means and a propulsion means of the apparatus to pivot the follower link members about the connecting axes in order to move the members along the length of the hole line.

9. An apparatus for digging a hole-shaped excavation when constructing an underground, steeply extending, filling pile-shaped wall and stratum structure, the apparatus comprising:

a connecting framework means disposed over the ground to produce the hole;

a hole-forming means adapted to extend in an advancing direction into the ground from the framework means having a means supporting a rear, in relation to the direction, portion of the forming means for movement forward and to extracting backward and out of the hole toward the framework means; the forming means comprising:

an elongate, hole-forming motive frame means having a front, in relation to the advancing direction, portion oriented in the direction and a rear portion which being supported by the framework means for the movements;

a saddle frame means supported from beneath on a front end of the front end portion and provided with a means for reciprocation of the saddle means in horizontal directions which being parallel to the surface of the front portion;

a number of circular cylindrical barrel members having pluralities of cutter bits and a number of cutter blades arranged on circular cylindrical facial shell portions of the barrels to form a multiple end barrel cutter means defining a substantially horizontal cutting front against the oriented in the advancing direction facial wall of the hole, and central axes disposed parallel to the directions of reciprocation and in end-to-end and side-by-side order, and supported on the saddle means for movement about and along the central axes, and multiple activating drive means for effecting relative movement between the framework means and the motive frame means, relative axial movement between the saddle means and the front end portion of the motive means, and rotary movement of the barrel cutter members to effect advancement of the hole;

wherein the multiple end barrel forming means comprises a number of injection pipes and a number of removal pipes extending from the framework means into the frame means and having branched remote ends opening at the barrel members.

10. The apparatus according to claim 9, wherein each of the barrel members that has at least one piston-shaped end wall portion capable of engaging slidingly with a working end facial wall of the hole and with the saddle means, and the pipes are provided with check valves opening for injecting and removal flows and closing for opposite flows to form a multiple end pump barrel cutter, so that the piston portions alternately suck a drilling fluid from the injection pipes into the section and compress a mixture of the excavated ground and the fluid from the hole section being formed into the removal pipes as the pumping barrel cutter is advanced.

11. The apparatus according to claim 9, wherein the elongate motive frame means is composed of a plurality of short, relative to the frame means, motive frame link members, and the multiple end barrel cutter means and the plurality of the link members are connected in consecutive order, in relation to the advancing and emptying directions, for movement about connecting axes crossing perpendicularly the central longitudinal axis of the adjacent link members to form a multiple end barrel articulate forming means.

12. The apparatus according to claim 11, wherein each of the some barrel members that has a number of the cutter bits and a number of director bits alternately arranged on the barrel member to form a directable multiple end barrel cutter means of a directable multiple end barrel articulated forming means; and wherein the directable multiple end barrel cutter means further comprises a guide means capable of modifying the line by causing the cutting front to pivot about the front horizontal axis relative to the link member which being adjacent to the front end link member; and wherein the multiple barrel cutter means is capable of pivoting the front link member about the front connecting axis and relative to the adjacent link member; and wherein the guide means comprise the plurality of the activating drive means engaged between the barrel shafts and the saddle means, so that actuating the activating guide means causes the multiple barrel cutter means to pivot about the front connecting axis and relative to the adjacent link member.

13. An apparatus for drilling a steeply extending curvilinear hole-shaped excavation when constructing an underground filling pile-shaped structure, the apparatus comprises:

a connecting framework means disposed over the ground to produce the hole in the ground;

an elongate, longitudinally displaceable, hole-forming drilling means adapted to be disposed in working positions and extended into the ground from the framework means up to a predetermined depth in intended advancing directions to excavate and form side walls of an excavated section of the hole that being formed along a hole line, and to be extracted out of the hole toward the framework means, and comprising:

an elongate, longitudinally displaceable motive frame means supporting components of the drilling forming means and being composed of a number of short, relative to the elongate motive means, motive link members connected in consecutive order, relative to the advancing and returning directions, for movement about connecting central_points crossing perpendicularly a central longitudinal axis of the motive means between the adjacent link members and having the rear end link members supported and guided by the framework means for movements in the directions, and the front end link member oriented in the advancing direction and having the front end:

a multiple end cutter means disposed on the front end and comprising a central facial end cutter member and a plurality of lateral facial end cutter members supported for rotation about central axes, the axes being parallel to a central longitudinal axis of the front member, and having numbers of cutter bits arranged on facial portions of the cutter members defining a cutting front which being substantially perpendicular to the axis of the front member;

multiple activating drive means engaged between the front end link member of the motive means and the end cutter members for effecting rotation of the cutter members about the longitudinal axes to effect advancement of the hole while a propulsion means of the apparatus that is effecting advancement of the motive means and the multiple end cutter means also to effect advancement of the hole; and an injection pipe and a removal pipe extending from the framework means into the motive means and having branched ends which being remote from the framework means and opening at the end cutter members;

wherein the lateral end cutter members are disposed behind closely the central cutter member, and the lateral axes are crossing the central member, and segmental portions of the lateral members that are protruded aside of the central member;

wherein the multiple end cutter means comprises a guide means for modifying the hole line by causing the cutting front which being perpendicular to the axis of the front end link member, to pivot in any intended planes crossing the front connecting axis about the front central point and relative to the link member of the motive means that being adjacent to the front member;

wherein the multiple end cutter means and the front end link member are capable to pivot relative to the adjacent link member of the motive means;

wherein the guide means comprise the multiple activating drive means engaged between the front end link member and each of the lateral end members of the multiple end cutter means of the forming means, so that actuating the intended drive means causes the multiple end cutter means to pivot in the intended direction relative to the adjacent link member of the forming means and where the multiple drive means capable of effecting separate rotation of the end members in intended directions, and the protruded excavation-directing cutting portions of the directing outer end members that force the outer sections of the facial wall in the crossing directions and the protruded excavation-directing cutting portions of the directing outer end members that force the outer sections of the facial wall in the crossing directions and move the front end member, with the directing end cutter members, relative to the facial portions of the wall being forced, about the front central point toward the diverged laterally advancing direction as the front member is advanced.

14. An apparatus for forming a curvilinear slit hole-shaped excavation when constructing an underground, filling pile-shaped structure, the apparatus comprising:

a connecting framework means disposed over the ground to produce the hole in the ground;

an elongate, longitudinally displaceable, curvilinear slit hole-forming, solid wedge articulated forming means adapted to be extended into the ground from the framework means and to be extracted out of the excavated hole toward the framework means, supported on the framework means for longitudinal movement and comprising:

a motive frame means for supporting components of the forming means for the movements, the motive means is composed of a plurality of short, in relation to the elongate motive means, motive frame link members that are connected in consecutive order, in relation to the directions, for movement about connecting points on a central longitudinal axis of the adjacent link members and perpendicular to the directions, where the rear, in relation to the advancing direction, end link member being supported and guided by the framework means for longitudinal movement;

a curvilinear slit hole-making, angular solid wedge cutter member supported on a front end of the front link member for lateral pivoting about a wedge connecting center point, the wedge connecting points being on the central longitudinal axes of the angular wedge member and the front link member, to form an angular solid wedge articulated forming means, and defining a cutting front against the oriented in the advancing direction facial wall of the hole being formed, the front being perpendicular to the axis of the wedge member and capable to be oriented substantially in a plurality of advancing directions along the line;

wherein the wedge forming means comprises a guide means disposed in the wedge member and the front member for modifying the hole line by causing the cutting front to pivot in any intended planes and lateral directions about the corresponding front connecting axes relative to the adjacent link member; and wherein the wedge member and the front link member of the forming means are capable to pivot relative to the adjacent link member of the motive means, and wherein the guide means comprises activating drive means engaged between the wedge and front members, so that actuating the activating drive means causes the wedge member and the front member to pivot relative to the adjacent member of the motive means; and a propulsion means situated on an underground portion of the motive means for effecting movement of the wedge forming means relative to the side walls of the sections, wherein the propulsion means are capable to effect pivoting of the wedge means and the follower link members about the connecting points in order to move the articulated wedge forming means along the length of the curvilinear sections of the line and advance and empty the hole.

15. An apparatus for forming a curvilinear slit hole-shaped excavation when constructing an underground wall and stratum structure, the apparatus comprising:

a connecting framework means adapted to be over the ground to produce the slit hole which is extended in a direction in the ground;

an elongate, longitudinally displaceable, curvilinear slit hole-making motive frame means adapted to be extended from the framework means into the hole to form sections of the hole and to be extracted out of the excavated sections, and composed of connected in consecutive order, relative to the direction, a front end motive frame link member having an oriented forward front end, and a number of follower motive frame link members ended with the rear link member supported by the framework means for movement in the directions, where the link members are supported for movement about a plurality of substantial connecting points on a central longitudinal axis of the adjacent link members;

an elongate wedge cutter means for making curvilinear slit sections of the hole at ahead of the end, the wedge means is supported on the front end and defining the oriented in the advancing direction facial wall of the hole, the facial wall being substantially perpendicular to the axis of the end member that being capable to be oriented in any intended advancing directions;

wherein the wedge means comprises a plurality of longitudinally displaceable along the central axis, one-sided wedge cutter members having an outer, relative to the central axis, triangular side portion with a vertex which being on the central axis, and disposed adjacently in mirror symmetrical order around the central axis to form a multiple one-sided wedge means; and wherein the multiple one-sided wedge cutter means comprises the plurality of guide means disposed in the front end link member and the one-sided wedge cutter means for modifying the hole line by causing the cutting front which being perpendicular to the central axis of the front link member and capable to be pivoted in any one of planes crossing the front connecting point and about the front point and relative to a motive frame link member adjacent to the front member, wherein the one-sided wedge means and the front end member are capable to pivot relative to the adjacent member of the motive means, and wherein the guide means comprise the plurality of activating drive means engaged between each of the wedge members and the front end member of the forming means, so that operating the activating drive means causes the wedge means and the front end member to pivot about the front point and relative to the adjacent member of the motive means;

a propulsion means disposed on an underground portion of the motive means for effecting movement of the multiple one-sided wedge forming means relative to the side walls to effect advancement and emptying of the hole.

16. The apparatus according to claim 15, wherein the activating drive means are capable of effecting alternate forward and rearward movement of the one-sided wedge members relative to the front end member to effect advancement in turn of adjacent in side-by-side manner slit sections of the excavation.

17. The apparatus according to claim 15, wherein the excavation-making and directing double one-sided wedge cutter means and follower link members of the motive frame means that are connected in consecutive order, in relation to the advancing and emptying directions, for movement about connecting axes, the connecting axes being on the central longitudinal surface of the adjacent link members and substantially perpendicular to the directions of advancement of the members and wherein the double one-sided wedge cutter means and the front end link member comprise a guide means for modifying the hole line by causing the cutting front to pivot about the front connecting axis, the connecting axis being substantially perpendicular to the direction of advancement of the excavation, relative to the link member which being adjacent to the front end link member of the double one-sided wedge means;

wherein the double one-sided wedge means is capable of pivoting relative to the adjacent link member about the front connecting axis;

wherein the guide means comprise activating drive means of the cutter means and the propulsion means which cause the one-sided wedge members to pivot about the front connecting axis and relative to the adjacent member.

18. The apparatus according to claim 17, wherein the double one-sided wedge means comprises a guide means for modifying the line by causing the cutting front to pivot in a plane, the plane being perpendicular to the connecting axes about the front connecting axis and relative to the link member which being adjacent to the front member of the double one-sided wedge articulated forming means;

wherein the double one-sided wedge means is capable of be pivoted relative to the adjacent member about the connecting axis which being between the front link member and the adjacent member;

wherein the guide means comprise activating drive means and the propulsion means cause the one-sided wedge members to pivot relative to the adjacent member of the double one-sided wedge articulated forming means;

wherein the making and directing cutting one-sided portions are capable of forming the cylindrical side walls and are operated by the activating guide means and the propulsion means to pivot the follower members about the connecting axes in order to move the members along the length of the line.

19. An apparatus for forming a curvilinear slit hole-shaped excavation when constructing an underground wall and stratum structure, the apparatus comprising:

a supporting framework means adapted to be over the ground to produce the hole and the structure in the hole;

a steeply disposed, slit hole-forming motive frame means adapted to extend downward into the ground from the framework means and having a rear, in relation to an advancing direction, portion supported on the framework means for movement in the directions;

a slit hole-making, two-sided wedge cutter member defining a horizontal cutting front;

where the wedge member and follower motive frame link members are connected in consecutive order, in relation to the advancing direction, for pivoting about connecting axes, the connecting axes being on the central longitudinal surface of the adjacent link members and transverse to the direction of advancement of the members and at least substantially horizontal, with the ability to interact with side walls of the hole to urge the members to pivot about the axes in the lateral directions in formation of the excavated section, where the making and directing cutting portions are capable deforming the ground to form the side walls in a cylindrical shape;

a propulsion means engaged with the frame means for effecting movement of the wedge cutter to effect advancement of the slit hole;

a guide means situated between the wedge member and the front link member for modifying the advancing direction by causing the cutting front to pivot about the front connecting axis and relative to the link member adjacent to the front member and comprising activating drive means engaged between the wedge member and the front member, so that actuating the activating guide means causes the wedge member to pivot about the front axis and relative to the adjacent member of the two-sided wedge articulated forming means.

20. The apparatus according to claim 19, wherein the activating guide means comprises a hydraulic cylinder and piston unit with the longitudinally, in relation to the front connecting axis, displaceable output rod including oppositely disposed, castellated portions leaning on corresponding castellated bearings of the front link member for longitudinal displacement and engaging screw-shaped splined portions capable of interacting with corresponding engaged screw-shaped splined portions of the wedge member.

21. An apparatus for forming a trench-shaped excavation of a plurality of adjacent, steeply excavated holes when constructing an underground, horizontally extending, piling wall and stratum structure, the apparatus comprises:

a supporting chassis means adapted to be alternately advanced in a direction over the ground and stopped in turn at the plurality of stop points where the holes are to be produced;

a connecting framework means adapted to be transported by the chassis means in the direction over the ground to produce the trench;

a trench-forming means comprising:

a first hole-forming and guiding means; and a number of predetermined, directed, next hole-forming means adapted to form in turn a number of the next adjacent holes, and a next hole-guiding means;

where each of the hole-forming means comprises:

a cutter means for making the hole, and a hole-forming motive means for supporting components of the forming means, and the guide means having:

a forward oriented, in relation to the trench-advancing direction, aisle means extending from the framework means along the motive means for causing the next in turn, next hole-forming means to advance a next front, in relation to the trench-advancing direction, hole of the trench closely to the last rear formed hole of the trench; and a guiding tenon means which being supported on a front end, in relation to the hole-advancing direction, and backward oriented, in relation to the trench-advancing direction, edge portion of the motive means of each of the next in turn hole-forming means for moving engagement with the aisle means of the adjacent from behind hole-forming means, and comprising a tenon member displaceable into and along the length and out of the aisle means, wherein the tenon member being capable to be displaced out of the aisle means substantially in the trench by an activating drive means of the apparatus that is capable of effecting relative movement between the aisle means and the tenon member to effect disengagement of the rear forming means and the front forming means in the trench and ease of the movement of the rear forming means relative to the front forming means and out of the trench.

22. The apparatus according to claim 21 and comprising methods and instrument means of the geophysical survey for measuring intended physical characteristics of the ground which the first in turn forming means comes across and determining what kinds of the hole-making means, the side wall-supporting means, the directing means, and the materials should be used and when to operate the multiple activating drive means to optimizing effect advancement and emptying and filling of the holes.

23. An apparatus for digging a steeply extending slit and slot hole-shaped excavation when constructing an underground pile-shaped structure in a direction, the apparatus comprising a movable means for digging the excavation in the direction and emptying the excavation in an intended direction and for supporting side walls thereof, the excavation-digging means composed of:

a longitudinally displaceable elongate motive frame member for supporting and guiding components of the forming means;

support means receivable in the excavation to be advanced by the cutting of a front facial wall thereof, where the excavation having a pair of side walls, and the support means including a plurality of wall-supporting and engaging member set means disposed in a predetermined order, and activating means for effecting relative movement between the frame member and the set means to effect advancement and emptying of the excavation;

an excavation-making cutter means adapted to be thrust against the facial wall and to cut away the facial wall from the excavation and supported on a front end of the frame member extending substantially in the directions, and respective activating drive piston-and-cylinder ram means connected between each of the member set means and the frame member and actuatable to force the cutter means against the facial wall, where each of the ram means being actuatable independently of the ram means of the other element means;

wherein each of the plurality of the member set means comprises oppositely disposed, in relation to the frame member, laterally displaceable short members, and wherein the plurality of member set means being disposed in the consecutive order along the directions; and wherein the frame member is extending substantially in the directions and along the length of the order of the set means; and wherein each of the set means that is capable of supporting movingly and guiding the frame member in the excavation and being alternately expanded in opposite lateral directions from the frame member and each of the set means that has an activating drive means for effecting relative lateral movement between the members to effect ease of advancement and emptying of the excavation.

24. The apparatus according to claim 23 for digging a partly hemispherical slit excavation, wherein the motive frame means comprises an acute triangular frame member which having a central circular cylindrical surface about an intended center of curvature of the central cross-section of a predetermined partly hemispherical slit trench of a plurality of the adjacent, acute angular, circular cylindrical slit holes, and a downward-oriented vertex; and where the hole-making cutter means comprises a wedge cutter member extending along the length of a front, in relation to the trench-advancing direction, side edge of the angular motive frame member to form an angular, circularly curved dagger-shaped forming means, and where the dagger-shaped forming means is provided with a propulsion means for causing the dagger-shaped forming means to insert into the ground and extract out of the trench.

25. The apparatus according to claim 23, wherein the number of the activating drive means are capable of effecting simultaneously uninterruptible movements between the frame means and the number of the member set means which are stationary relative to the walls, at the speeds $V_{1,3}$, where the speeds $V_{1,3}$ are the speeds of continuous uniform movements of the frame means relative to the framework means correspondingly in the advancing and the emptying directions to decrease forces which there are needed to apply to the frame means relative to and overturning moment about the framework means and to increase a force of advancement of the cutter means, and where the speeds $V_{1,3}$ of the continuous uniform movement of the frame means relative to the set means are secured by alternate and uninterruptible movement in opposite directions between the frame means and each of the set means alternately approaching the end of the working stroke of the drive means at the same speeds $V_{2,4}$ relative to the frame means, where the speed $V_{2,4}$ in relation to the frame means that must be equal to not less than $(n-1)\times V_{1,3}$, where "n" is the number of the interacting set means.

26. The apparatus according to claim 23, wherein each of the member set means that is with the ability to be expanded and increased outwardly in its volume to decrease the friction resistance of the set means to and easy relative movement of the frame means.

27. The apparatus according to claim 23, wherein the motive frame means comprises:

a plurality of motive frame link members connected in consecutive order, in relation to the advancing and emptying directions, for relative axial telescopic displacement; and activating drive means for effecting relative axial movement between the adjacent link members to effect advancement and emptying of the excavation, each of the member-advancing drive means that being actuatable independently of the other member-advancing drive means.

28. A method for digging a trench-shaped excavation of adjacent slit and slot holes when constructing a steeply and horizontally extending underground piling wall and stratum-structure, the method comprising the following steps of:

operating multiple activating means of an apparatus for digging the trench excavation of a plurality of slit and slot holes, the activating means dispose a framework means of the apparatus that being transportable on a transporting chassis means of the apparatus, at a point where a first in turn hole of the trench is to be dug along a steeply extending hole line, the line being similar in the shape to an intended cross-section of the trench;

operating a propulsion means of the apparatus, the propulsion means inserts a first means for forming the first hole, the first means for forming being part of the apparatus and comprising a motive means for supporting components of the forming means and a cutter means on a front end of the motive means, at a working position into the ground and digs the hole to a predetermined depth in an advancing direction along the line, the motive means comprises a guide aisle means extending from the framework means along the motive means for guiding a next in turn hole-forming means of the apparatus;

operating the activating means to transport the framework means with the chassis means in a trench-advancing direction along a trench line to a next point of crossing of the trench line and a next hole line, where a next hole of the trench is to be dug, and stopping motionless at the next point;

operating the multiple activating means to dispose a next hole-forming means of the apparatus in a working position at the next point;

operating an activating means of the apparatus to connect a guided tenon member for directing advancement of the next hole, the tenon member being part of the apparatus, in a working position to a front end portion, in relation to the hole-advancing direction, of a motive means of the next forming means;

operating the activating means to engage movingly the tenon member with an upper entrance end portion of the aisle;

operating the propulsion means to extend the next forming means forward into the ground so to advance the next front hole, in relation to the trench-advancing direction, jointly in advance to the rear hole formed previously;

operating an activating drive means of the apparatus to displace the tenon member substantially in relation to the front forming means and the rear forming means through an intended exit portion of the aisle means out of the engagement with the aisle means so as to disengage the rear forming means from the front forming means substantially in the trench;

operating the propulsion means to displace the rear forming means out of the trench to empty the rear hole for use.

29. The method according to claim 28 and using the first forming means and comprising the following step of:

exploring intended physical characteristics of the ground comes across and excavated by the first forming means with methods and instrument means of the geophysical survey to determine what kind of the hole-making cutter means should be used, and when to operate the multiple activating means to effect advancement and emptying of the next in turn holes, and when to change the types of cutter means, the motive means and the propulsion means that are workable for the explored characteristics.

30. The method according to claim 29 and comprising the following step of:

choosing an embodiment of the cutter means which is capable of working under the explored conditions from a list of the preferable exchangeable, hole-making embodiments, where each of the embodiments is capable of being supported on the front end of the circular arched motive member and to insert into the ground at ahead of the end, and defining a cutting front which being substantially perpendicular to the central axis of the end, the list including:

a. mill cutter embodiments:

the multiple end chain cutter;

the multiple end-and-face barrel cutter; and b. wedge cutter embodiments provided with the propulsion means for causing the wedge-shaped, hole-forming means of the apparatus to displace in the ground:

the wedge dagger-shaped cutter;

the double one-sided wedge cutter;

the multiple one-sided wedge cutter.

31. The method according to claim 30, and using the multiple one-sided wedge cutter means and comprising following steps of:

digging a slot section of the hole which is to be dug in the ground to a predetermined depth by means of a trenching device;

inserting into the hole section a front portion of the advanceable, multiple one-sided wedge forming means for excavating a slit hole and for supporting side walls thereof, the wedge forming means being composed of a plurality of short members which are displaceable in an advancing direction, and a motive frame means provided with a portion of the propulsion means of the apparatus and having the front end, relative to the direction, for supporting and guiding the members;

operating the activating drive means of the portion of the propulsion means to effect advancement of a slit section of the hole; while operating the activating drive means of the multiple one-sided wedge means to advance the parallel, short, one-sided wedge members in relation to the motive end portion which supports and guides the members so as to excavate alternately parallel and adjacent in side-by-side manner slit sections of the hole.

32. The method according to claim 29, utilizing the forming means further comprising a guide means disposed in the making cutter means for modifying the hole line by causing the cutting front to pivot about an at least horizontal axis, the axis being crossing perpendicularly the axis of the front end of the motive means, where the motive means is composed of a plurality of short, in relation to the motive means, motive link members, and where the cutter means comprises a number of cutter members and the cutter members and the follower link members are connected in consecutive order, relative to the advancing direction, for pivoting about at least horizontal connecting axes crossing perpendicularly a central longitudinal axis of the adjacent members and perpendicular to the direction of advancement of the members and comprising the following step of:

operating the activating drive means of the propulsion means and the activating drive means of the guide means to insert into the ground and move the directable cutter members in the working position to force a facial wall of the hole section being formed in a direction opposite to an intended diverged section of the line to cause the cutter means and the front end link member to be forced to pivot about the front connecting axis and relative to the adjacent link member toward the diverged line section so to advance the hole section in the diverged direction.

33. The method according to claim 32 and comprising following steps of:

choosing the exchangeable, directable embodiment of the curvilinear hole-making cutter means which is capable of working under the explored conditions, from a list of the preferable embodiments, the list including:

a. mill end cutter embodiments:

the multiple chain cutter;

the multiple end-and-face barrel cutter; and the multiple drilling cutter; and operating the multiple activating drive means of the guide means of every one of the mill end cutter means to move mill members of the mill end cutter means in relation to the front end link member in mutually opposite directions, while operating the activating drive means of the propulsion means to advance the mill members with the front end member so as to excavate the section of the hole in an advancing direction along a straight section of the line;

operating the propulsion means and the guide means to move the directing cutter members so as to excavate the section of the hole in an advancing direction along a straight section of the line;

operating the activating drive means of the guide means to move the directable cutter members in relation to the front end link member in an intended direction which is opposite to a direction of a diverged section of the line so as to excavate a section of the hole in an advancing direction along the diverged line section.

34. A method for advancement of a section of an excavation used in the construction of an underground structure, the method using an apparatus for digging the excavation when constructing at least the wall and stratum structure, the apparatus comprising:

a connecting framework means adapted to be disposed over the ground to produce the excavation, the excavation extends in a direction and empties in an emptying direction along a line;

a movable means for forming the excavation, the means for forming is adapted to extend from the framework means into the ground and to extract out of the formed excavation, and comprises:

a motive frame means for supporting and guiding components of the forming means, the frame means has a front end portion, in relation to the advancing direction, and a rear end portion which is supported and guided by the framework means for the movements; and an excavation-making cutter means for forming the excavation ahead of a front end of the front end portion;

a movable propulsion means for forming the excavation and supporting side walls thereof, the propulsion means being composed of a plurality of shorten, in relation to the frame means, member set means displaceable in the directions and activating drive means for effecting relative movement between the frame means and the set means to effect advancement and emptying of the excavation;

the method comprising the steps of:

operating an activating drive means of the forming means to advance the consecutive short supporting set means relative to the frame means which supports and guides the set means so that to support side walls of a section of the excavation;

operating the activating drive means to move the frame means in the advancing direction to cause the cutter means to insert into a facial wall of the hole at a forward speed $V_1$, and then in the opposite emptying direction to cause the forming means to extract out of the hole at an extract speed $V_3$, where the speeds $V_{1,3}$ must be equal to speeds of movement of the frame means in the corresponding directions by an activating drive means of the framework means, and to cause the forming means to decrease the propulsion force and the extracting force which should be applied to the frame means relative to the framework means and the overturning moments about the framework means.

35. The method according to claim 34, wherein the speeds $V_{1,3}$ of the continuous uniform movements of the frame means relative to the supporting set means are secured by:

operating the activating means of the forming means to effect the alternate longitudinal uninterruptible movement in the opposite directions between the frame means and each of the opposite side walls supporting set means, "n", with the same distances and speeds, $V_{2,4}$, relative to the frame means, where the speeds $V_{2,4}$ must be equal to no less than about $V_{2,4}=(n-1)\times V_{1,3}$.

36. The method according to claim 34, using each the set means having the ability of expansion and increasing its volume toward outside and further comprising the following step of operating an activating drive means of the set means to move opposite short, wall-supporting and frame means-supporting members of the stopped set means outwardly in opposite directions from the frame means which supports and guides the members so as to ease the advancement and emptying of the excavation.

37. The method according to claim 34 and comprising the following steps of:

digging a slot trench section of an intended length to a predetermined depth by means of a slotting trencher;

inserting a front, in relation to the advancing direction, portion of the forming means that has the at least one wall-supporting member set means into the section and forming a bosom between the walls and the set means;

filling the bosoms with dry sand;

operating the activating drive means of the set means to expand the set means and increase its volume toward outside of the frame means for fixing the portion with the expanded set means motionless in the section so as to anchor the frame means in relation to the walls.

38. The method according to claim 37 and comprising the following step of anchoring the framework means in relation to the motionless part of the motive means that having the set means which being expanded in the hole section.

39. The method according to claim 37 and comprising the following step of operating the activating means of the framework means to effect relative displacement of the framework means in an intended direction relative to the anchored portion of the frame means.

40. The method according to claim 34 and comprising the following steps of:

digging an initial section of the excavation in the ground to a predetermined depth by means of a slot trenching device;

operating an activating drive means of the framework means to insert the making cutter means and at least first and second front, in relation to the advancing direction, set means of the propulsion means in a drawn together working position into the section adjacently to side walls thereof;

operating an activating drive means of the second set means to expand and increase its volume;

operating a first activating drive means that being engaged between the first set means and the expanded second set means to displace the cutter means with the first set means and the frame means in the advancing direction relative to the fixed motionless expanded second set means to cause the cutter means and the first set means to dig a next section of the excavation;

operating an activating drive means of the first set means to expand and increase its volume;

operating the drive means of the framework means to connect a next in turn third set means to the rear second set means with the second drive means into the drawn together position;

operating the drive means of the second set means to decrease its volume toward inside;

operating the first drive means to displace the second set means toward the first set means into the drawn together position and displace the third set means into the excavation adjacently to the walls;

operating an activating drive means of the third set means to expand and increase its volume toward outside;

operating the drive means of the first set means to decrease its volume toward inside;

operating the first and second drive means to displace the first set means and the second set means in the advancing direction to advance a next section of the excavation;

operating the activating means of the framework means to connect a next in turn fourth set means to the rear third set means with the third drive means in the drawn together position;

operating the drive means of the first set means to increase its volume toward outside;

operating the drive means of the third set means to decrease its volume toward inside;

operating the first and second drive means to displace the second set means and the third set means in the excavation and the fourth set means into the drawn together position into the excavation adjacently to the walls; and repeating the operations for next in turn fifth rear set means to effect advancement of the excavation and supporting the walls while the forming means advances like a moving worm within the excavation.

* * * * *